US011891236B2

(12) United States Patent
Phelps et al.

(10) Patent No.: US 11,891,236 B2
(45) Date of Patent: Feb. 6, 2024

(54) TRANSPORT CONTAINER

(71) Applicant: PVPALLET LLC, Kirksville, MO (US)

(72) Inventors: Luke Phelps, Kirksville, MO (US); Steven Kottwitz, Kirksville, MO (US); Bryan Kottwitz, Kirksville, MO (US); Brian Trushinger, Kirksville, MO (US)

(73) Assignee: PVPallet, Inc., Montrose, IA (US)

( * ) Notice: Subject to any disclaimer, the term of this patent is extended or adjusted under 35 U.S.C. 154(b) by 0 days.

(21) Appl. No.: 17/175,741

(22) Filed: Feb. 15, 2021

(65) Prior Publication Data

US 2021/0261326 A1 Aug. 26, 2021

Related U.S. Application Data

(60) Provisional application No. 63/009,720, filed on Apr. 14, 2020, provisional application No. 62/981,396, filed on Feb. 25, 2020.

(51) Int. Cl.

| | |
|---|---|
| ***B65D 88/00*** | (2006.01) |
| ***B65D 85/62*** | (2006.01) |
| ***B65D 90/08*** | (2006.01) |

(52) U.S. Cl.

CPC ..... *B65D 88/005* (2013.01); *B65D 85/62* (2013.01); *B65D 90/08* (2013.01); *B65D 2590/02* (2013.01)

(58) Field of Classification Search

CPC .... B65D 88/005; B65D 88/52; B65D 88/522; B65D 21/08; B65D 19/44;

(Continued)

(56) References Cited

U.S. PATENT DOCUMENTS

| | | | |
|---|---|---|---|
| 3,478,995 | A | 11/1969 | Lautzenhiser et al. |
| 4,091,950 | A | 5/1978 | Craven |

(Continued)

FOREIGN PATENT DOCUMENTS

| | | | |
|---|---|---|---|
| CN | 201729335 | U | 2/2011 |
| CN | 202226134 | U | 5/2012 |

(Continued)

OTHER PUBLICATIONS

ISR for PCT/US21/18215 mailed on Apr. 28, 2021.

(Continued)

*Primary Examiner* — John K Fristoe, Jr.
*Assistant Examiner* — Laura E. Parker
(74) *Attorney, Agent, or Firm* — Nyemaster Goode, P.C.

(57) ABSTRACT

A transport container for carrying objects includes a base for supporting the objects. Opposing first and second side walls are operatively connected to the base. At least one of the side walls is movable between an extended position and a contracted position. The transport container has a first width between the first and second side walls when at least one of the side walls is in the extended position and a second width between the side walls when at least one of the side walls is in the contracted position. The second width is different from the first width. The first and second side walls are also movable between a deployed position and a collapsed position. The transport container has a first height when the side walls are in the deployed position and a second height different than the first height when the side walls are in the collapsed position.

20 Claims, 56 Drawing Sheets

(58) Field of Classification Search
CPC .. B65D 2519/00865; B65D 2519/0087; B65D 2519/00875; B65D 21/086; B65D 2519/00034; B65D 2519/00069; B65D 2519/00139; B65D 2519/00174; B65D 11/18; B65D 11/1866; B65D 11/1893
USPC ..... 220/4.01
See application file for complete search history.

(56) References Cited

U.S. PATENT DOCUMENTS

| | | | | |
|---|---|---|---|---|
| 4,445,616 | A * | 5/1984 | Mancusi | B65D 85/68 211/85.8 |
| 4,630,745 | A | 12/1986 | Shiotani | |
| 4,638,744 | A * | 1/1987 | Clive-Smith | B65D 88/522 108/56.1 |
| 4,674,647 | A | 6/1987 | Gyenge et al. | |
| 4,915,033 | A | 4/1990 | Bond | |
| 5,076,457 | A * | 12/1991 | Marovskis | B65D 11/1833 220/6 |
| 5,297,485 | A | 3/1994 | Bond | |
| 5,439,152 | A * | 8/1995 | Campbell | B60R 9/00 211/195 |
| 5,810,186 | A | 9/1998 | Lam | |
| 6,299,011 | B1 | 10/2001 | Rosenfeldt | |
| 8,064,628 | B2 | 11/2011 | Bailis et al. | |
| 8,584,338 | B2 | 11/2013 | Potter | |
| 8,789,715 | B2 | 7/2014 | Shea | |
| 8,807,364 | B2 | 8/2014 | Josefiak et al. | |
| 8,844,719 | B2 | 9/2014 | Yoshida | |
| 8,905,234 | B2 | 12/2014 | Yoshida | |
| 8,991,602 | B2 | 3/2015 | Kashima et al. | |
| 9,181,035 | B2 | 11/2015 | Sueoka et al. | |
| 9,242,761 | B2 | 1/2016 | Iwata | |
| 9,321,583 | B2 | 4/2016 | Potter | |
| 9,409,702 | B2 | 8/2016 | Sueoka et al. | |
| 9,481,512 | B2 | 11/2016 | Diniaco | |
| 9,546,755 | B2 | 1/2017 | Barrett et al. | |
| 9,714,135 | B2 | 7/2017 | Kamata | |
| 10,232,979 | B2 | 3/2019 | Takyar et al. | |
| 2004/0129699 | A1 | 7/2004 | Williams | |
| 2005/0284830 | A1 | 12/2005 | Snyker et al. | |
| 2011/0024325 | A1 | 2/2011 | Winderlich | |
| 2012/0000957 | A1 | 1/2012 | Shea et al. | |
| 2014/0208686 | A1 | 7/2014 | Ruddell | |
| 2014/0261102 | A1 | 9/2014 | Kuo et al. | |
| 2017/0015497 | A1 | 1/2017 | Diniaco | |
| 2018/0064798 | A1 | 3/2018 | Numa-Beaujour | |
| 2018/0346229 | A1 | 12/2018 | Geurdrum et al. | |
| 2019/0283962 | A1 | 9/2019 | Skaaksrud et al. | |
| 2019/0305720 | A1 | 10/2019 | Rogalka | |
| 2019/0320835 | A1 | 10/2019 | Dehner et al. | |
| 2019/0322417 | A1 | 10/2019 | Hurt et al. | |

FOREIGN PATENT DOCUMENTS

| | | | | |
|---|---|---|---|---|
| CN | 203127497 | U | 12/2012 | |
| CN | 103057854 | A | 4/2013 | |
| CN | 102616471 | B | 12/2013 | |
| CN | 203865321 | U | 5/2014 | |
| CN | 204701896 | U | 10/2015 | |
| CN | 10508378 | A | 11/2015 | |
| CN | 105083795 | A | 11/2015 | |
| CN | 204737183 | U | 11/2015 | |
| CN | 105129254 | A | 12/2015 | |
| CN | 204896227 | U | 12/2015 | |
| CN | 204896315 | U | 12/2015 | |
| CN | 204896316 | U | 12/2015 | |
| CN | 204896351 | U | 12/2015 | |
| CN | 205418517 | U | 8/2016 | |
| CN | 205633574 | U | 10/2016 | |
| CN | 205633609 | U | 10/2016 | |
| CN | 206407354 | U | 8/2017 | |
| CN | 105083746 | B | 9/2017 | |
| CN | 207292979 | U | 5/2018 | |
| CN | 108657631 | A | 10/2018 | |
| CN | 208149849 | U | 11/2018 | |
| CN | 108945815 | A | 12/2018 | |
| CN | 208199148 | U | 12/2018 | |
| CN | 108146883 | B | 3/2019 | |
| CN | 208647416 | U | 3/2019 | |
| CN | 208683497 | U | 4/2019 | |
| CN | 109747969 | A | 5/2019 | |
| CN | 209218013 | U | 8/2019 | |
| CN | 209225857 | U | 8/2019 | |
| CN | 209259669 | U | 8/2019 | |
| CN | 209536034 | U | 10/2019 | |
| CN | 209889305 | U | 1/2020 | |
| CN | 209889455 | U | 1/2020 | |
| CN | 209889464 | U | 1/2020 | |
| CN | 209973091 | U | 1/2020 | |
| DE | 20117881 | U1 * | 1/2002 | B65D 88/005 |
| DE | 10306484 | A1 | 8/2004 | |
| DE | 202005018965 | U1 | 3/2006 | |
| DE | 202006005284 | U1 | 7/2006 | |
| DE | 202008011823 | U1 | 2/2009 | |
| DE | 202008016209 | U1 | 3/2009 | |
| DE | 102008012928 | B3 | 6/2009 | |
| DE | 202009007881 | U1 | 9/2009 | |
| DE | 102013005150 | A1 | 4/2014 | |
| DE | 202015101703 | U1 | 6/2015 | |
| DE | 202015102753 | U1 | 6/2015 | |
| EP | 211116 | A * | 2/1987 | B65D 19/18 |
| EP | 2196403 | B1 | 2/2015 | |
| EP | 2722291 | B1 | 1/2016 | |
| EP | 3078924 | A1 | 10/2016 | |
| IN | 20134231 | P4 | 8/2014 | |
| IN | 20132199 | P3 | 10/2014 | |
| IN | 20134050 | P4 | 1/2015 | |
| IN | 20146515 | P4 | 7/2016 | |
| IN | 20146637 | P4 | 7/2016 | |
| IN | 20147027 | P4 | 7/2016 | |
| IN | 201717033459 | A | 12/2017 | |
| IN | 201921001803 | A | 9/2019 | |
| JP | 2005231701 | A | 9/2005 | |
| JP | 20072223639 | A | 9/2007 | |
| JP | 2008308199 | A | 12/2008 | |
| JP | 4544848 | B2 | 9/2010 | |
| JP | 2012140159 | A | 7/2012 | |
| JP | 2012232781 | A | 11/2012 | |
| JP | 2012246021 | A | 12/2012 | |
| JP | 2013163542 | A | 8/2013 | |
| JP | 5749345 | B2 | 7/2015 | |
| KR | 2020001646 | A | 2/2020 | |
| TH | 118350 | A | 11/2012 | |
| TH | 134278 | A | 3/2014 | |
| TH | 134297 | A | 6/2014 | |
| TW | 201315657 | A | 4/2013 | |
| WO | 2008059241 | A2 | 5/2008 | |
| WO | 2011071076 | A1 | 6/2011 | |
| WO | 2012006165 | A9 | 1/2012 | |
| WO | 2013118808 | A1 | 8/2013 | |
| WO | 2013121259 | A1 | 8/2013 | |
| WO | 2013121461 | A1 | 8/2013 | |
| WO | 2013128926 | A1 | 9/2013 | |
| WO | 2013170851 | A1 | 11/2013 | |
| WO | WO-2015020109 | A1 * | 2/2015 | B65D 88/005 |
| WO | 2015174830 | A1 | 11/2015 | |
| WO | 2018102868 | A1 | 6/2018 | |
| WO | 2018175110 | A1 | 9/2018 | |
| WO | 2018211012 | A1 | 11/2018 | |
| WO | 2019216915 | A1 | 11/2019 | |

OTHER PUBLICATIONS

International Searching Authority, "Search Report and Written Opinion," issued in connection with International Patent Application No. PCT/US2021/018215, dated Apr. 28, 2021, 7 pages.
International Search Report dated Apr. 28, 2021. International application No. PCT/US21/18215, 15-pages.

* cited by examiner

TRANSPORT CONTAINER

CROSS-REFERENCE TO RELATED APPLICATIONS

The present application claims priority to U.S. Provisional Application No. 62/981,396, filed Feb. 25, 2020, and claims priority to U.S. Provisional Application No. 63/009,720, filed Apr. 14, 2020, which are hereby incorporated by reference in their entireties.

FIELD OF THE DISCLOSURE

The present disclosure generally relates to transport containers and, more particularly, to transport containers for planar objects, such as solar or photovoltaic (PV) panels.

BACKGROUND OF THE DISCLOSURE

Planar objects, like solar panels, may be stored or shipped in various containers. For example, such objects may be stacked together, strapped on a shipping pallet, and shipped to an installation site. At least some known containers do not adequately protect solar panels inside the container during storage or transit. As a result, the solar panels may become scratched, bent, or broken, causing additional costs and delays in installation while replacement solar panels are sent to the job site.

Additionally, on various job sites, the solar panels are removed from the container as they are needed. However, because the solar panels are staked or arranged from one end of the container to the other, as solar panels are removed from at least some known containers, the remaining panels can fall or slip down the container sidewall, which may result in scratching or damaging the panel surface.

SUMMARY OF THE DISCLOSURE

In one aspect, a transport container for carrying one or more generally planar objects comprises a base configured to support the one or more generally planar objects. Opposing first and second side walls are operatively connected to the base. At least one of the first and second side walls is movable between an extended position and a contracted position. The transport container has a first width between the first and second side walls when said at least one of the first and second side walls is in the extended position and a second width between the first and second side walls when said at least one of the first and second side walls is in the contracted position. The second width is different from the first width. The first and second side walls are movable between a deployed position and a collapsed position. The transport container has a first height when the first and second side walls are in the deployed position and a second height different than the first height when the first and second side walls are in the collapsed position.

In another aspect, a transport container for carrying one or more generally planar objects comprises a base configured to support the one or more generally planar objects. First and second side walls are supported by the base. At least one of the first and second side walls is movable relative to the other of the first and second side walls to change a distance between the first and second side walls to conform the distance to a dimension of the one or more generally planar objects. The first and second side walls are movable between a deployed position and a collapsed position. In the deployed position, the first and second side walls are generally upright. In the collapsed position, the first and second side walls lay generally flat on the base.

In another aspect, a method of erecting a transport container for carrying one or more generally planar objects comprises moving first and second side walls of the transport container from a collapsed position in which the first and second side walls lie on a base of the transport container to a deployed position in which the first and second side walls are generally upright; and moving one or both of the first and second side walls relative to the base to adjust a width between the first and second side walls to conform to a dimension of the one or more generally planar objects.

Other objects and features of the disclosure with be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DISCLOSURE

The present disclosure generally relates to transport containers and, more particularly, to transport containers for planar objects, such as solar or photovoltaic (PV) panels. The transport containers described herein can be expanded to fit different sizes of solar panels. The transport containers include side walls to adequately protect the solar panels and supports to prevent the solar panels from falling. The transport containers can also be collapsed for convenient storage after the solar panels have been unloaded from the container.

Figure 1:
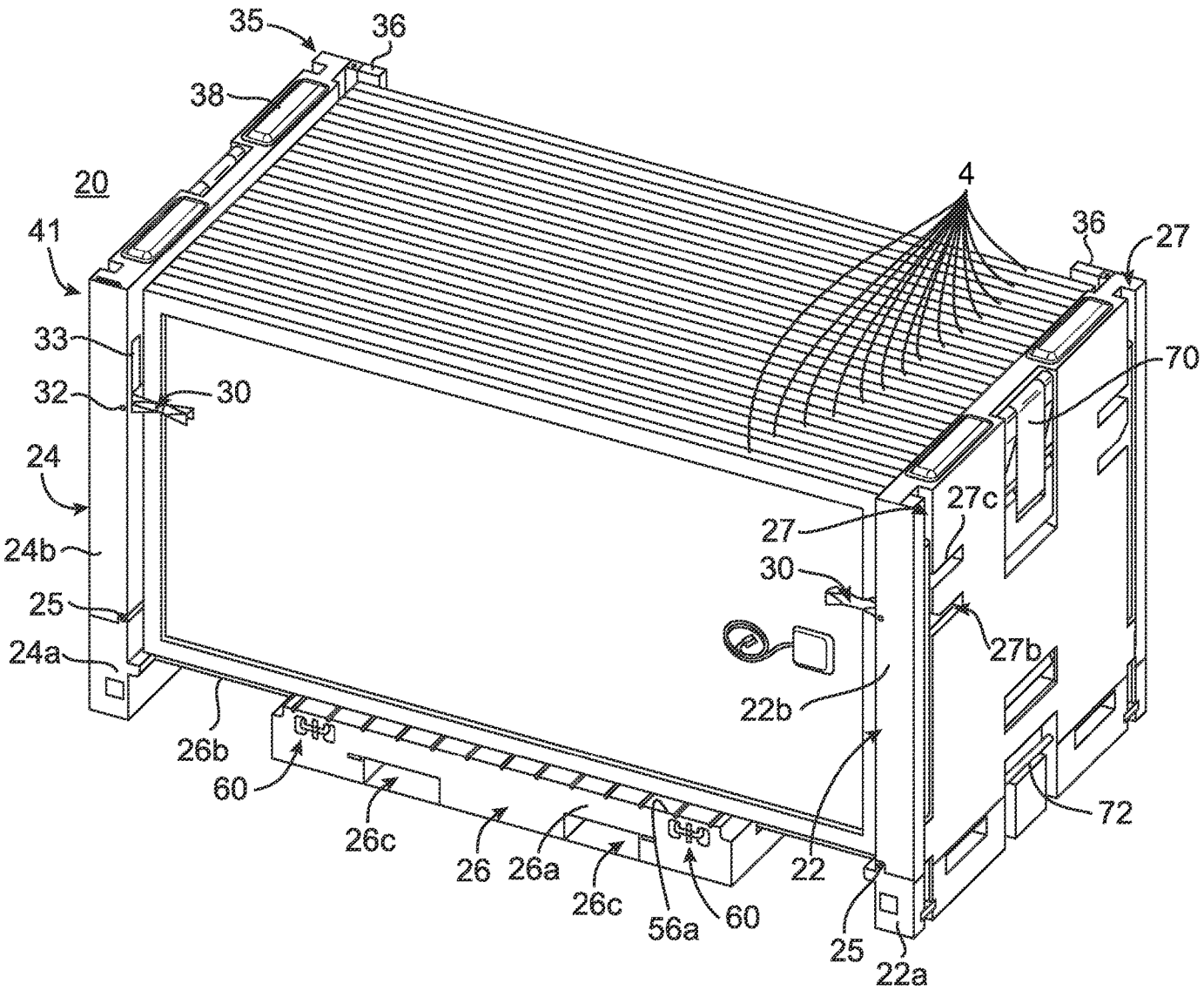
FIG. 1 is a rear perspective of a container according to one embodiment of the present disclosure supporting a plurality of solar panels.
Figure 2:
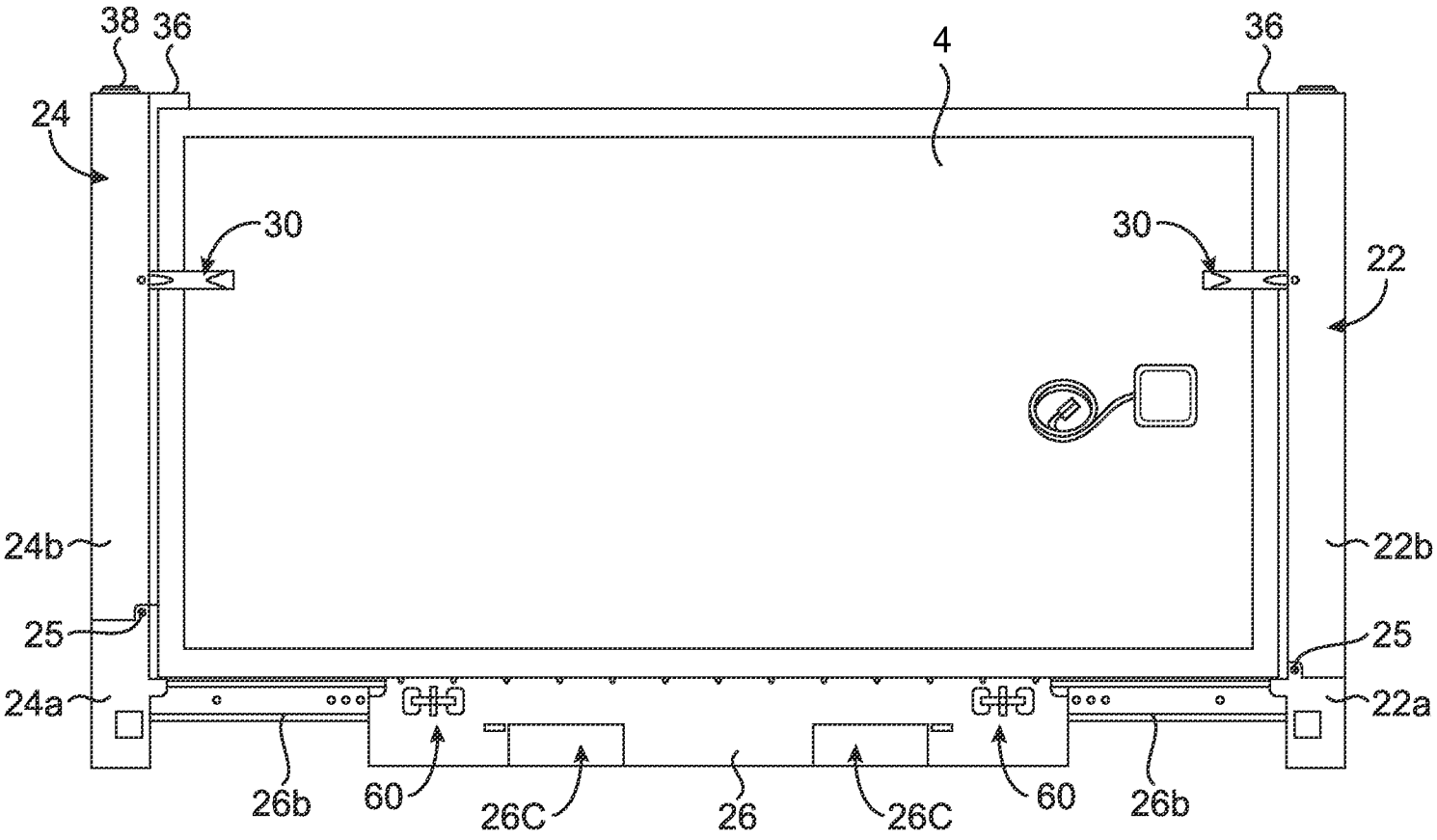
FIG. 2 is a rear elevation thereof.
Figure 4:
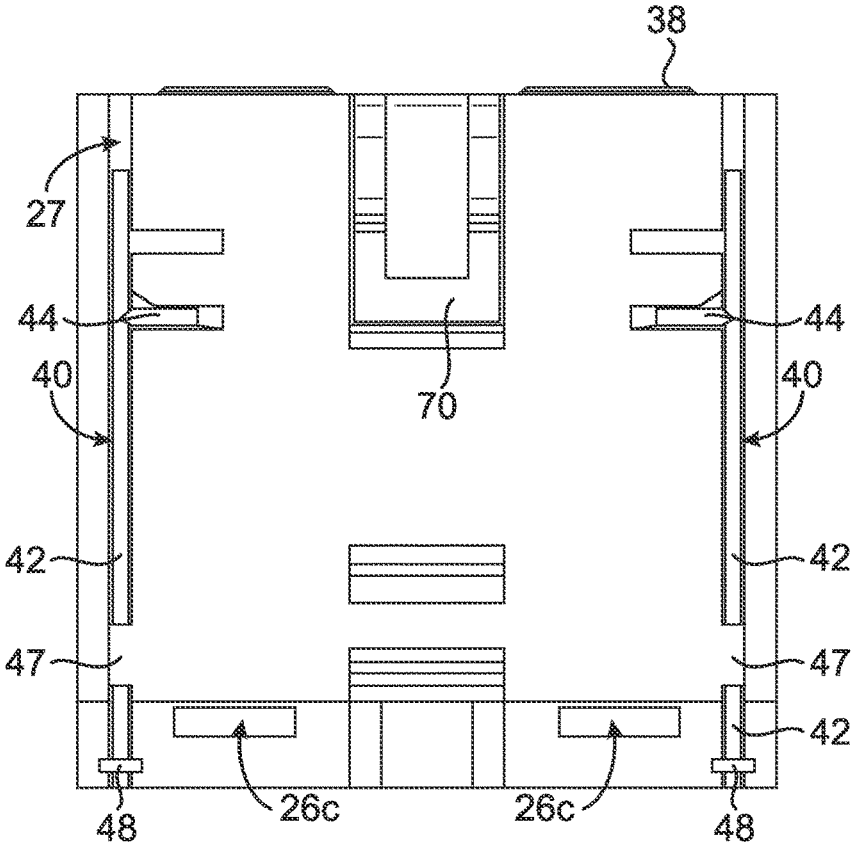
FIG. 4 is a side elevation of a side wall of the container shown in FIG. 1.
Figure 5:
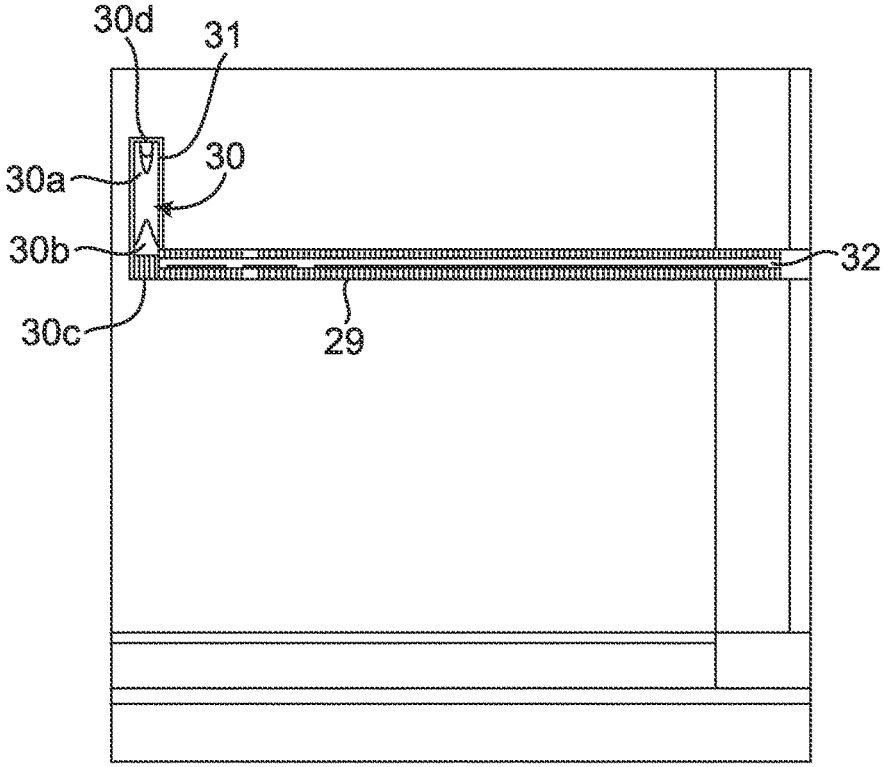
FIG. 5 is an opposite side elevation of the side wall of the container shown in FIG. 1.

Referring to the drawings in more detail, and specifically FIG. 1, the reference numeral 20 generally refers to an embodiment of the present disclosure, an improved stackable container (i.e., transport container) and method for using the improved stackable container, the container generally referred to as reference number 20 and the method generally referred to as reference number 120. FIG. 1 illustrates an embodiment of the present disclosure, the improved stackable container 20 made from plastic, metal or wood with a first side wall 22 separated from a second side wall 24 by a telescoping base 26 which extends from a contracted orientation to an expanded orientation, the expanded orientation illustrated in FIG. 1 and the contracted position illustrated in FIG. 4. The first and second side walls 22, 24 are pivotally connected to the base 26 allowing for rotation of the walls 22, 24 from a vertical orientation to a horizontal orientation as desired. The depicted embodiment of the walls 22, 24 may be solid, partially solid or hollow but as illustrated in FIG. 2 includes a plurality of flutes or interior members 23 which extend from the base 26 upward vertically or horizontally for reinforcement of the container 20 while allowing the walls 22, 24 to remain lightweight.

FIG. 1 illustrates the improved stackable container 20 in receipt of a solar panel 4 extending between the first side wall 22 and the second side wall 24, each of the first and second side walls 22, 24 including a rotatable side support 30 and a rear support 36 extending from each of the first and second side walls 22, 24. The rotatable side support 30 generally provide lateral support to the received panels 4 to limit lateral movement during shipping, storage or while in use. In addition, each rear support 36 is rotatable from a channel within the first or second side wall 22, 24 outwardly to present a supporting surface for limiting movement of the received panels 4.

The first side wall 22 is depicted with a first lower portion 22*a* separable from a first upper portion 22*b* along a rotatable joint 25, the first upper portion 22*b* rotatable between the vertical and horizontal orientation while the first lower portion 22*a* remains in a generally upright, vertical orientation. The first side wall 22 and second side wall 24 provide support for containing the panels 4 during shipping and storing and for stacking of multiple containers 20 on top of each other as desired.

In the depicted embodiment of FIG. 2, the first side wall 22 and second side wall 24 include at least one corner channel 27 which extends upwardly from the telescoping base 26 and is adapted for receipt of a rotational support 40 as further described below. An annular support 47 is provided for securing and receiving the rotational support 40 and is secured to the corner channel 27.

Figure 8:
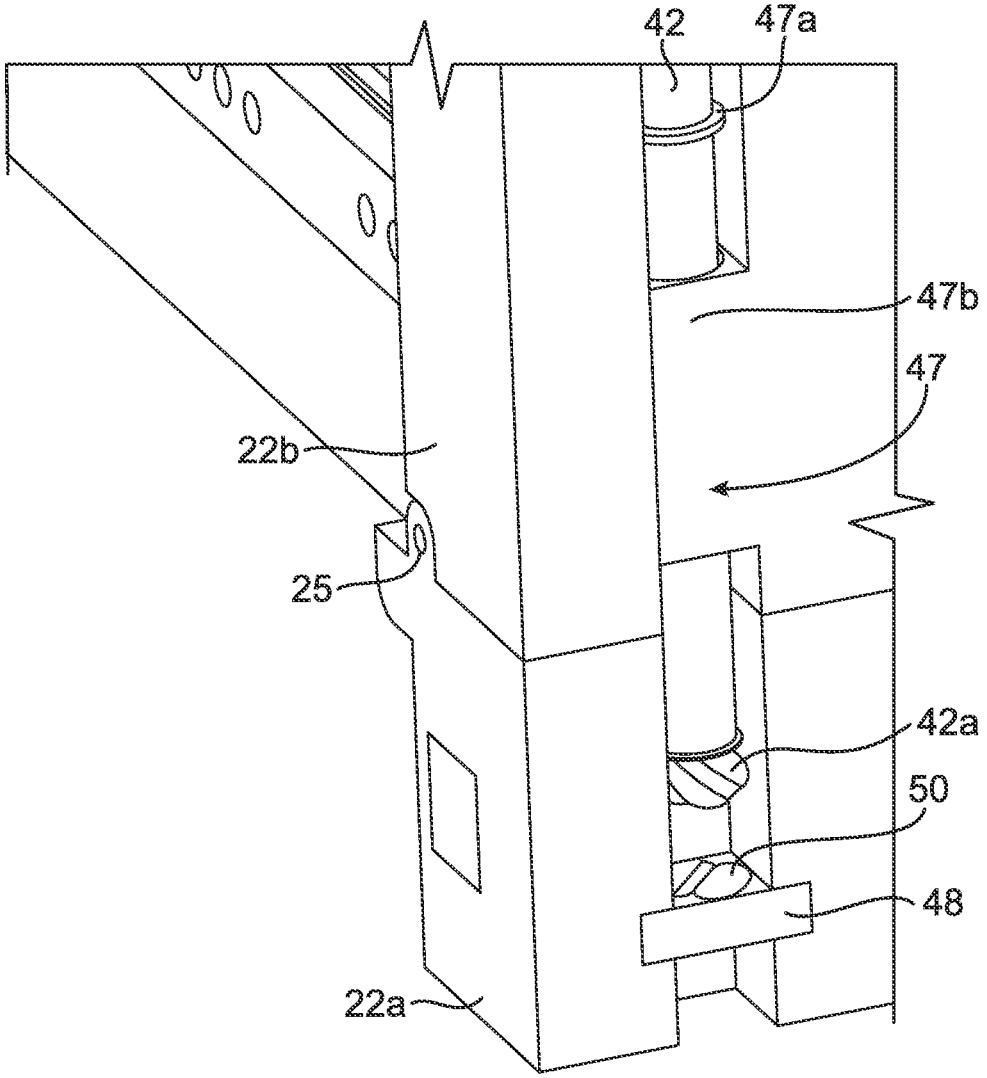
FIG. 8 is a fragmentary side perspective of a portion of the container shown in FIG. 1, showing a rotational support received within a corner channel for threaded receipt by an anchoring structure.

As depicted in FIGS. 1-4, a pair of annular supports 47 are spaced along the corner channel 27 for securing an upper and lower region of each rotational support 40 within the corner channel 27. Generally, the annular support 47 is cylindrical and presents a circular opening for receiving the rotational support 40 and providing it support as it rotates within the corner channel 27. In the embodiment of the annular support 47 depicted in FIG. 8A, the annular support 47 also includes an annular ring 47*a* extending radially from the circular opening. In addition, as illustrated, the annular support 47 is connected to the corner channel 27 with a spanning member 47*b* extending from the corner channel 27 to the annular support 47. The spanning member 47*b* could be an extrusion or formed as part of the manufacturing process or it could be a mechanical or adhesive joint, but generally, the spanning member 47*b* secures the annular support 47 to the corner channel 27 with sufficient support to allow the annular support 47 to securely receive and retain the rotational support 40.

Each of the first side wall 22 and second side wall 24 are depicted with a horizontal channel 29 having a plurality of annular grooves 29*a*. The horizontal channel 29 generally extends from a U-shaped front wall surface 41 depicted in FIG. 6 to a U-shaped rear wall surface 35 and is configured for slidable receipt of a rotatable side support 30 as it moves along the central axis 32 and for securing the rotatable side support 30 when it is in the locked position.

Figure 10A:
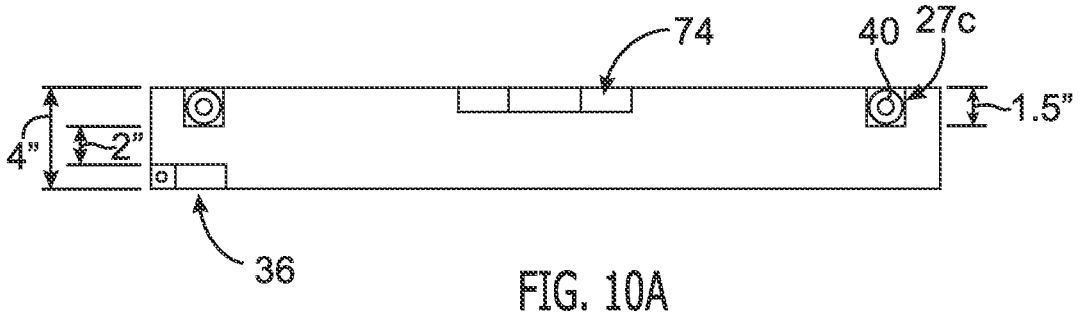
FIG. 10A is a top plan view of a side wall of the container shown in FIG. 1.
Figure 10B:
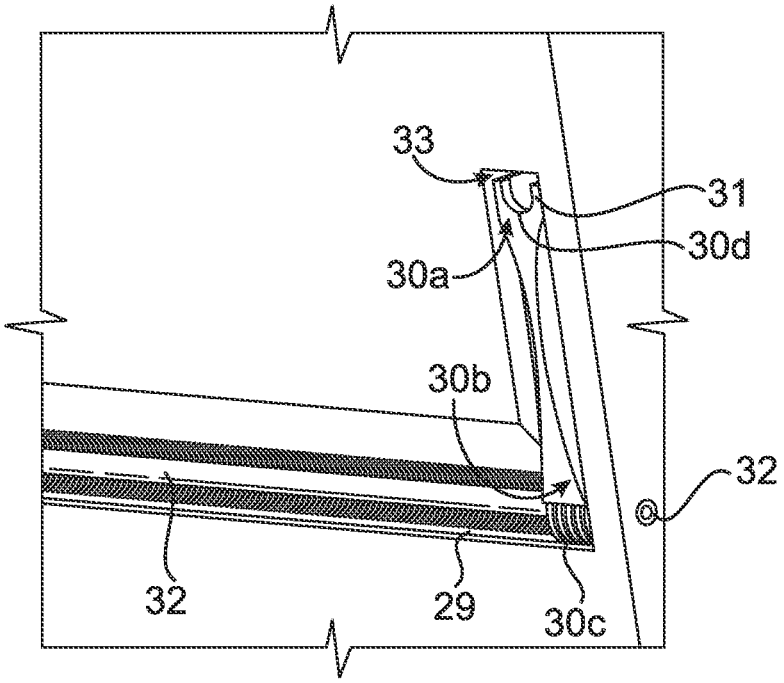
FIG. 10B is a fragmentary side perspective of a rotatable sliding mechanism of the container shown in FIG. 1 in a recessed, stored position.
Figure 10C:
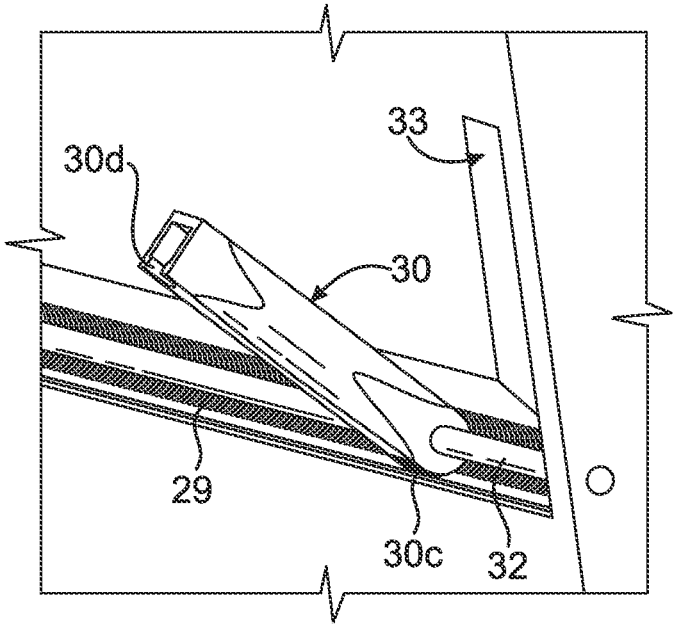
FIG. 10C is a fragmentary side perspective of the rotatable sliding mechanism of the container shown in FIGS. 1 and 10B in a sliding position.
Figure 10D:
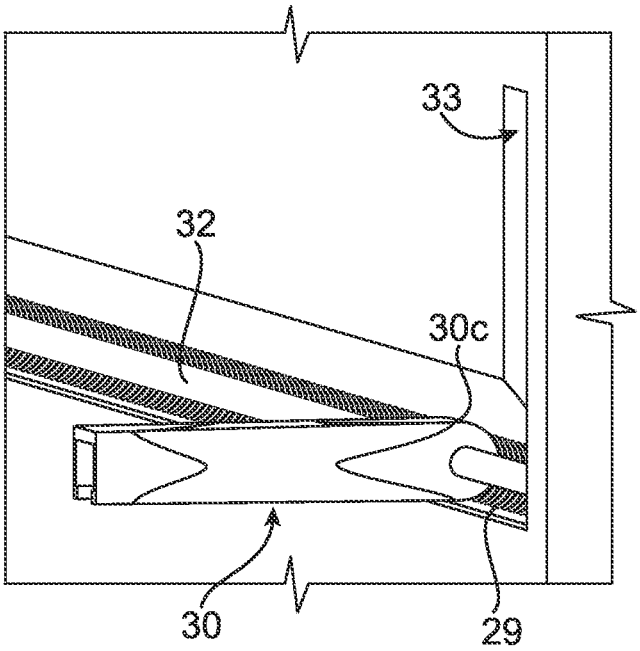
FIG. 10D is a fragmentary side perspective of the rotatable sliding mechanism of the container shown in FIGS. 1 and 10B in an engaged position.

The rotatable side support 30 generally provides an adjustable clamping mechanism for supporting the received panels 4 during transport, storing and unloading. The rotatable side support 30 generally rotates between a locked position, a sliding position and a stored position. The stored position is illustrated in FIG. 10B. The sliding position is illustrated in FIG. 10C and the locked position is illustrated in FIG. 10D, Generally, the rotatable side support 30 includes a rotatable arm 31 which when rotated angularly from the locked or stored position can move laterally, between the front and rear wall surface 41, 35 of each of first and second side walls 22, 24. For sliding lateral movement, the rotatable arm 31 is generally rotated angularly between about 0 degrees and about 90 degrees but as depicted in FIG. 10C is closer to about 45 degrees. When the rotatable side support 30 is in the sliding position, the rotatable arm 31 can slide along the central axis 32 from the front wall surface 41 towards the rear wall surface 35 to provide adjustable support for any panels 4 left in the container 20. In this way, as panels 4 are removed from the container 20, the rotatable side support 30 traverses the central axis 32 to support the remaining panels 4. In the locked position the rotatable arm 31 is rotated perpendicular to the first or second side wall 22, 24 and in the stored position, the rotatable arm 31 is recessed within an elongated receiver 33 (as shown in FIG. 10C) located near the front wall surface 41.

The rotatable arm 31 is generally a rectangular tubular member with a curved proximate end 30*a* and a square distal end 30*b*, the curved proximate end 30*a* including a plurality of circumferential projections 30*c* and the square distal end

30*b* including a slotted curved groove 30*d* located along the top of the tubular member. Portions of the rotatable side support 30 are depicted in FIGS. 2, 3 and 5 and 10B-D. The rotatable side support 30 generally includes a rotatable arm 31 with a central aperture 31*a* rotational about a central axis 32 and extending from the proximate end 30*a* to a distal end 30*b*. The proximate end 30*a* is rotational about a central axis 32 received by the central aperture 31*a*. The proximate end 30*a* also includes a plurality of circumferential projections 30*c* each in helical alignment with a corresponding annular groove 29*a* extending along the horizontal channel 29.

After the rotatable side support 30 is slide laterally into the desired position, the rotatable arm 31 is rotated further into the locked position so that the panels 4 can be supported. By way of example, in the locked position the rotatable arm 31 is configured for threaded engagement with the horizontal channel 29. As the rotatable arm 31 is rotated, the circumferential projections 30*c* extending from the proximate end 30*a* of the rotatable arm 31 are threaded into the annular grooves 29*a* associated with the horizontal channel 29. This allows the rotatable arm 31 to be locked into place along the horizontal channel 29. As the rotatable arm 31 is rotated, each of the circumferential projections 30*c* engage a corresponding annular groove 29*a*.

Figure 3:
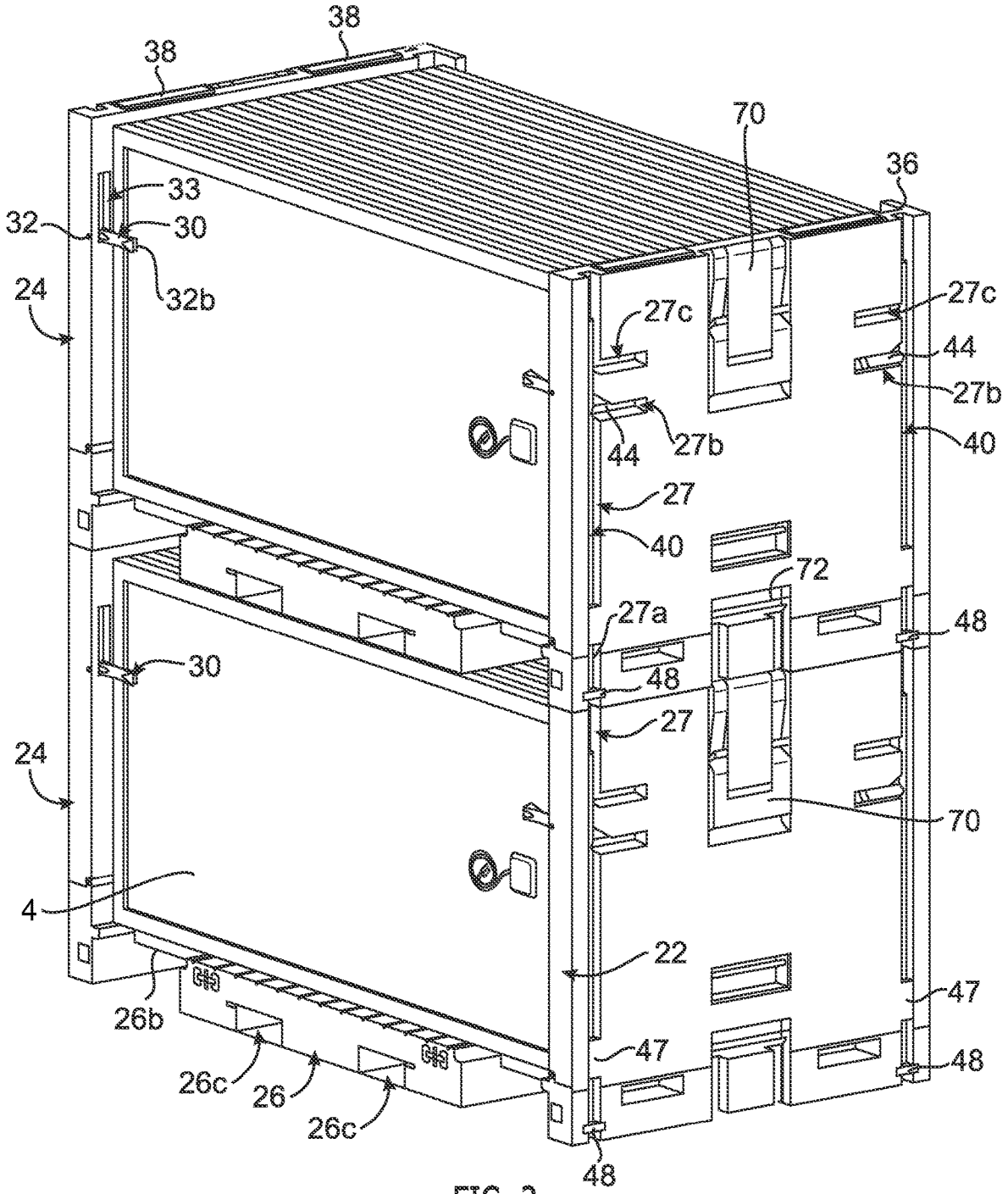
FIG. 3 is a rear perspective of a stacked pair of containers shown in FIG. 1.

One embodiment of the central axis 32 includes a cylindrical rod extending rearwardly through the rotatable side support 30 within the horizontal channel 29 the cylindrical rod being secured at each end of the front and rear wall surfaces 33, 35. The rotatable side support 30 illustrated in FIGS. 2 and 3 is generally positioned along the front wall surface 41 while in the stored position and adapted for outward rotation. In the non-rotated orientation, the rotatable side support 30 is recessed within an elongated receiver 33 associated with the front wall surface 41. When desired, the rotatable side support 30 can be rotated out of the way or rotated outwardly as desired to provide a front supporting surface extending at least partially along the surface of the panel 4. Generally, the rotatable side support 30 is used to stabilize the received panels 4 and can be rotated back into the elongated receiver 33 as desired.

Frictional movement of the rotatable arm 31 is provided by frictional engagement of the circumferential projections 30*c* and annular grooves 29*a* as the rotatable arm 31 is rotated about the central axis 32 to keep the rotatable arm 31 in an outward orientation as desired. Generally, the plurality of annular grooves 29*a* are spaced along the horizontal channel 29 for receipt of the plural circumferential projections 30*c* associated with the proximal end 30*a* of the rotatable side support 30. In the embodiment depicted in FIG. 5, the rotatable side support 30 includes an arcuate groove 30*d* adapted for receipt of a finger or tool which may be useful for operating the rotatable side support 30 during upward rotation of the rotatable side support 30.

Figure 11:
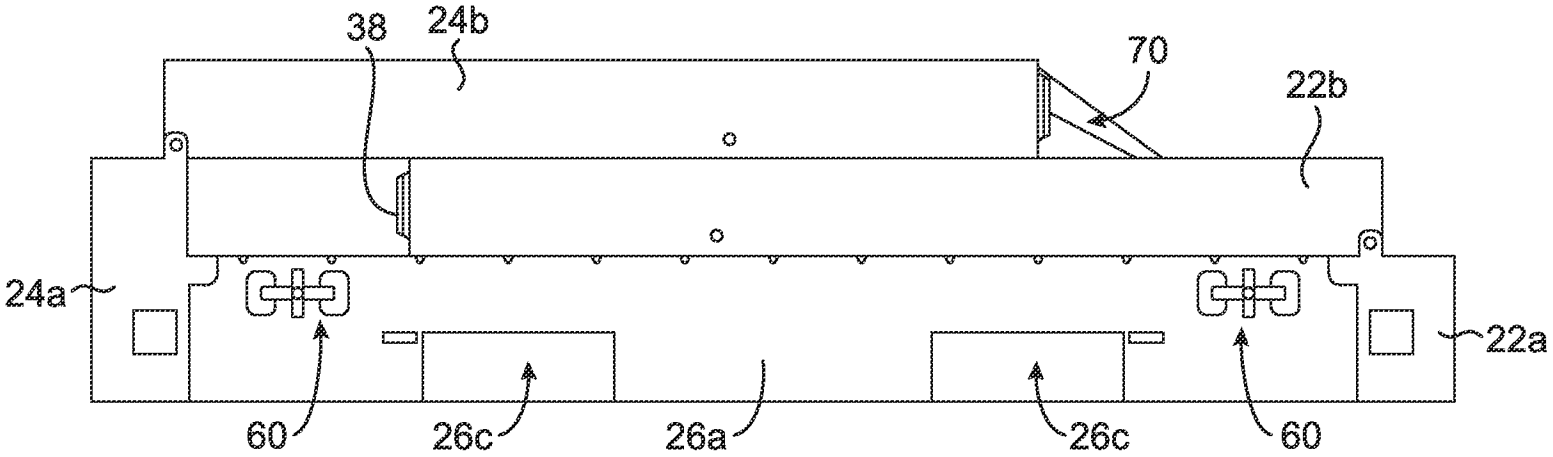
FIG. 11 is a side elevation of the container shown in FIG. 1 in a folded configuration.

The second side wall 24 includes a second lower portion 24*a* separable from a second upper portion 24*b* along rotatable joint 25, the second upper portion 24*b* rotatable between the vertical and horizontal orientation while the second lower portion 24*a* remains in a generally upright vertical orientation, the rotatable joint 25 in the first side wall 22 being offset from the rotatable joint 25 in the second side wall 24 as illustrated in FIG. 11 such that the first upper portion 22*b* is horizontally aligned with the rotatable joint 25 associated with the second lower portion 24*a*.

The rotational support 40 is illustrated in FIGS. 1-4. Generally, the rotational support 40 helps secure the outside of the first and second side walls 22, 24 to the telescoping base 26 in the upright position without additional internal or inner facing support structures like an angle brace. The rotational support 40 includes a generally cylindrical body 42 with a handle 44 which are housed within the corner channel 27 which includes a vertical portion 27*a* and a lower horizontal depression 27*b* and an upper horizontal depression 27*c*. The vertical portion 27*a* is generally configured for housing the cylindrical body 42 while the lower horizontal depression 27*b* is generally configured for housing the handle 44 while the cylindrical body 42 is in the lower position. The handle 44 is in communication with the cylindrical body 42 for controlled operation of the rotational support 40 between an uncoupled position and a coupled position. The cylindrical body 42 generally extends from the handle 44 to a threaded end 42*a* (not shown).

An anchor 46 is associated with the telescoping base 26 and at least one threaded joint 48 is located between the anchor 46 and the cylindrical body 42. Generally, the anchor 46 is open-ended so that when any debris can be removed from the anchor 46 during engagement with the rotational support 40. In engaged operation, the anchor 46 is secured to the telescoping base 26 using for example mechanical or chemical (i.e. adhesive) fasteners. Alternatively, the anchor 46 may be fabricated as part of the telescoping base 26. The anchor 46 generally secures the rotational support 40 during operation.

The threaded joint 48 includes a circumferential ring 49 with an inner helical receiver 50 configured for receiving the threaded end 42*a* of the cylindrical body 42. For coupled operation of the rotational support 40, the handle 44 is rotated, directing the cylindrical body 42 to rotate which screws the threaded end 42*a* into the threaded joint 48. By counter rotating the handle 44, the cylindrical body 42 is counter rotated, unscrewing the threaded end 42*a* from the threaded joint 48, uncoupled the cylindrical body 42 from the anchor 46. In the uncoupled orientation, the cylindrical body 42 is separable from the anchor 46. In the coupled orientation, the rotational support 40 provides support and rigidity to the depicted walled sections, the first side wall 22 and second side wall 24 while in an upright, vertical orientation. In the uncoupled orientation, the rotational supports 40 allow the first and second side wall 22, 24 to be folded into the horizontal orientation.

In the uncoupled orientation, the rotational support 40 may be separated from the anchor 46 and moved vertically. In this way, the cylindrical body 42 may be lifted and raised from the lower position to a raised position with the handle 44 aligned with the upper horizontal depression 27*c*.

Figure 6:
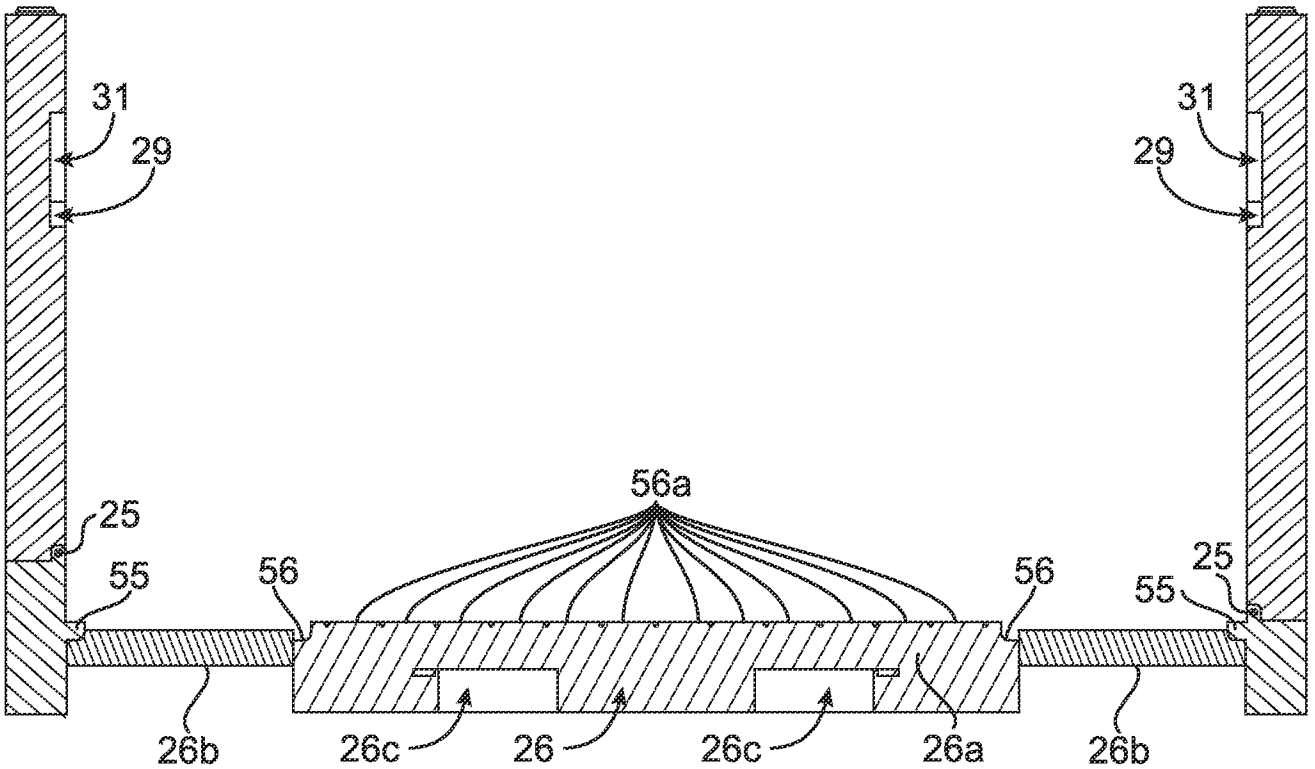
FIG. 6 is a cross-section of the container shown in FIG. 1.
Figure 7A:
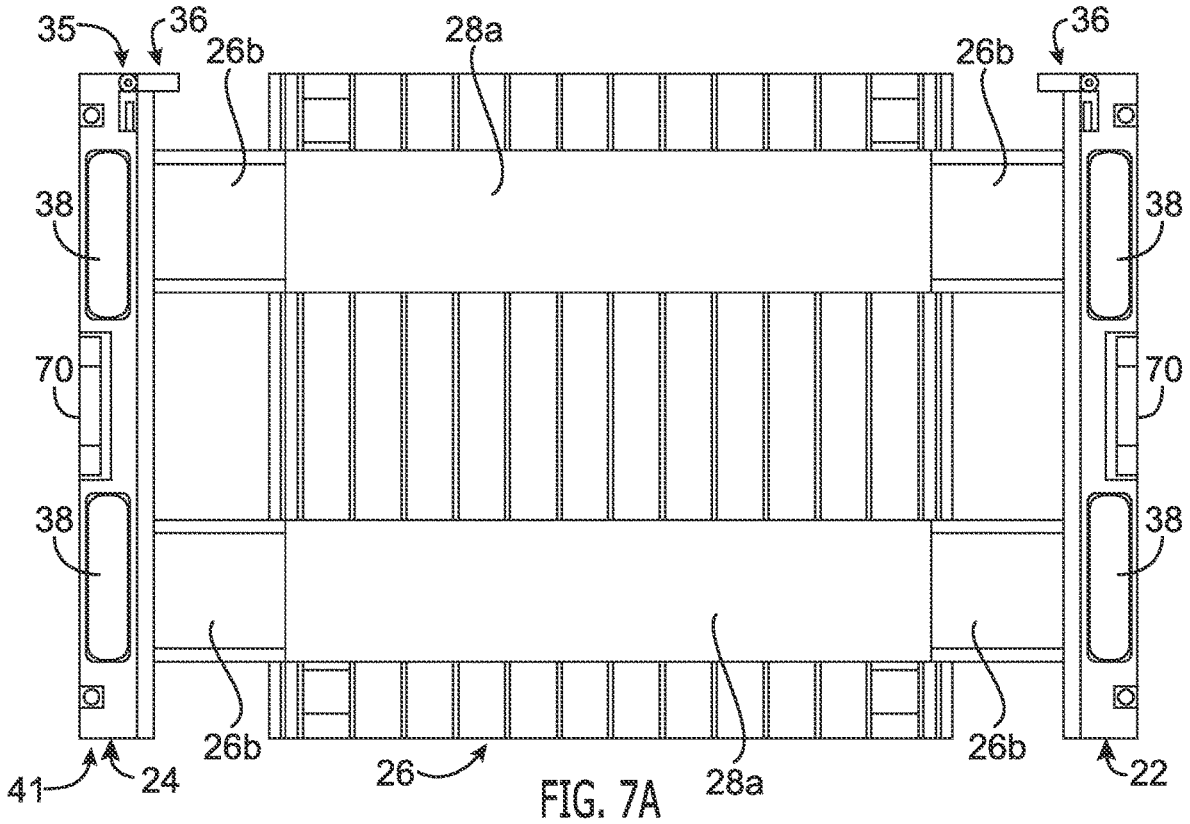
FIG. 7A is a top plan view of the container shown in FIG. 1 in an upright, expanded position.
Figure 7B:
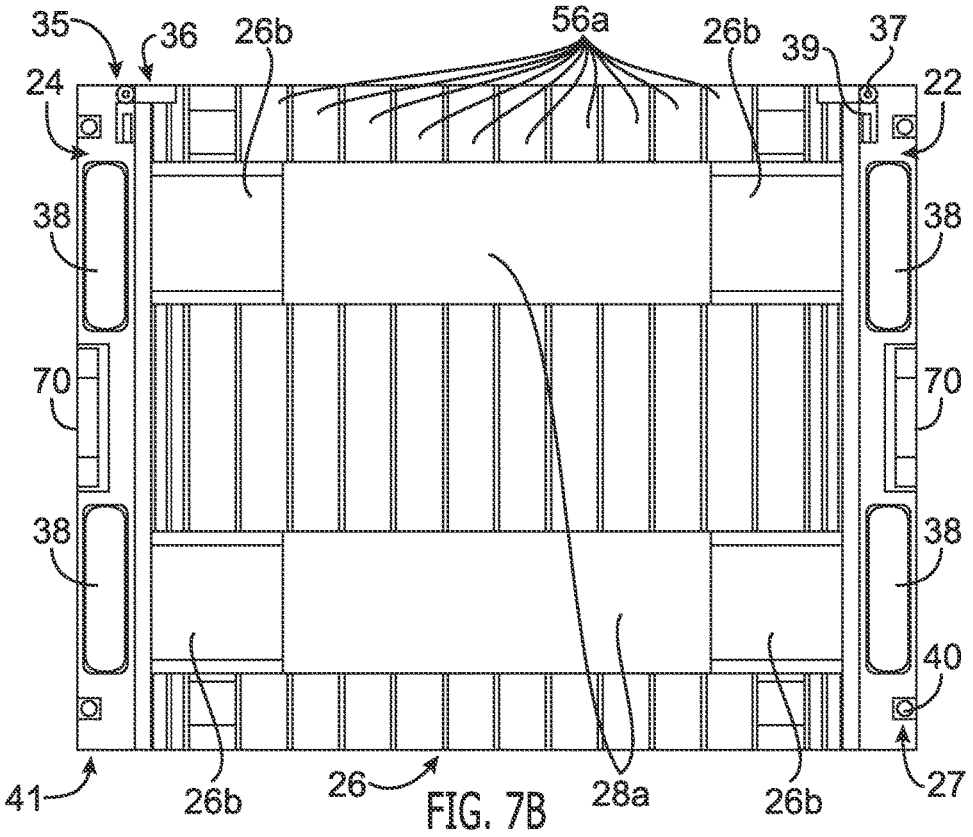
FIG. 7B is a top plan view of the container shown in FIG. 1 in an upright, contracted position.

The telescoping base 26 is illustrated in FIGS. 1-7B and generally extends from an expanded orientation illustrated in FIGS. 1-3, 6, and 7A to a contracted orientation illustrated in FIG. 7B. Generally, the telescoping base 26 includes a rectangular central body 26*a* with a pair of central channels 26*c*, a pair of tensioned locking mechanisms 60 in communication with a plurality of telescopic support members 26*b* which can be recessed within the central body 26*a*. The central body 26*a* includes a pair of boss receiving channels 56 configured for receipt of a boss projection extending interiorly from one of the side walls 22, 24. A pair of telescopic support members 26*b* are generally configured for receipt within a pair of longitudinal channels 28*a* extending longitudinally though the telescoping base 26.

As depicted in FIG. 2, the central body 26*a* provides a rigid member for supporting the received panels 4 and is generally constructed of a parallel square tubing members in a general rectangular configuration with rearward support members 56*a* extending rearwardly behind the central body 26*a* a length corresponding to the first and second side walls 22, 24. Each of the telescopic support members 26*b* are be received within the longitudinal channels 28*a* and extend from the central body 26*a*, outward to the first and second side walls 22, 24. The central channels 26*c* generally includes with a pair of parallel support channels extending laterally through the central body 26*a* and presenting a receiver which can be used for lifting or carrying the container 20 from a first location to a second location with for example, a fork-lift. In the depicted embodiment, the telescoping base 26 is symmetrical with generally the same number of sections on the left and the right. The telescopic support members 26*b* may be fabricated from plank of wood, metal or plastic or fabricated from other suitable material for supporting the received panels 4. Support brackets and extendable sections, the tensioned locking mechanism 60, the longitudinal channels 28*a* and the telescopic support members 26*b* may be manufactured as part of the central body 26*a*, or fastened thereto using fasteners or fastening techniques generally known in the art.

As can be shown in FIGS. 6, 7A, and 7B the central body 26*a* acts in a telescopic manner with the telescopic support members 26*b* sliding telescopically away from or towards the central body 26*a*, the tensioned locking mechanism 60 used to fix the telescopic support members 26*b* while allowing for adjustment in the size of the container 20. As is generally known, the outside diameter of the telescoping support member 26*b* is slightly less than the inside dimension of the longitudinal channel 28*a* which, in turn, has an outside diameter less than or equal to the dimension of the central body 26*a* thereby presenting a substantially planar outer surface for receiving and supporting the panels 4. It can thus be appreciated that the telescopic support members 26*b* will telescopically slide for desired adjustment within a wide range of lengths as depicted in FIG. 6. When expanded to the desired dimension, the central body 26*a* can be secured with the use of pins or bolts inserted through receivers in the central body 26*a*, the telescopic support members 28 and each telescopic support member 26*b* and retained in position by keepers.

As depicted, the tensioned locking mechanism 60 is used to provide projecting locking members for securing the telescopic support members 26*b* in the desired length. The end of the telescopic support member 28 in contact with the first and second side wall 22, 24 will have a connection plate which is secured to each of the first and second side wall 22, 24.

Figure 12:
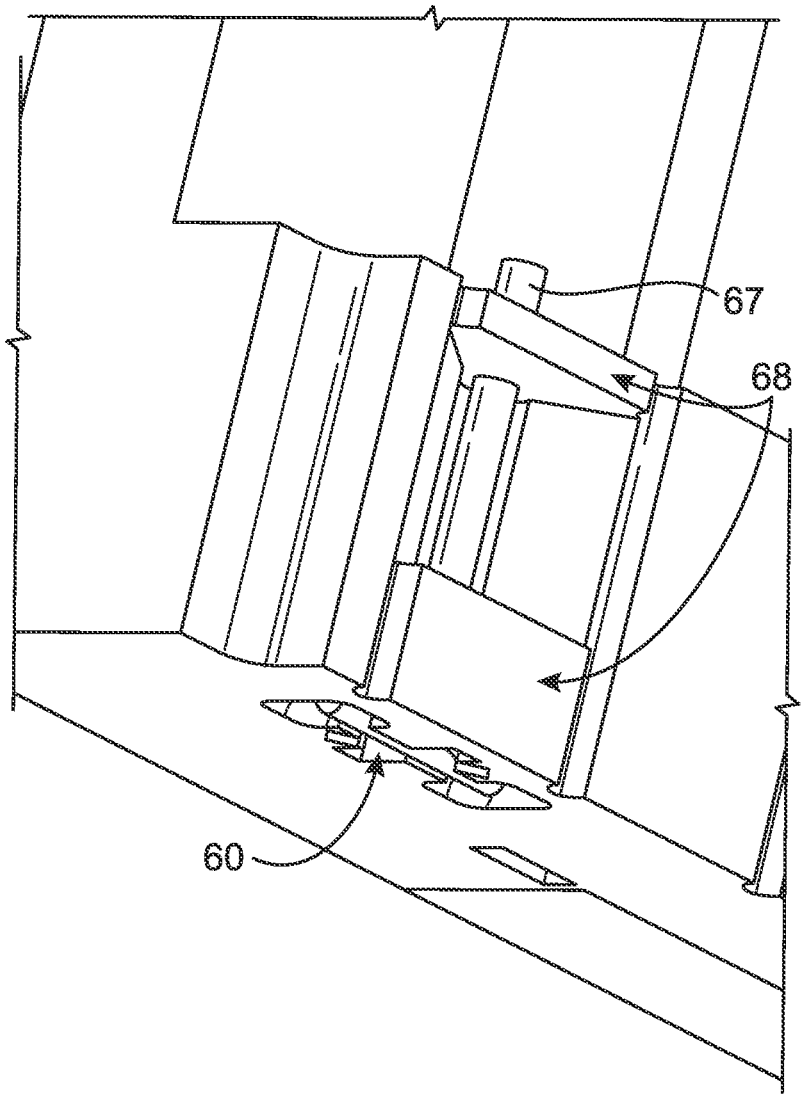
FIG. 12 is a fragmentary, front perspective of a tensioned locking mechanism of the container shown in FIG. 1.
Figure 13:
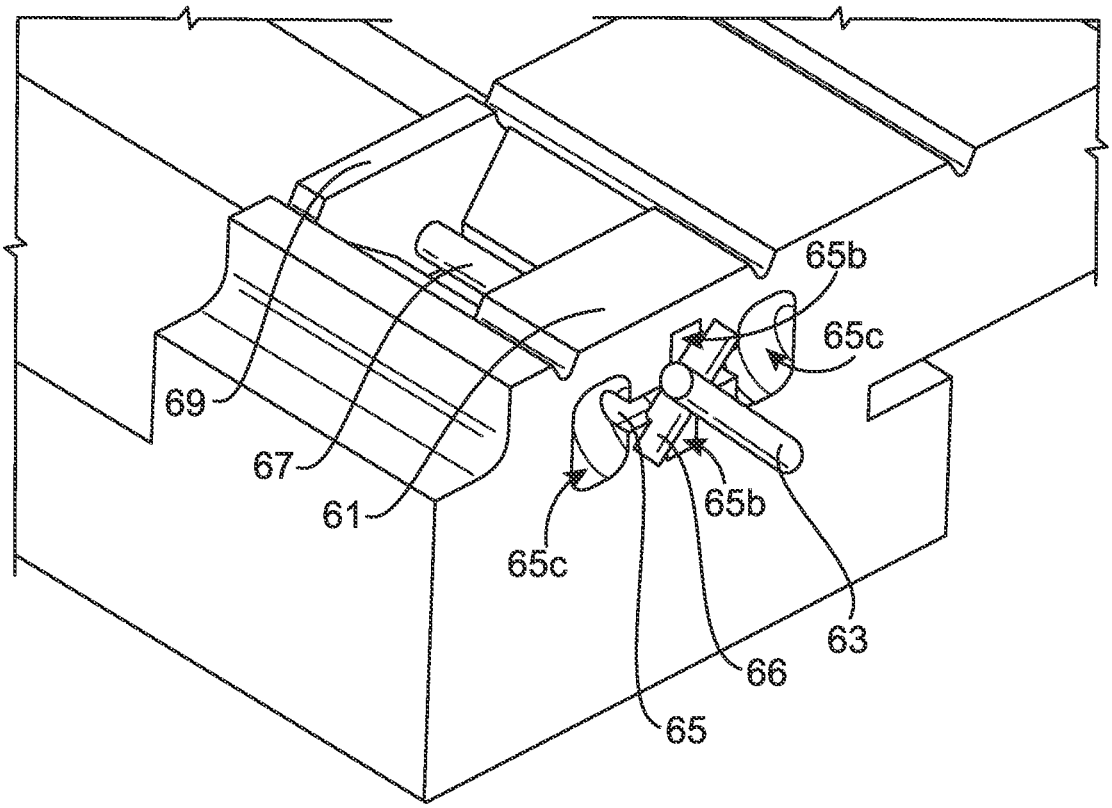
FIG. 13 is a fragmentary, front perspective of the tensioned locking mechanism of the container shown in FIG. 1 in a retracted position.
Figure 14:
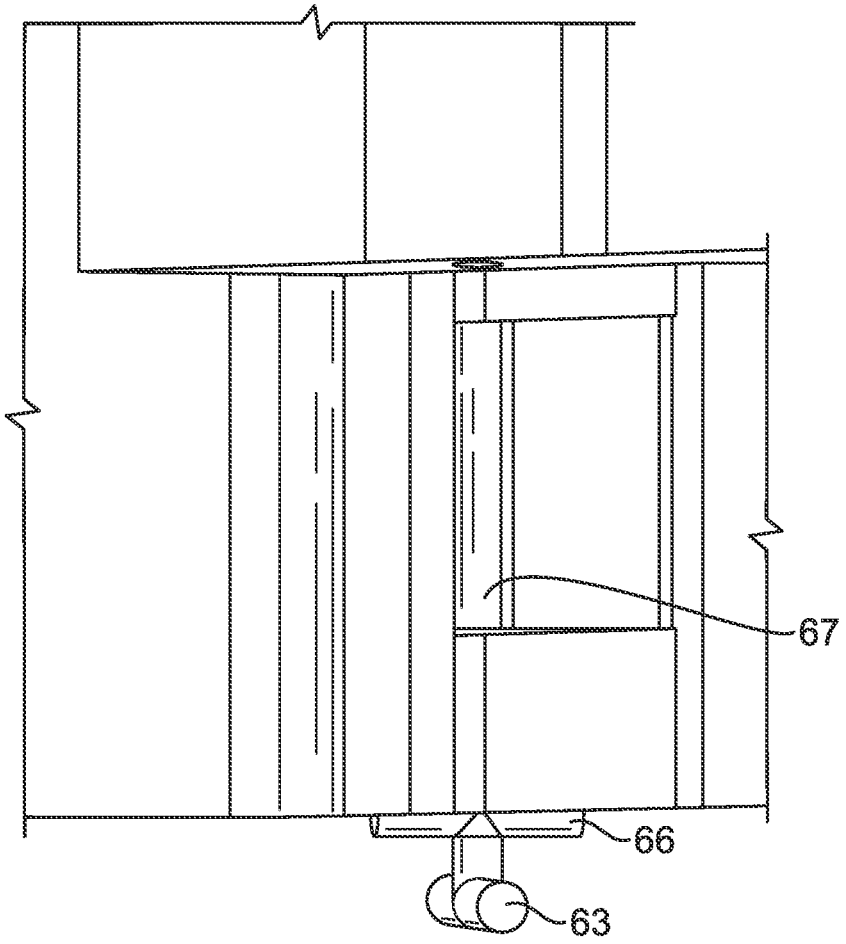
FIG. 14 is a fragmentary, side-perspective of the tensioned locking mechanism of the container shown in FIG. 1 in the retracted position.

As depicted in FIGS. 12-14, an optional tensioned locking mechanism 60 may be utilized for securing the telescopic support members 26 *b* into the desired position in relation to the telescoping base 26. Generally, the tensioned locking mechanism 60 includes a primary handle 63 and offset handle 66 operably connected to a slider rod 67 with a biasing member (not shown) secured between the slider rod 67 and the offset handle 66 for reciprocal movement of the slider rod 67 for engagement with the telescopic support members 26 *b*. The tensioned locking mechanism 60 also includes a first arm 61 and a second arm 69, the first arm 61 presenting a central groove 65 for receiving the primary handle 63 and for supporting the offset handle 66. The first and second arm 61, 69 both present a central aperture in alignment with the slider rod 67 for rotational and reciprocal movement as the slider rod 67 is operated between the retracted and extended positions. In operation, the tensioned locking mechanism 60 is extended from locked engagement with the telescopic support member 26 *b* by pulling the primary handle 63 outwardly from the central groove 65. Once the offset handle 66 is free from the central groove 65, the primary handle 63 is rotated angularly from being in alignment with the central groove 65 to an offset orientation where the slider rod 67 is prevented from retracting and the offset handle 66 is engaged by the first arm 61. In the offset orientation, the telescopic support member 26 *b* is can be selectively adjusted. Once the telescopic support member 26 *b* is placed into the desired position, the primary handle 63 is rotated, in a reverse direction, for alignment with the central groove 65 and the primary handle 63 is released for retraction into the central groove 65, the slider rod 67 retracted rearwardly for engagement with complementary structure associated with the telescopic support member 26 *b*. In this way, the tensioned locking mechanism 60 selectively engages the slider rod 67 from the telescoping base 26 and into receivers associated with each telescopic support member 26 *b*.

A secondary recess 65*b* (shown in FIG. 13) is angularly orientated with respect to the central groove 65 and can range between other between 15 and 90 degrees and a pair of arcuate indentations 65*c* are presented on either end of the central groove 65. The tensioned locking mechanism 60 is designed to allow flexibility in securing various quantities and dimensions of panels 4 within the container 20. Another feature of the tensioned locking mechanism 60 is that the primary handle 63 can be fully recessed into the container side wall to limit any obstruction which may be caused by being at least partially extending from the side wall or base of the container 20, interfering with the loading or handling of the panels 4 during shipment, storage or use. While not in use, the primary handle 63 will be recessed within the central groove 65 associated with the first arm 61.

In operation, the slider rod 67 in biased communication with the primary handle 63 is extended from a locked position to a retracted position. In the locked position, the slider rod 67 extends through the second arm 69 and into a receiver associated with the telescopic support member 26 *b*. In the retracted position, the slider rod 67 extends from the second arm 69 towards the first arm 61 as the primary handle 63 is retracted outwardly from the central groove 65. In the retracted position, the telescopic support members 26 *b* can be extended or retracted into the telescoping base 26 allowing the first and second side walls 22, 24 to be positioned as desired for receipt or removal of the panels 4.

Generally, the slider rod 67 is cylindrical and rotatable within a passageway extending from the central groove 65 through the first arm 61 and second arm 69 for engaged receipt by a telescopic support member 26*b*. The primary handle 63 is in communication with the slider rod 67 as it moves between an engaged to a retracted position and back to an engaged position once the telescopic support member 28 is extended to the desired position. Generally, the primary handle 63 has a limited rotation which can be controlled with the use of the offset handle 66 or with mechanical limiters like set-screws at the end of the slider rod 67. Generally, the offset handle 66 limits the angular rotation of the primary handle 63 to a particular angular range. For example, offset handle 66 may be used to limit the primary handle 63 from rotating beyond 90 degrees. In addition, the offset handle 66 may also limit the ability of the primary handle 63 from being prematurely retracted into the central groove 65 while rotated. Alternatively, a set screw or other mechanical fastener may be used to limit or control the rotation of the primary handle 63.

The tensioned latching mechanism 70 is depicted in FIGS. 1-4 and 9A-9C. Generally, the tensioned latching mechanism 70 allows for the stacking of plural containers 20 in an overlying orientation during shipment. A pair of aligners 38 extend upwardly from the top of each side wall 22, 24 and are configured for receipt within a complementary structure associated the bottom of each side wall 22, 24 and help secure and align the side wall 22, 24 for alignment of a plurality of stacked containers 20. For securing the stacked containers 20, a latching assembly 74 extends from an elongated latch receiver 80 which extends along the side wall 22, 24. The latching assembly 74 includes a pair of hooks 76 used for grasping a cylindrical structure or latch 72 extending along the elongated latch receiver 80 from the exterior side of one side wall 22, 24. The latching assembly 74 is used to mount one container 20 to another container 20. In operation, the tensioned latching mechanism 70 may be operated using both hands.

Figure 9C:
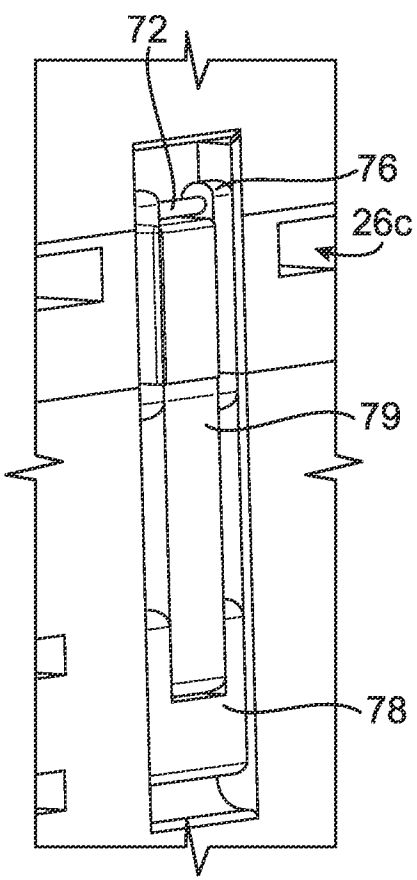
FIGS. 9A-C are fragmentary side perspectives of the stacked pair of containers shown in FIG. 3, showing a latching mechanism from an unlatched to a latched position for securing the containers together.
Figure 9B:
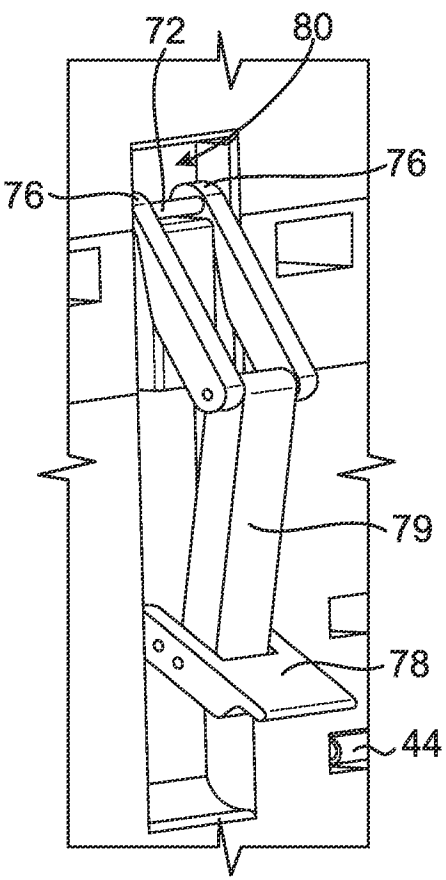
Figure 9A:
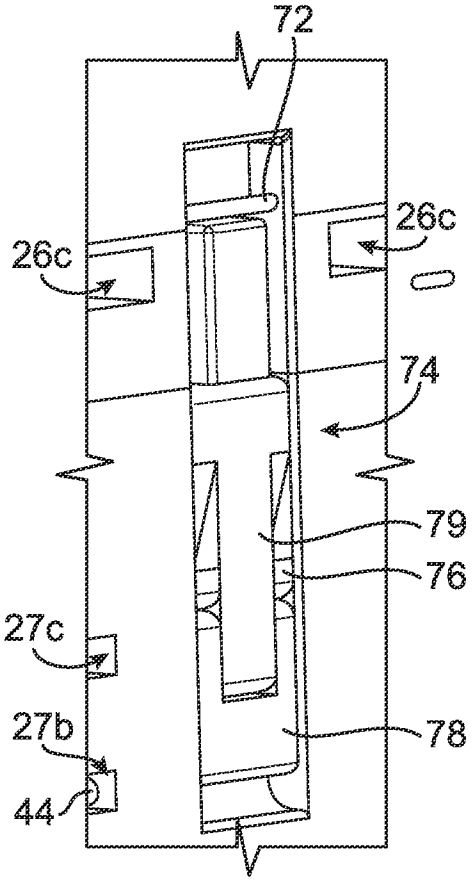

The latching assembly 74 is illustrated in FIG. 9A and includes a hook 76 and an operator 78 rotatable recessed within the side wall of the container 20. The operator 78, or handle, is pivotally connected to the hook 76 using a linking member 79 as illustrated in FIGS. 9A-9C. In operation, the operator 78 is rotated out and the hook is rotated from a downward orientation to an upward orientation. As the operator 78 is rotated further, the hook 76 extends upwards towards the latch 72 for engagement. Upon engagement of the latch 72 by the hook 76, the operator 78 is pulled down or pivoted in the opposite direction, applying tension to the latch 72 by the hook 76 until the operator 78 is rotated parallel to the side wall of the container 20 as illustrated in FIG. 9C.

Figure 15:
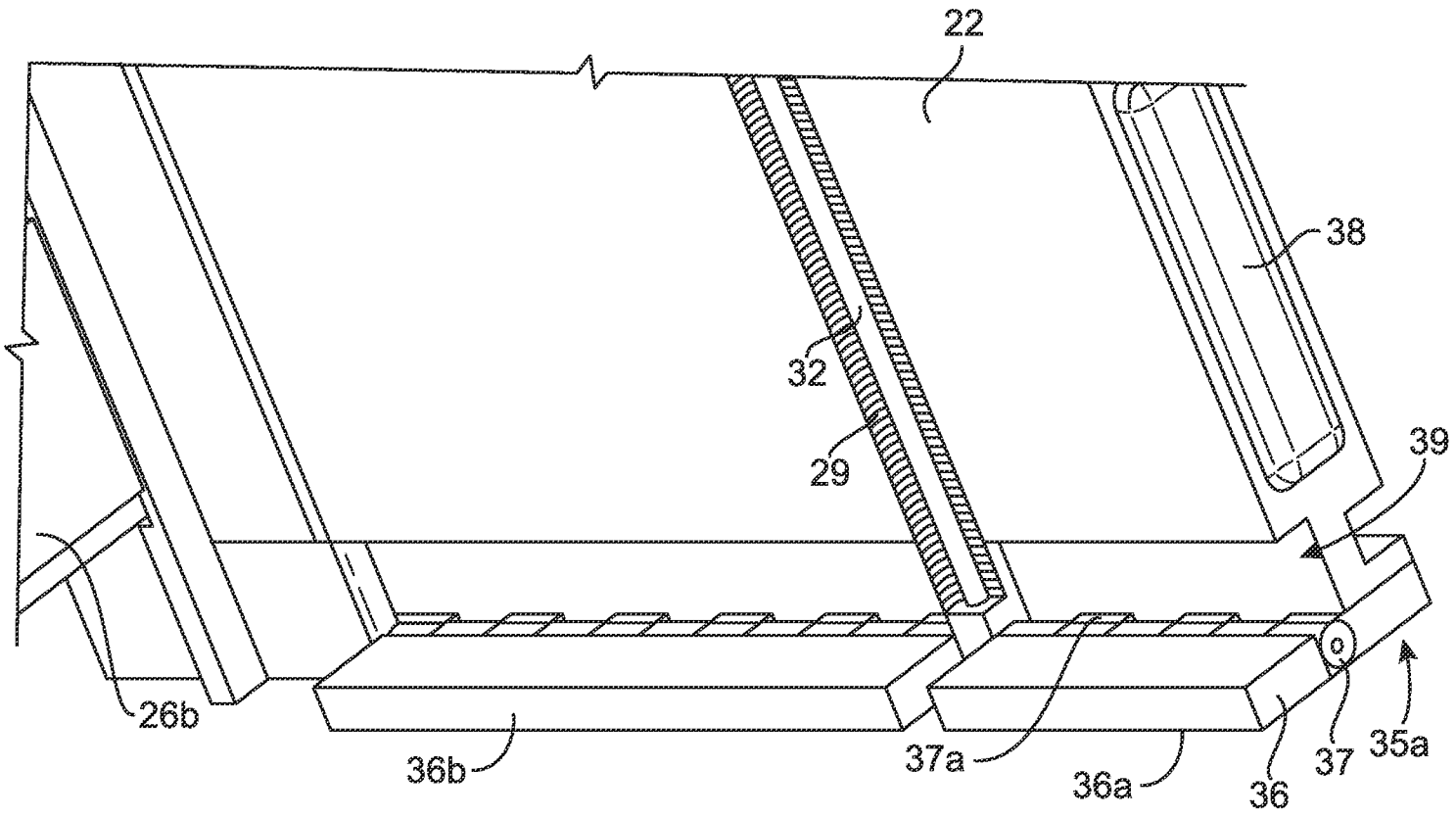
FIG. 15 is a fragmentary, side perspective of a rear support of the container shown in FIG. 1 in an outwardly rotated position.
Figure 16:
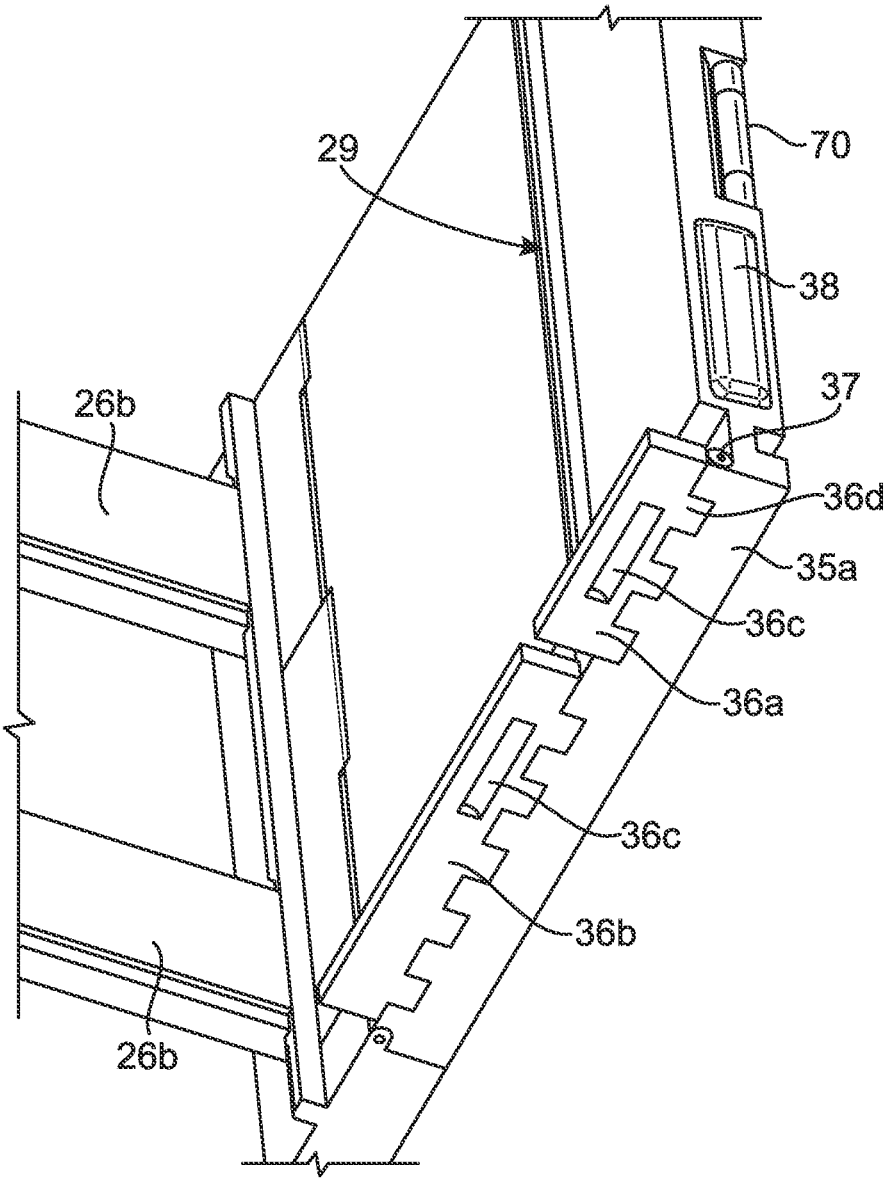
FIG. 16 is a fragmentary, rear perspective of the rear support of the container shown in FIG. 1 in the outwardly rotated position.
Figure 17:
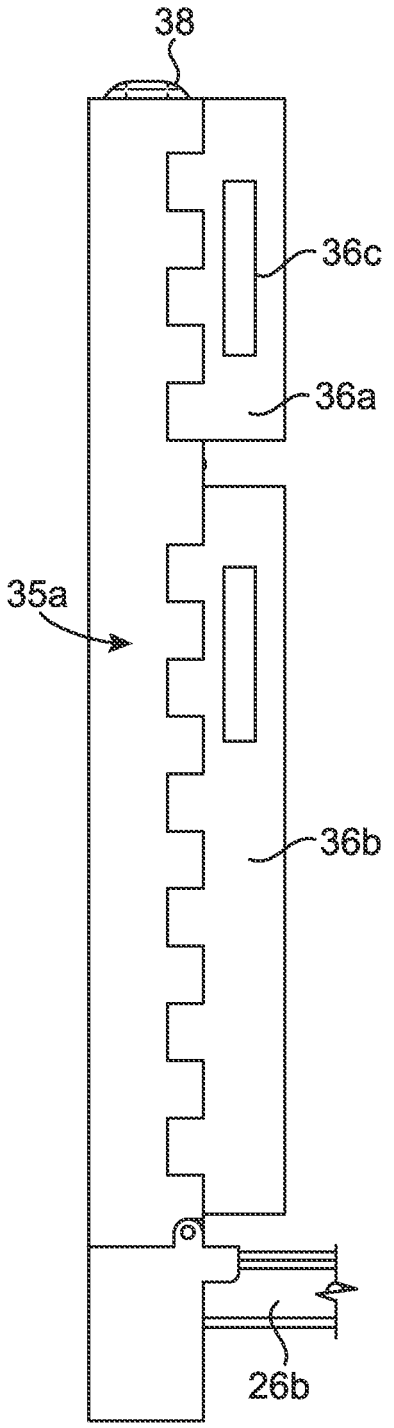
FIG. 17 is a fragmentary, rear elevation of the rear support of the container shown in FIG. 1 in the outwardly rotated position.

Generally, the rear support 36 extends from a hinged recess 39 within one of the sides of the container 20 and as depicted in FIGS. 15-17 rotates outwardly from each of the first and second side wall 22, 24 until it in a normal orientation with respect to each of the first and second side walls 22, 24. The rear support 36 is joined to the first and second side walls 22, 24 with a hinge 37, the hinge 37 being selectively pivotably and rotatably secured to the first and second side wall 22, 24. The hinge 37 extends selectively and continuously from the first and second side wall 22, 24 to allow for a selectively configurable rear support 36 which extends at least partially from the top towards the telescopic base 26 providing the desired support to maintain the panels 4 in the upright position during transport, storage and installation. The hinge 37 can be a continuous hinge, like a piano hinge, or it can utilize a standard hinge, strap hinge, butt hinge, bolt-on hinge, concealed hinge, latch hinge and the like. In the depicted embodiment, the hinge 37 includes a plurality of independent hinges, each of which extending from the first and second side wall 22, 24 providing rearward support to the panels 4.

Referring to FIGS. 18-26 and 28, another example of a transport container or pallet constructed according to the teachings of the present disclosure is generally indicated at reference numeral 110. The transport container 110 may be used to carry and transport one or more objects O. In particular, the transport container 110 may be used to carry one or more generally planar objects O, such as panels, sheets, boards, etc. In the illustrated embodiment, the objects O the transport container 110 is shown supporting are solar panels (e.g., panels 4). However, it is understood the transport container 110 may be used to transport objects O of generally any size and shape. As will be explained in more detail below, the size of the transport container 110 is selectively configurable to fit the size of the one or more objects O the transport container 110 is carrying.

The transport container 110 includes a base assembly 112 and opposing first and second side walls 114, 116 (e.g., first and second side wall assemblies) coupled to the base assembly 112. The base assembly 112 includes a base 118. The base 118 is configured to support the one or more generally planar objects O. The first and second side walls 114, 116 are operatively connected or coupled to the base 118. The base 118 includes an upper surface 120 (shown, e.g., in FIG. 20) configured to engage the one or more generally planar objects O and an opposing lower surface 121 (shown in FIG. 22). The base assembly 112 has opposing first and second ends 122, 124 with a longitudinal axis LA extending between the first and second ends 122, 124. The upper surface 120 may include one or more raised projections or ribs 126 (shown e.g., in FIG. 20) extending along the upper surface 120 in a direction generally perpendicular to the longitudinal axis LA. The ribs 126 are configured to support the one or more objects O. The lower surface 121 may define one or more forklift channels 123. Each forklift channel 123 may be sized and shaped, for example, to receive a fork or tine of a forklift, a pallet jack, or other suitable lifting device (not shown) to enable the lifting device to lift and move the transport container 110. The base assembly 112 may include one or more projections or feet 125 (shown in FIG. 22) extending downward from the lower surface 121. In the illustrated embodiment, the base assembly 112 includes a first set (e.g., pair) of feet 125 generally adjacent the first end 122 and a second set (e.g., pair) of feet 125 generally adjacent the second end 124.

The size of the transport container 110 is selectively configurable to fit the size and shape of the one or more objects O the transport container 110 is carrying. In particular, a width W (shown in FIG. 18) of the transport container 110 (e.g., a distance between the first and second side walls 114, 116) is selectively adjustable to fit the width or length or height of the one or more objects O. For example, at least one of the first and second side walls 114, 116 may be moved between an extended position and a contracted position. Broadly, the extended and contracted positions are different (e.g., first and second) longitudinal positions. The transport container 110 has a first width W1 (shown in FIG. 20) when said at least one of the first and second side walls 114, 116 is in the contracted position and a second width W2 (shown in FIG. 21) different than the first width W1 when said at least one of the first and second side walls 114, 116 is in the extended position (e.g., first extended position). In the illustrated embodiment, the second width W2 is greater than the first width W1. In other embodiments or methods of use, the second width W2 may be less than the first width W1. Other widths (e.g., width W3 shown in FIG. 23) and positions (e.g., a second extended position shown in FIG. 23) are possible. In some examples, the at least one of the first and second side walls 114, 116 is movable between a plurality of different positions (e.g., a plurality of longitudinal positions), such as a contracted position, a first extended position, a second extended position, a third extended position, a fourth extended position, etc., and thereby have a plurality of different widths W (e.g., a first width, a second width, a third width, a fourth width, etc.). In this manner, the transport container 110 may be arranged to fit the size of a plurality of different objects O. Moreover, by arranging the transport container 110 to conform or fit the size of the objects O supported thereon, the transport container 110 may better protect and carry the objects.

In the illustrated embodiment, each of the first and second side walls 114, 116 are movable between the contracted position and extended position (broadly, a plurality of different positions). The first and second side walls 114, 116 are configured to move in opposite directions when moving between the different positions. For example, the first and second side walls 114, 116 move outward (e.g., away from the center of the base 118) along (e.g., parallel to) the longitudinal axis LA to increase the width W of the transport container 110. For another example, the first and second side walls 114, 116 move inward (e.g., toward the center of the base 118) along (e.g., parallel to) to the longitudinal axis LA to decrease the width W of the transport container 110. In some examples, the first and second side walls 114, 116 move outward toward the extended position (e.g., to the second width W2) from the contracted position and move inward toward the contracted position (e.g., to the first width W1) from the extended position. The first and second side walls 114, 116 may move independently of one another or simultaneously with one another.

The base assembly 112 includes first and second extenders 128, 130 connected to the base 118. The first extender 128 is coupled to the first side wall 114 and operatively connects the first side wall 114 to the base 118. The second extender 130 is coupled to the second side wall 116 and operatively connects the second side wall 116 to the base 118. The first extender 128 extends outward, in a first direction generally parallel to the longitudinal axis LA, from the first end 122 of the base 118. The second extender 130 extends outward, in a second direction generally parallel to the longitudinal axis LA, from the second end 124 of the base 118. The first and second extenders 128, 130 are movable or actuatable relative to the base 118 to move the first and second side walls 114, 116 between the different positions (broadly, at least one of the first and second extenders 128, 130 is movable relative to the base 118). Specifically, the first and second extenders 128, 130 move along or parallel to the longitudinal axis LA to move the first and second side walls 114, 116 between the different positions (e.g., contracted position, first extended position, second extended position, third extended position, etc.).

Figure 27:
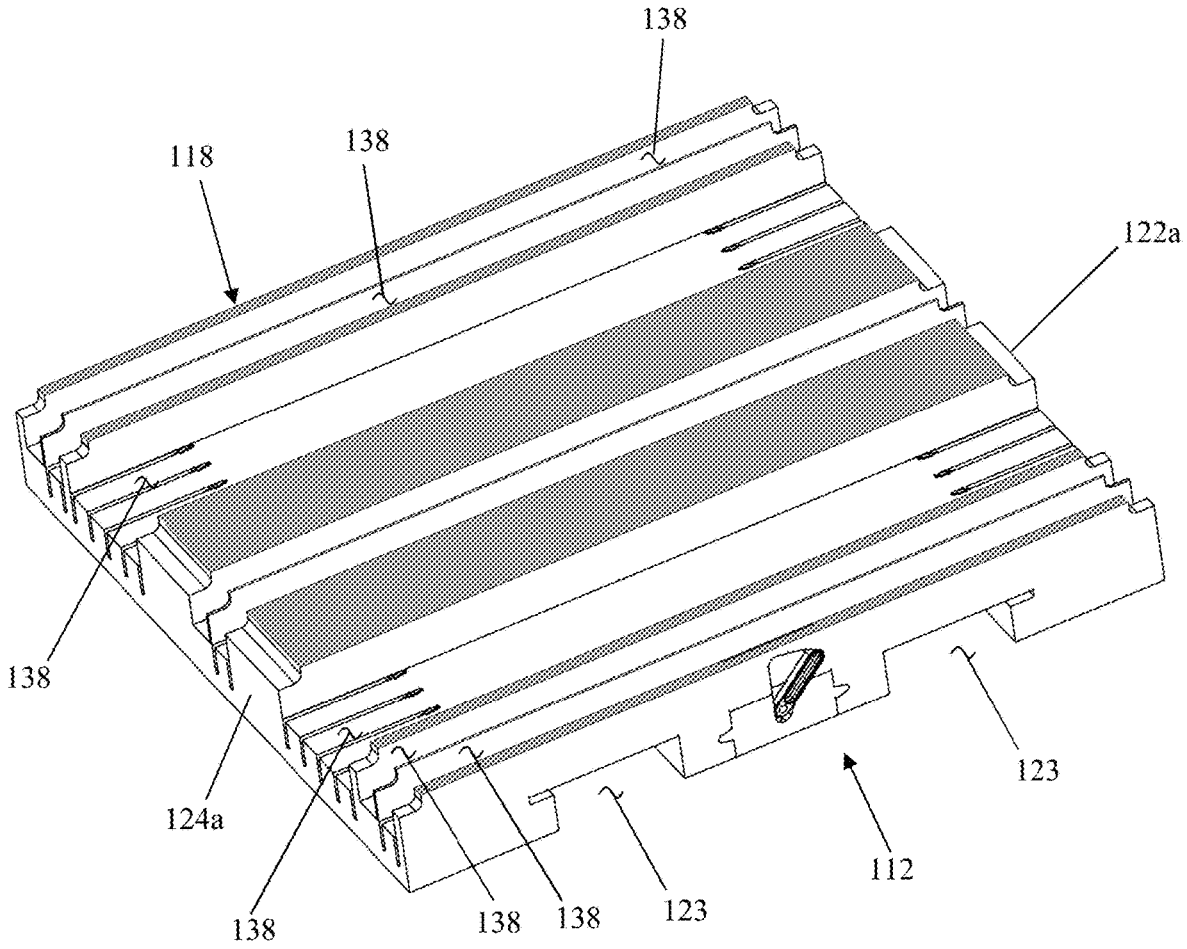
FIG. 27 is a cross-sectional view of the base of the transport container shown in FIGS. 20-26.
Figure 28:
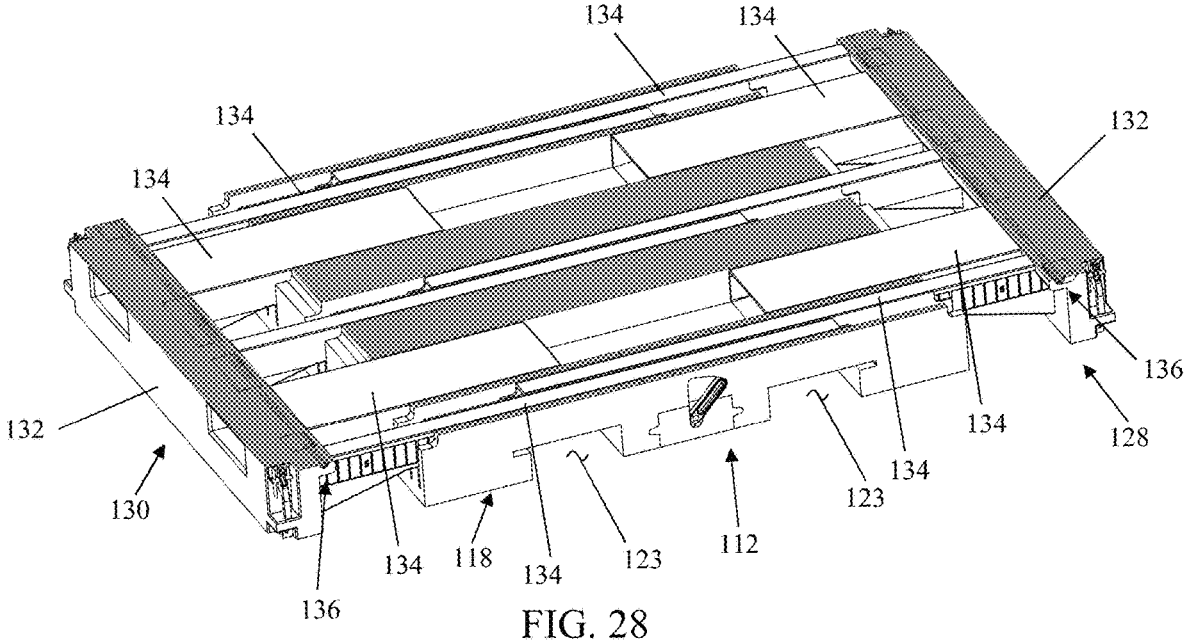
FIG. 28 is a cross-sectional view of the transport container shown in FIGS. 20-26 with the first and second extenders in the first expanded position, as shown in FIG. 21.
Figure 29:
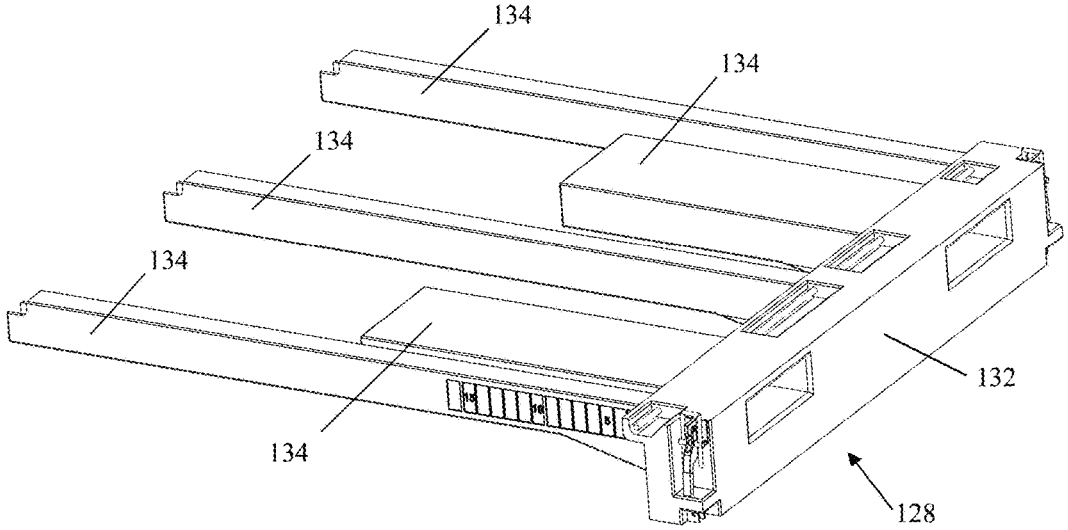
FIG. 29 is an upper perspective view of the first extender of the transport container shown in FIGS. 20-26 and 28.
Figure 30:
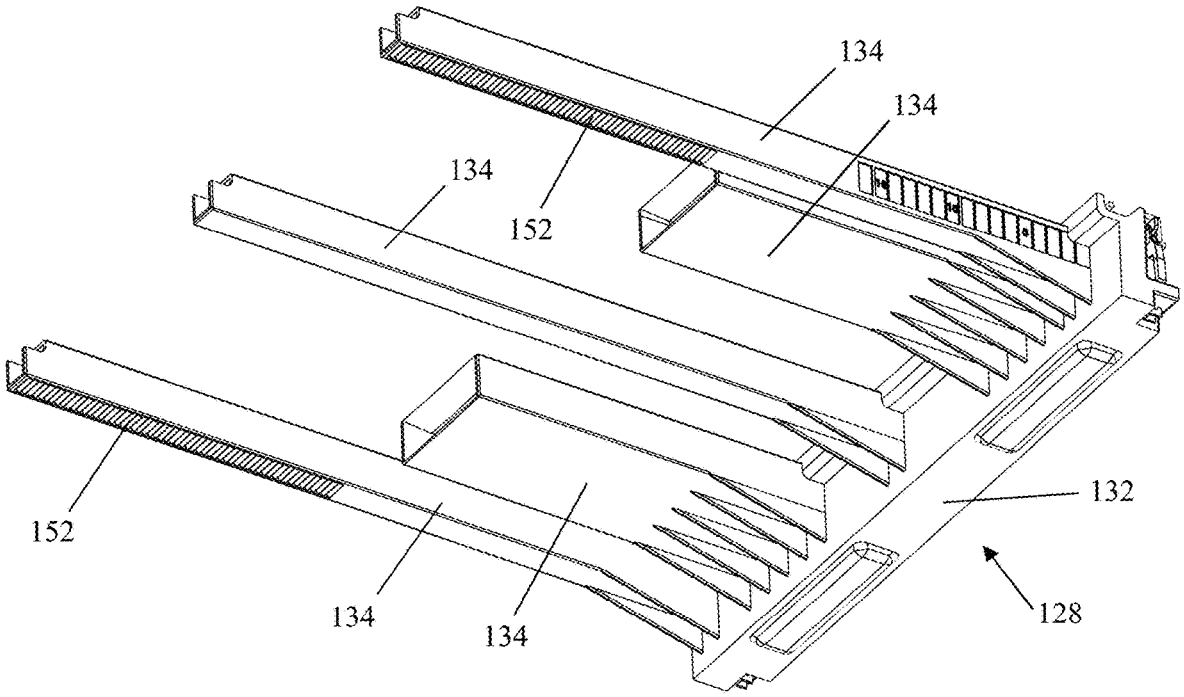
FIG. 30 is a lower perspective view of the extender shown in FIG. 29.
Figure 31:
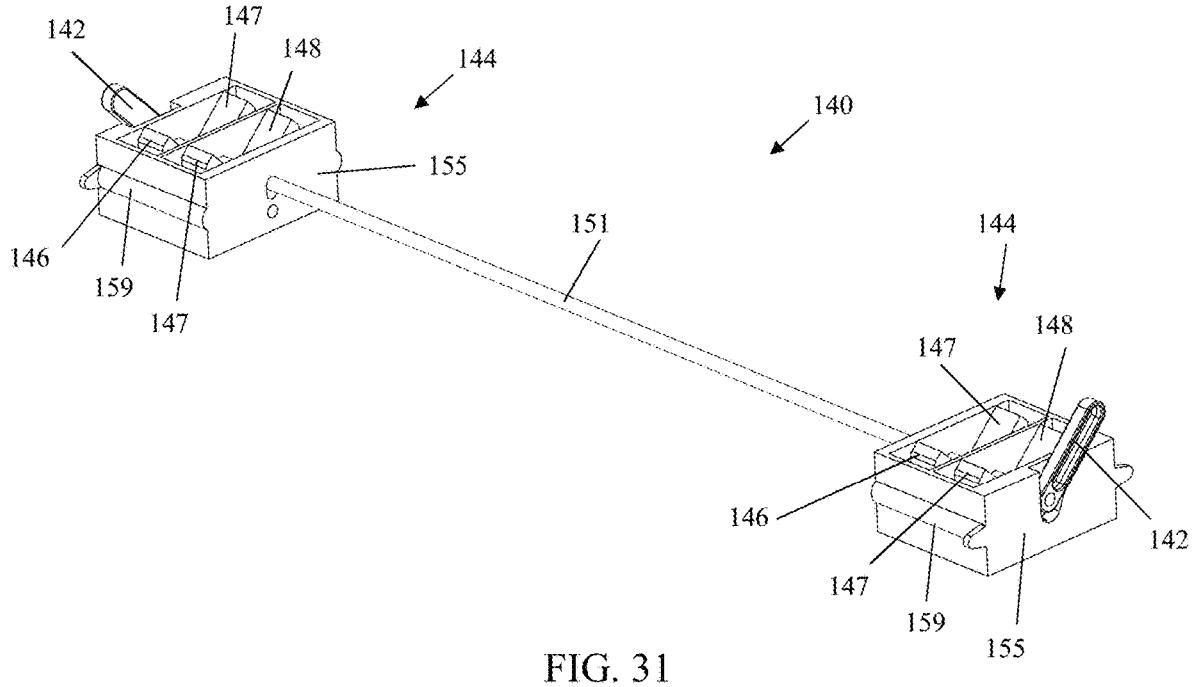
FIG. 31 is a perspective view of the retainer of the transport container shown in FIGS. 20-26 and 28.
Figure 32:
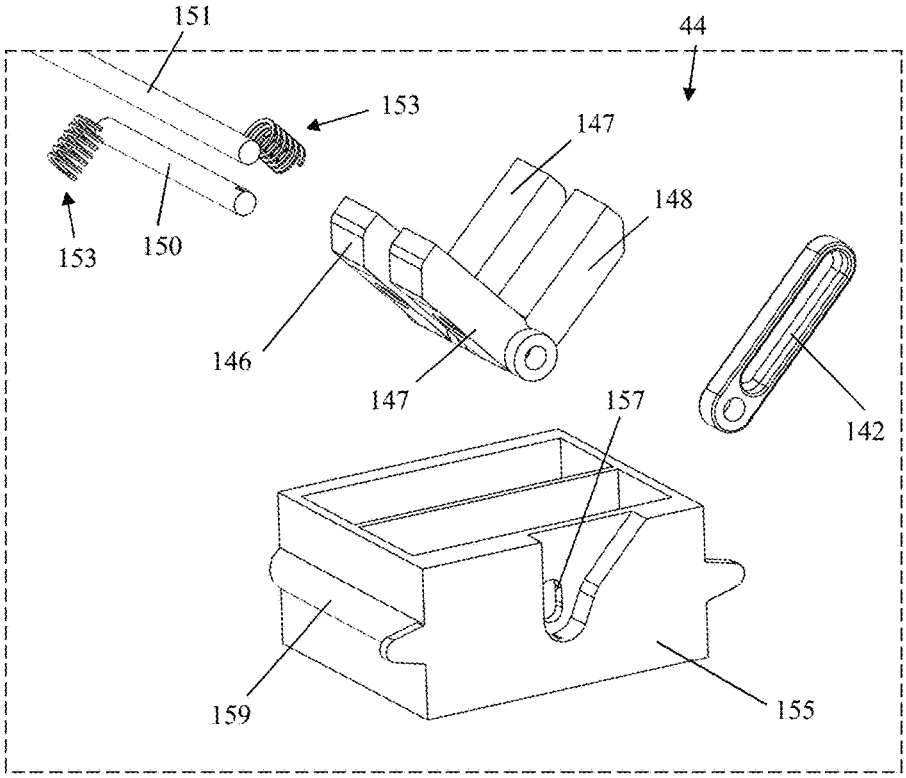
FIG. 32 is a detailed exploded view of the retainer shown in FIG. 31.
Figure 33:
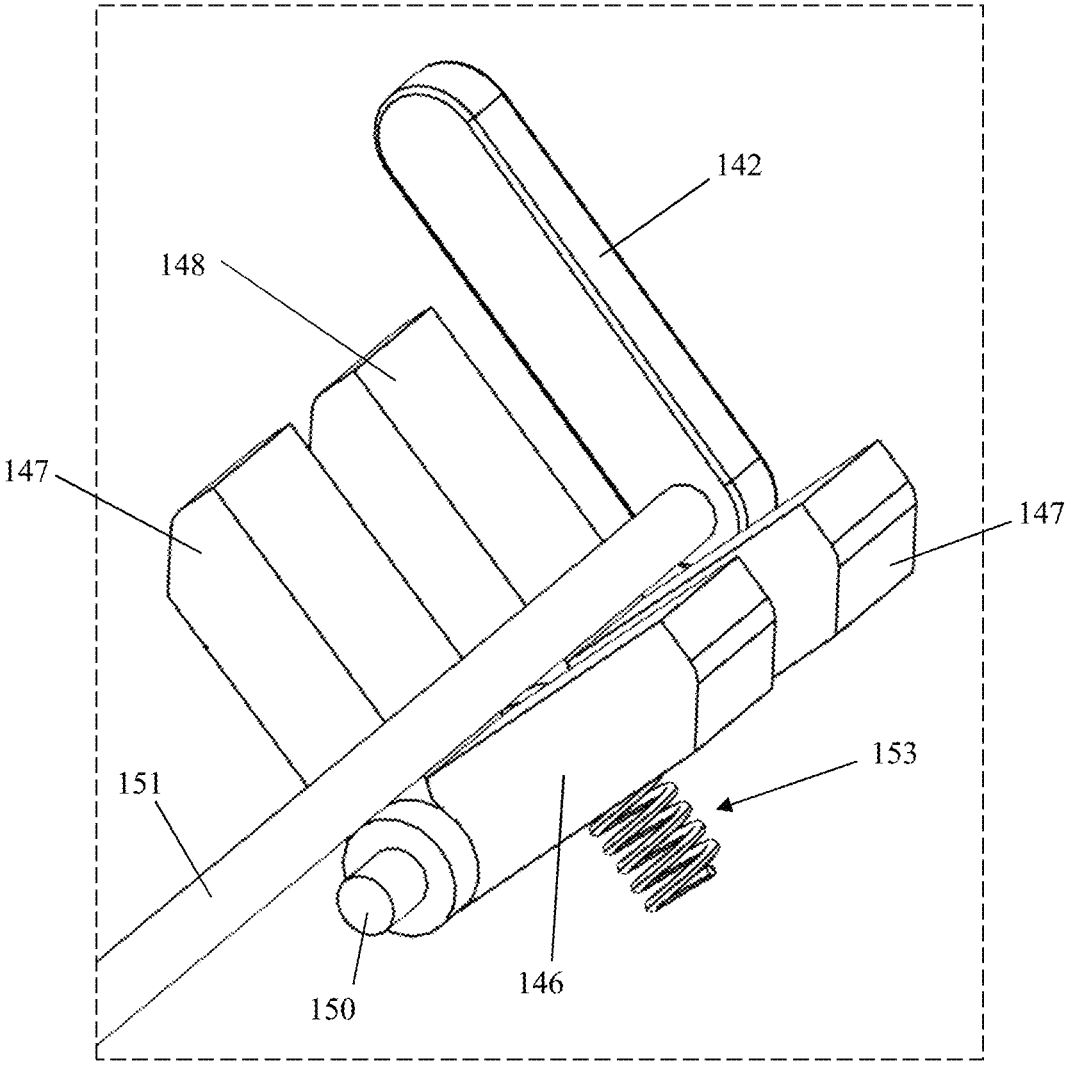
FIG. 33 is a rear perspective view of a portion of the retainer shown in FIGS. 31 and 32.

The first extender 128 is shown in FIGS. 29 and 30. In the illustrated embodiment, the first and second extenders 128, 130 are identical. Each extender 128, 130 includes a wall support portion 132 and at least one rail 134. Each wall support portion 132 is connected to a corresponding one of the first and second side walls 114, 116 (shown, e.g., in FIG. 21). The first and second side walls 114, 116 are movable relative to the first and second extenders 128, 130. In particular, the first and second side walls 114, 116 are pivotably or rotatably connected to the wall support portion 132. In some examples, the first and second side walls 114, 116 are rotatably connected to their corresponding wall support portion 132 with a hinge 136 (shown, e.g., in FIG. 21). In the illustrated embodiment, the hinge 136 is a rod or shaft extending through aligned openings in the first and second side walls 114, 116 and their corresponding wall support portion 132, although other configurations are within the scope of the present disclosure. Each rail 134 extends from the wall support portion 132 to the base 118. The rails 134 are generally parallel to the longitudinal axis LA. The rails 134 may have different shapes and sizes. The rails 134 are slidably coupled to the base 118. The base 118 defines channels 138 (shown in FIG. 27). Each channel 138 receives at least one rail 134. The rails 134 are movable along or parallel to the longitudinal axis LA within the channels 138, thereby enabling the first and second extenders 128, 130 to move relative to the base 118. The channels 138 extend between first and second ends 122, 124 of the base 118. Other configurations of the first and second extenders 128, 130 are within the scope of the present disclosure.

Referring to FIGS. 31-36, the transport container 110 includes a retainer, generally indicated at 140. The retainer 140 is configured to secure the first and second side walls 114, 116 (broadly, at least one of the first and second side walls 114, 116) in one or more of the different positions (e.g., the contracted position, the first extended position, the second extended position, the third extended position, etc.). Specifically, the retainer 140 secures the first and second extenders 128, 130 in one or more of the different positions. The retainer 140 is movable between a locked position (shown, e.g., in FIGS. 21 and 36) and an unlocked position (shown, e.g., in FIGS. 20 and 37). In the unlocked position, the first and second side walls 114, 116 (e.g., the first and second extenders 128, 130) are free to move relative to the base 118. Accordingly, in the unlocked position, an operator can manually move the first and second side walls 114, 116 to different positions (e.g., the contracted position, the first extended position, the second extended position, the third extended position, etc.). In the locked position, the first and second side walls 114, 116 are inhibited from moving between the different positions (e.g., the first and second side walls 114, 116 are secured in their position) relative to the base 118. In some examples, the first and second side walls 114, 116 (broadly, at least one of the first and second side walls 114, 116) are free to move in one direction and inhibited from moving in another (e.g., opposite) direction when the retainer 140 is in the locked position. For example, the first and second side walls 114, 116 may be free to move inwardly (e.g., decrease the width W of the transport container 110), but be inhibited from moving outwardly (e.g., increase the width of the transport container 110), when the retainer 140 is in the locked position. In other words, the first and second side walls 114, 116 may be configured to move to the extended position (FIGS. 21 and 23) (e.g., first or second extended positions) from the contracted position (FIG. 20) but inhibited from moving to the contracted position from the extended position when the retainer 140 is in the locked position. In the illustrated embodiment, the retainer 140 is generally housed within the base 118.

Figure 36:
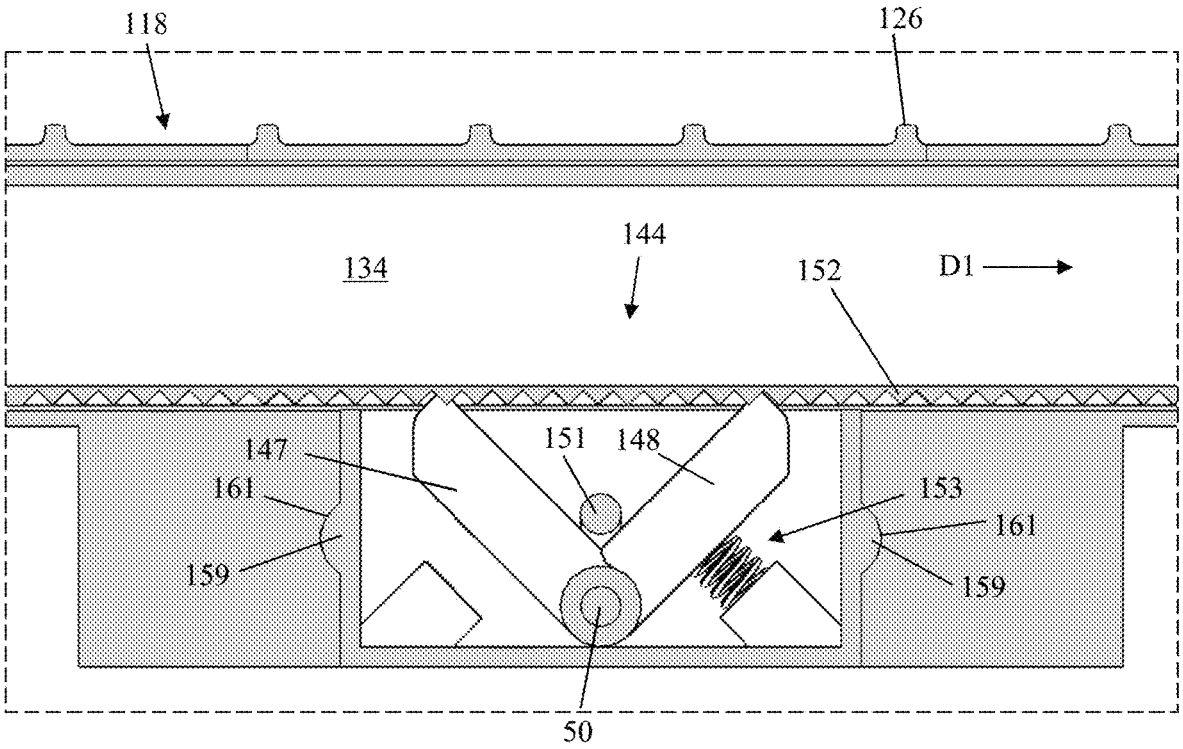
FIG. 36 is a detailed cross-sectional view of the portion of the transport container shown in FIGS. 34 and 35 with the retainer in the locked position.
Figure 39:
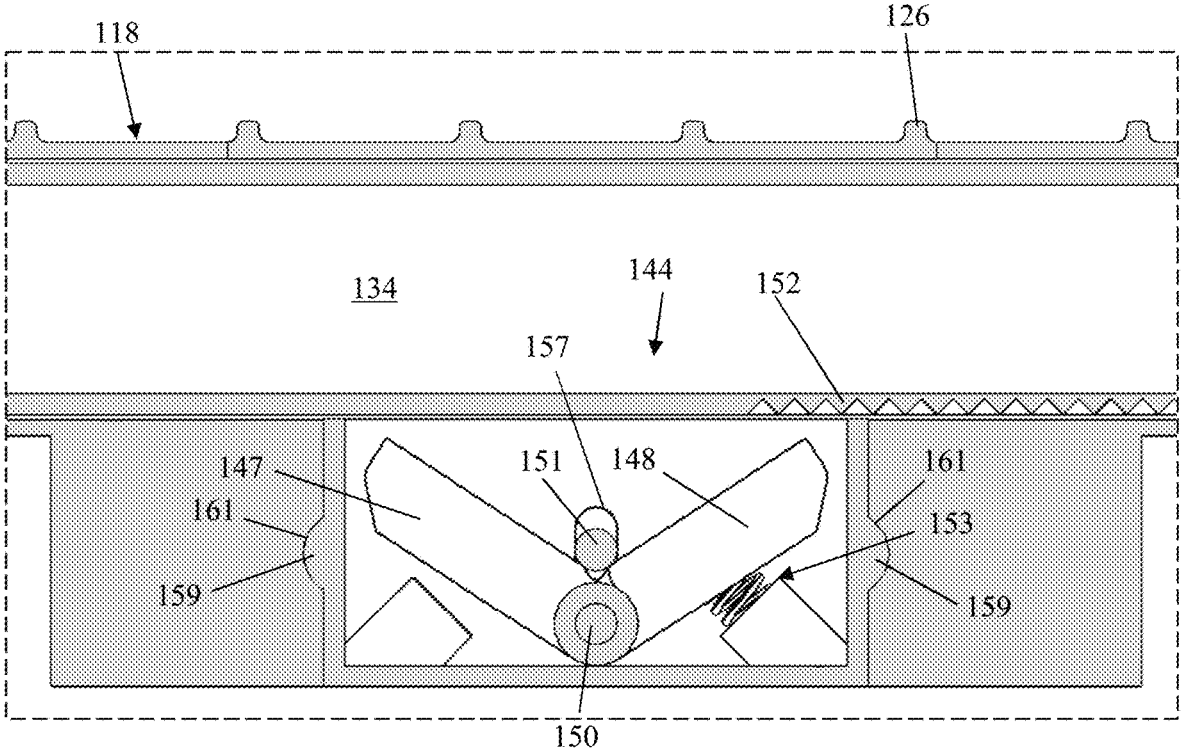
FIG. 39 is a detailed cross-sectional view of the portion of the transport container shown in FIGS. 37 and 38 with the retainer in the unlocked position.

The retainer 140 includes at least one knob or handle 142 (broadly, an actuator). In the illustrated embodiment, the retainer 140 includes two handles 142, one on a front side of the base 118 and the other on a rear side of the base 118. The operator may use one or more of the handles 142 to move the retainer 140 between the locked position and the unlocked position. In the illustrated embodiment, the retainer 140 includes a ratchet 144. The ratchet 144 enables the first and second side walls 114, 116 to move inwardly but prevents the first and second side walls 114, 116 from moving outwardly when the ratchet 144 is in the locked position. In the unlocked position, the ratchet 144 enables the first and second side walls 114, 116 to move inwardly or outwardly (e.g., in either direction along the longitudinal axis LA). In the illustrated embodiment, the retainer 140 includes two ratchets 144, one positioned generally adjacent the front side of the base 118 and the other positioned generally adjacent the rear side of the base 118. The two ratchets 144 are generally identical. Each ratchet 144 includes first and second pawls 146, 148 (broadly, a plurality of pawls) (shown, e.g., in FIG. 32) that selectively engage one or more projections or teeth 152 (shown, e.g., in FIG. 36) on one of the rails 134 of the first and second extenders 128, 130. The pawls 146, 148 are rotatably mounted on a shaft 150. The push shaft 151 is connected to and extends between the two handles 142. The push shaft 151 is generally parallel to and overlies the shaft 150. The first and second pawls 146, 148 are biased in an upward manner to engage the rails 134 of the first and second extenders 128, 130. The pawls 146, 148 may be biased with springs 153. For example, the first pawl 146 may be biased to rotate upward to engage one of the rails 134 of the first extender 128. Likewise, the second pawl 148 may be biased to rotate upward to engage one of the rails 134 of the second extender 130. The ratchet 144 may also include extraneous pawls 147 (e.g., pawls not biased upwards by springs 153). The extraneous pawls 147 do not engage the rails 134 (contrary to what is shown in FIG. 36) and are generally irrelevant to the operation of the transport container 110. The retainer 140 may include a ratchet box 155 to house the various components of the ratchet 144 (e.g., pawls 146, 148). The ratchet box 155 is coupleable to the base 118. In some examples, the ratchet box 155 includes one or more projections or ribs 159, and the base 118 includes one or more recesses or grooves 161 (as shown in FIGS. 36 and 39) sized and shaped to receive the ribs of the ratchet box 155, to facilitate securing the retainer 140 relative to the base 118. Specifically, the ribs 159 help keep the ratchet box 155 in place when the user moves the handle 142 between the locked and unlocked positions.

Figure 34:
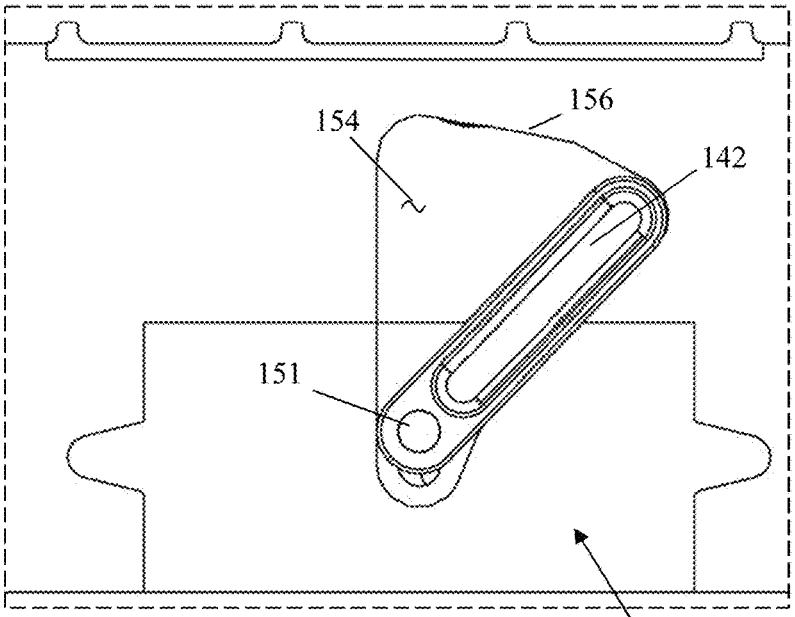
FIG. 34 is a detailed front view of a portion of the transport container shown in FIGS. 20-26 and 28 with the retainer in the locked position.
Figure 35:
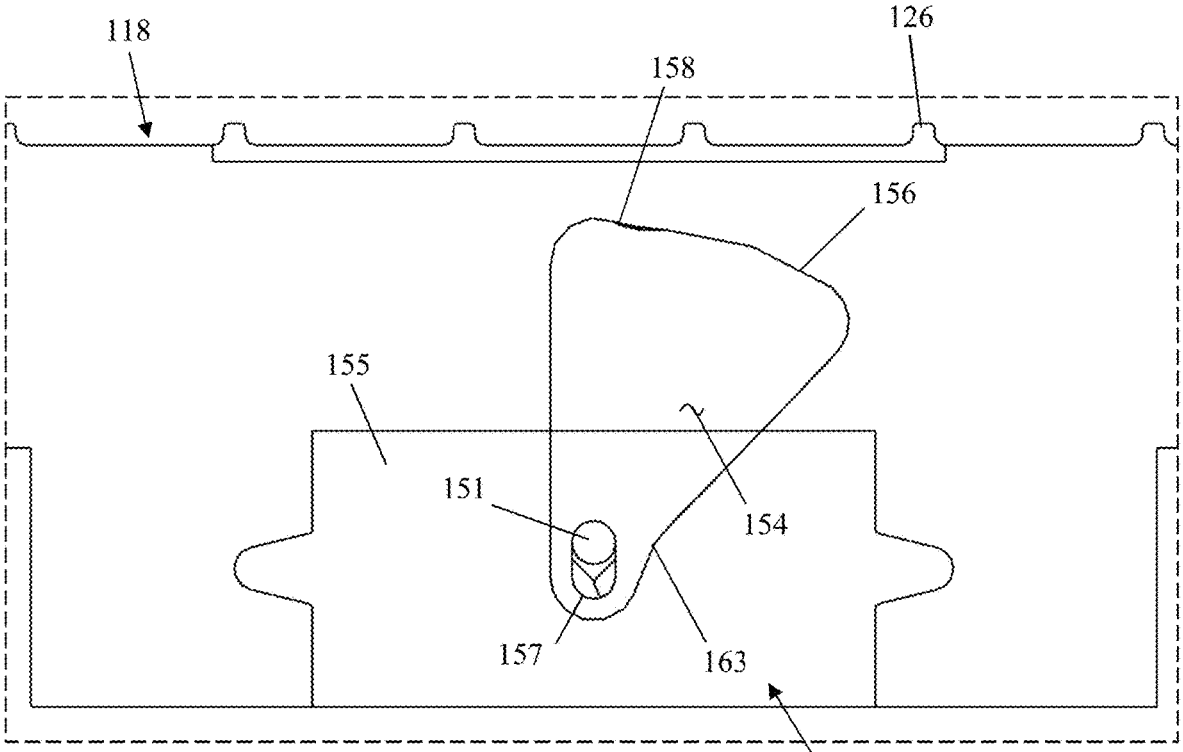
FIG. 35 is a detailed front view of a portion of the transport container shown in FIG. 34 with a handle of the retainer hidden from view to show interior details.

FIGS. 34-36 show the retainer 140 in the locked position. In the locked position, the first and second pawls 146, 148 engage the teeth 152 on the rails 134 to inhibit the rails 134, and by extension the extenders 128, 130 and side walls 114, 116, from moving in an inward direction. When the side walls 114, 116 are urged or forced in the outward direction while the retainer 140 is in the locked position, the teeth 152 urge or force the pawls 146, 148 to rotate upwards. This creates a binding between the pawls 146, 148 and rails 134 which inhibits or stops the outward movement of the first and second extenders 128, 130. On the other hand, when the side walls 114, 116 are urged or forced in the inward direction D1 while the retainer 140 is in the locked position, the teeth 152 urge or force the pawls 146 to rotate downward and away from the teeth 152. That is, the ratchet 144 enables the rails 134, and by extension the extenders 128, 130 and side walls 114, 116, to move freely in the inward direction D1. In operation, as a rail 134 moves in the inward direction D1, a first tooth 152 deflects or pushes the first or second pawl 146, 148 downward, permitting the rail 134 to move along the first or second pawl 146, 148. When the first tooth 152 moves past the pawl 146, 148, the pawl 146, 148 rotates back upward due to the biasing of the spring 153 to engage the next successive tooth 152 (e.g., a ratchet step). This process may repeat as long as the first or second extender 128, 130 is pushed inward, thereby enabling the first and second side walls 114, 116 to move inward outward when the retainer 140 is in the locked position. The first and second extenders 128, 130 are free to move inward until the wall support portions 132 engage the base 118.

Figure 37:
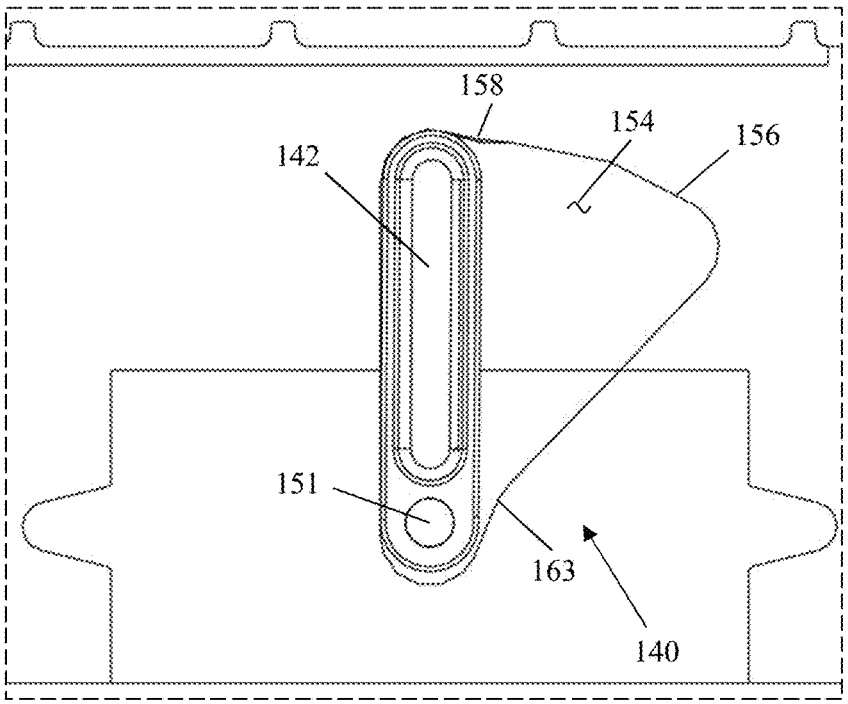
FIG. 37 is a detailed front view of a portion of the transport container shown in FIGS. 20-26 and 28 with the retainer in the unlocked position.
Figure 38:
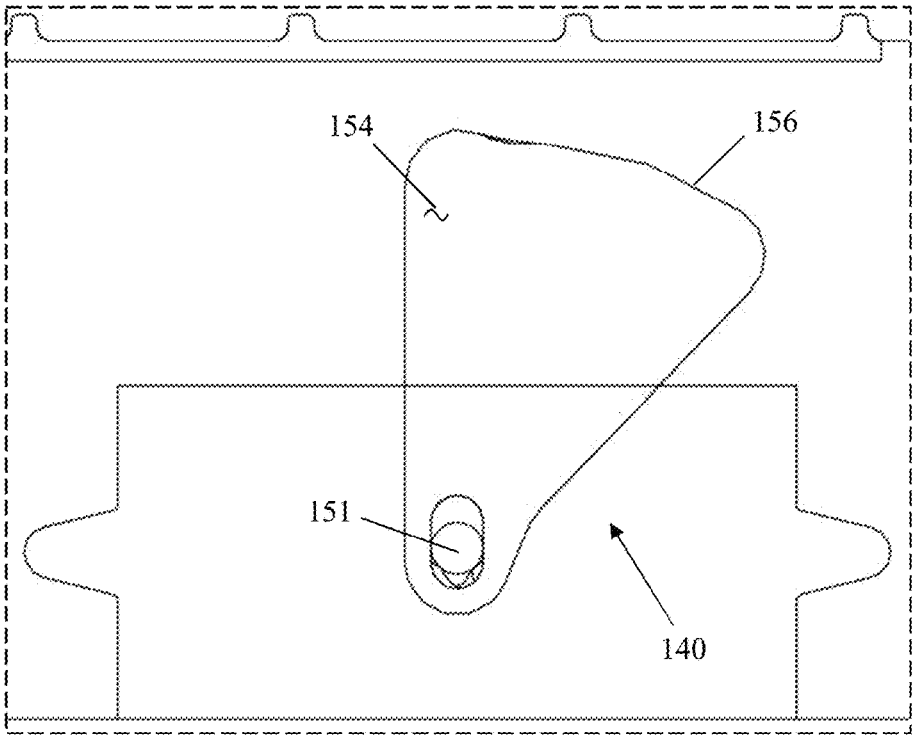
FIG. 38 is a detailed front view of a portion of the transport container shown in FIG. 37 with the handle hidden from view to show interior details.

FIGS. 37-39 shows the retainer 140 in the unlocked position. In the unlocked position, the first and second pawls 146, 148 are spaced from the rails 134 and do not engage the teeth 152. This permits the rails 134, and by extension the extenders 128, 130 and side walls 114, 116, to move freely inward or outward relative to the pawls 146, 148. In the illustrated embodiment, the first and second pawls 146, 148 are disposed at a location in the unlocked position that is lower than their location in the locked position. In other words, moving the retainer 140 from the locked position to the unlocked position moves the first and second pawls 146, 148 downward, away from the rails 134.

In the illustrated embodiment, the handle 142 is rotated to a generally vertical orientation (shown, e.g., in FIGS. 23 and 37) to move the first and second pawls 146, 148 to the lower, unlocked position. Specifically, the push shaft 151 is disposed within a vertical slot 157 of the ratchet box 155. When the handle 142 is actuated or rotated towards the vertical orientation, the push shaft 151 moves downward in the vertical slot 157, thereby pushing the first and second pawls 146, 148 downward and away from the rails 134. The handles 142 rotate about the axis of the push shaft 151. Both handles 142 may rotate together or independently of one another. Each handle 142 is disposed within a handle recess 154 (shown, e.g., in FIG. 34) on a respective side of the base 118. The base 118 includes an arcuate surface 156 that defines a portion of the handle recess 154. A distal end of the handle 142 engages the arcuate surface 156. The arcuate surface 156 is curved such that as the handle 142 rotates to the vertical, the handle 142 and push shaft 151 are pushed downward by the arcuate surface 156, thereby moving the first and second pawls 146, 148 away from the rails 134. The arcuate surface 156 may include a lip or detent 158 to secure the handle 142 in the vertical orientation, thereby securing the retainer 140 in the unlocked position. As the handle 142 rotates toward the vertical orientation, a proximal end of the handle 142 (e.g., the end coupled to the push shaft 151) engages and pivots about an elbow 163 and moves into a lower portion (e.g., a seat) of the handle recess 154. The elbow 163 defines a portion of the handles recess 154 and is part of the base 118.

In the illustrated embodiment, the handle 142 is rotated away from the vertical orientation (shown, e.g., in FIGS. 21 and 34) to move the pawls 146, 148 toward the rails 134 such that the pawls 146, 148 re-engage the rails 134. As the handle 142 is rotated back, the proximal end of the handle 142 and push shaft 151 rise, permitting the first and second pawls 146, 148 rotate upward and back into engagement with the rails 134. The proximal end of the handle 142 and push shaft 151 are biased upward (e.g., toward the locked position), by the springs 153, to facilitate the upward movement of the proximal end of the handle 142 and shaft 150. Other configurations of the retainer 140 are within the scope of the present disclosure.

Enabling the first and second side walls 114, 116 to move inward (e.g., toward the contracted position) when the retainer 140 is in the locked position makes it faster and easier to collapse the transport container 110. For example, once all the objects O are removed from the transport container 110, the operator can simply push the first and second side walls 114, 116 in order to start collapsing the transport container 110 instead of first having to use the handle 142 to move the retainer 140 to the unlocked position. Moreover, because the retainer 140 is configured to remain in the locked position, the operator does not have to move the retainer 140 back to the locked position once the first and second side walls 114, 116 are in the contracted position.

Referring back to FIGS. 18-25, the first and second side walls 114, 116 are movable between a deployed position (FIGS. 18-24) and a collapsed position (FIG. 25) (e.g., the transport container 110 is movable between a deployed configuration and a collapsed configuration). In the deployed position, the first and second side walls 114, 116 are arranged to receive the one or more objects O therebetween. The first and second side walls 114, 116 extend generally perpendicular to the base 118 (e.g., are generally upright). In the collapsed position, the first and second side walls 114, 116 are collapsed to reduce the overall size and shape of the transport container 110. The first and second side walls 114, 116 extend generally parallel to the base 118. The transport container 110 has a first height H1 when the first and second side walls 114, 116 are in the deployed position and a second height H2 different than the first height when the first and second side walls 114, 116 are in the collapsed position. Specifically, the second height H2 is less than the first height H1. Placing the first and second side walls 114, 116 in the collapsed position makes it easier to pack several transport containers 110 together and return them after the transport containers 110 have been used to deliver the one or more objects.

Figure 40:
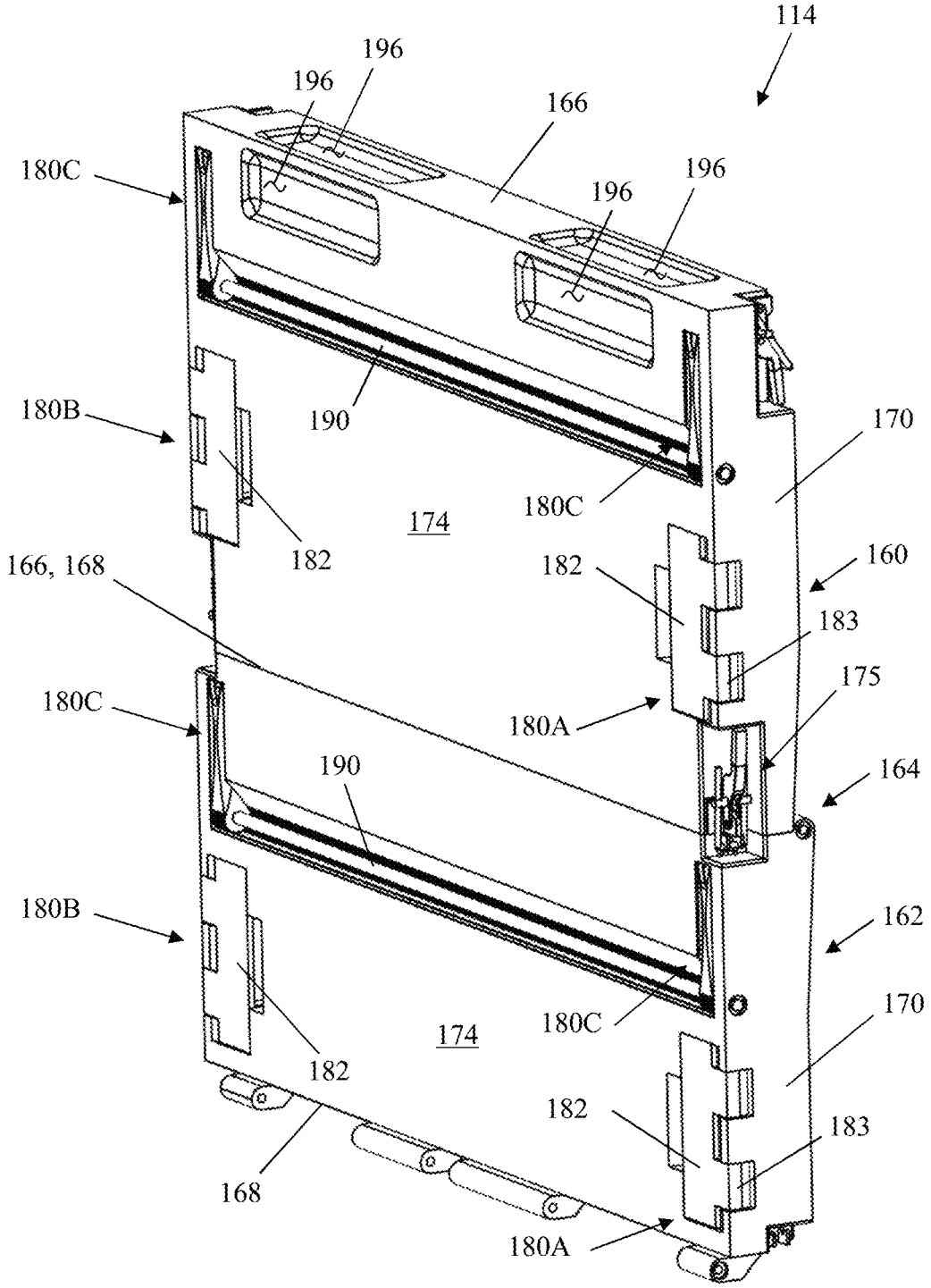
FIG. 40 is a front perspective view of the first side wall of the transport container shown in FIGS. 20-26 and 28, including first and second object supports in a stowed position.
Figure 41:
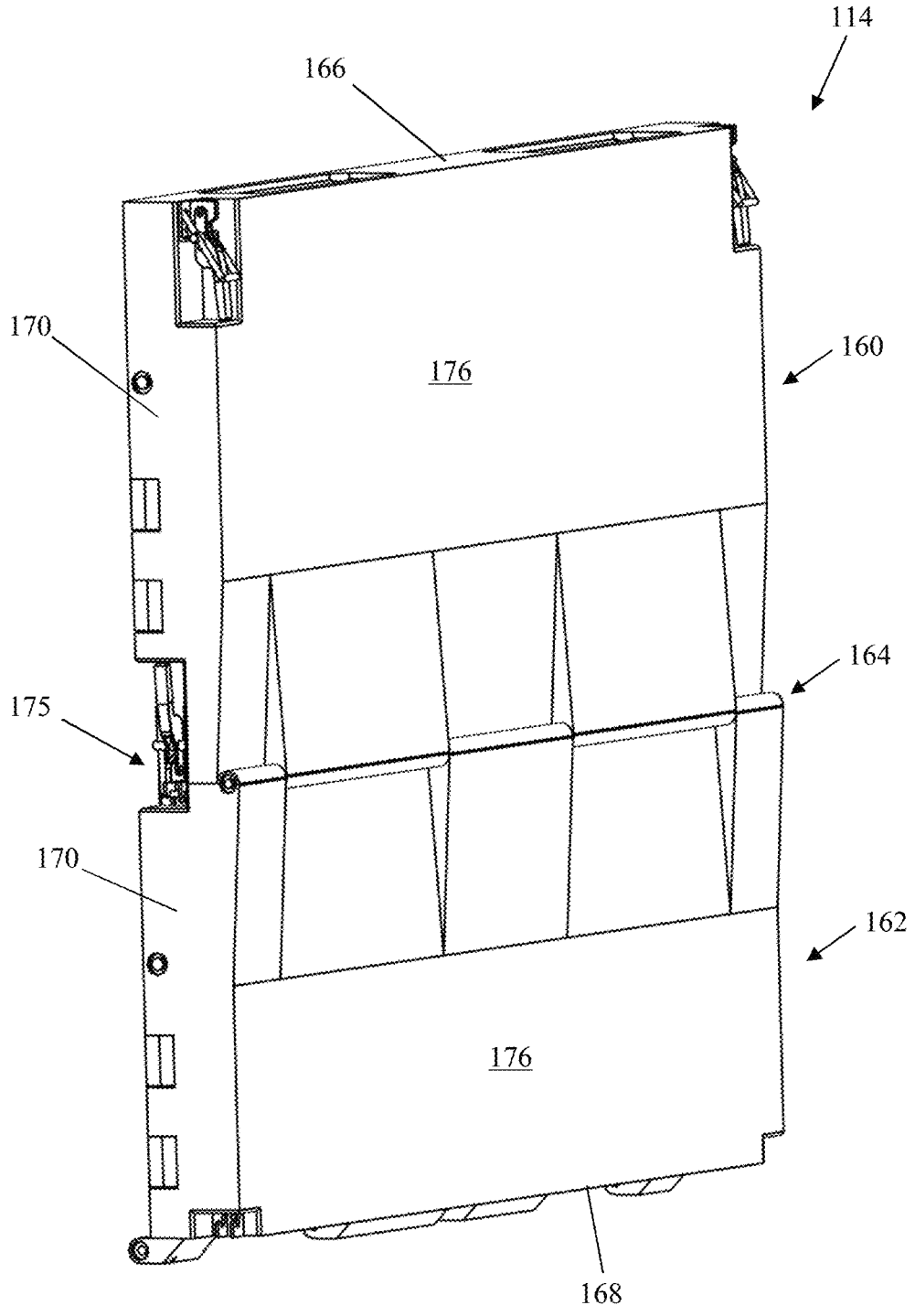
FIG. 41 is a rear perspective view of the first side wall shown in FIG. 40.
Figure 42:
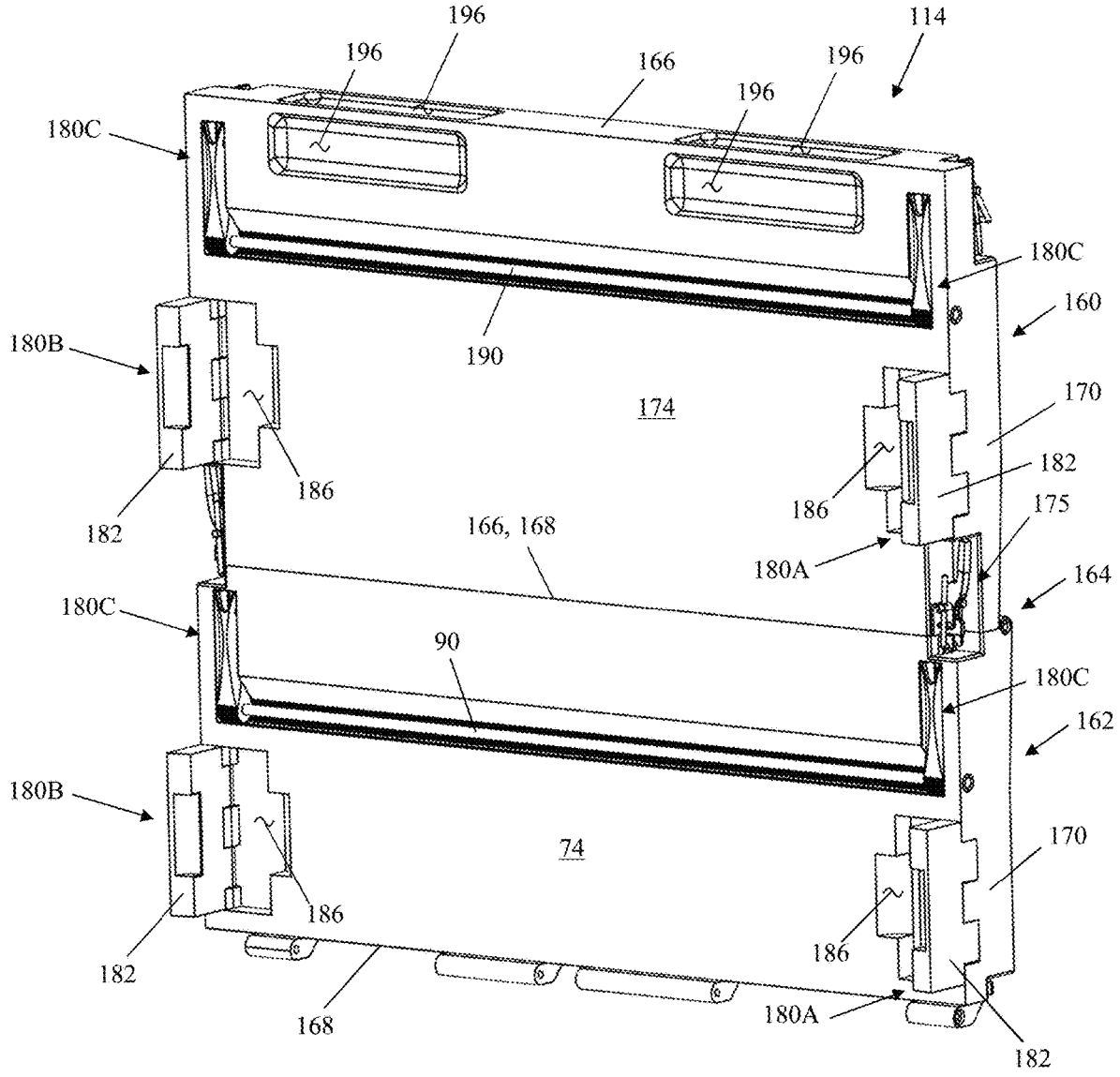
FIG. 42 is a front perspective view of the first side wall shown in FIGS. 40 and 41 with the first and second object supports in a support position.

In the illustrated embodiment, the first and second side walls 114, 116 are similar or generally identical. Referring to FIGS. 40-42, the first side wall 114 will be described in further detail herein with the understanding that the second side wall 116 has essentially a similar or the same construction. Thus, the description regarding the first side wall 114 also generally apply to the second side wall 214 as well. The first side wall 114 includes an upper portion 160 (e.g., an upper side wall portion) and a lower portion 162 (e.g., a lower side wall portion). The upper and lower portions 160, 162 are movable relative to one another (e.g., the upper portion 160 is movable relative to the lower portion 162). In the illustrated embodiment, the upper and lower portions 160, 162 are rotatably connected to one another with a hinge 164 (e.g., hingably coupled to one another). In some examples, the hinge 164 is a rod or shaft extending through aligned openings in the upper and lower portions 160, 162, although other configurations are within the scope of the present disclosure. As will become apparent, the hinge 164 facilitates the movement of the first side wall 114 between the deployed position and the collapsed position.

Figure 25:
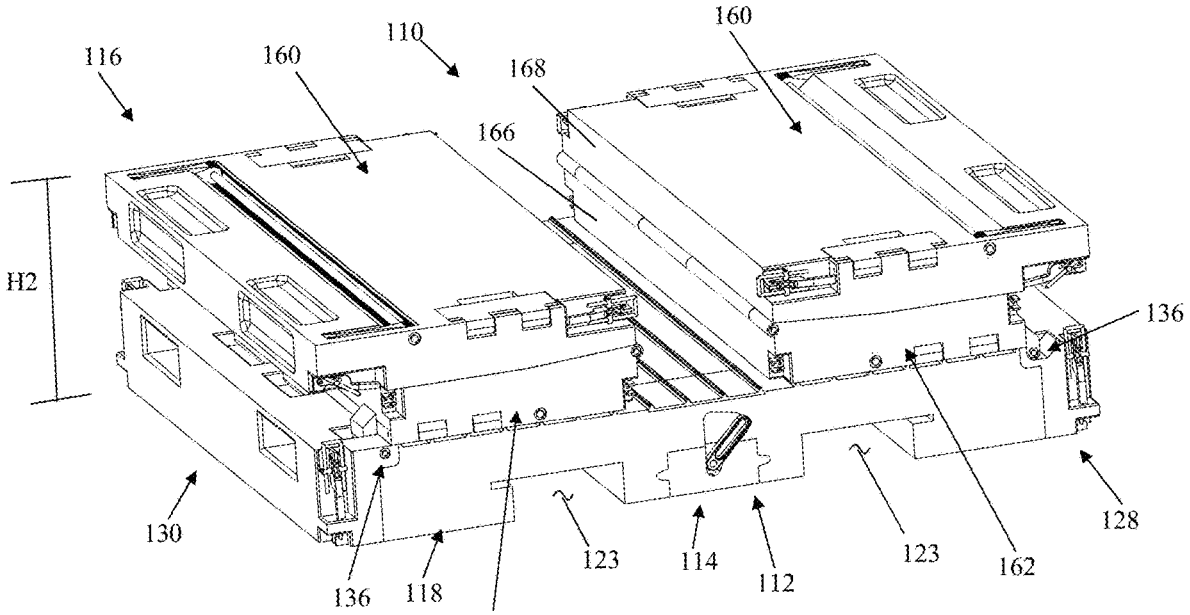
FIG. 25 is a front perspective view of the transport container shown in FIGS. 20-24 with the first and second extenders in the contracted position, as shown in FIG. 23, and the first and second side walls in a collapsed configuration.
Figure 26:
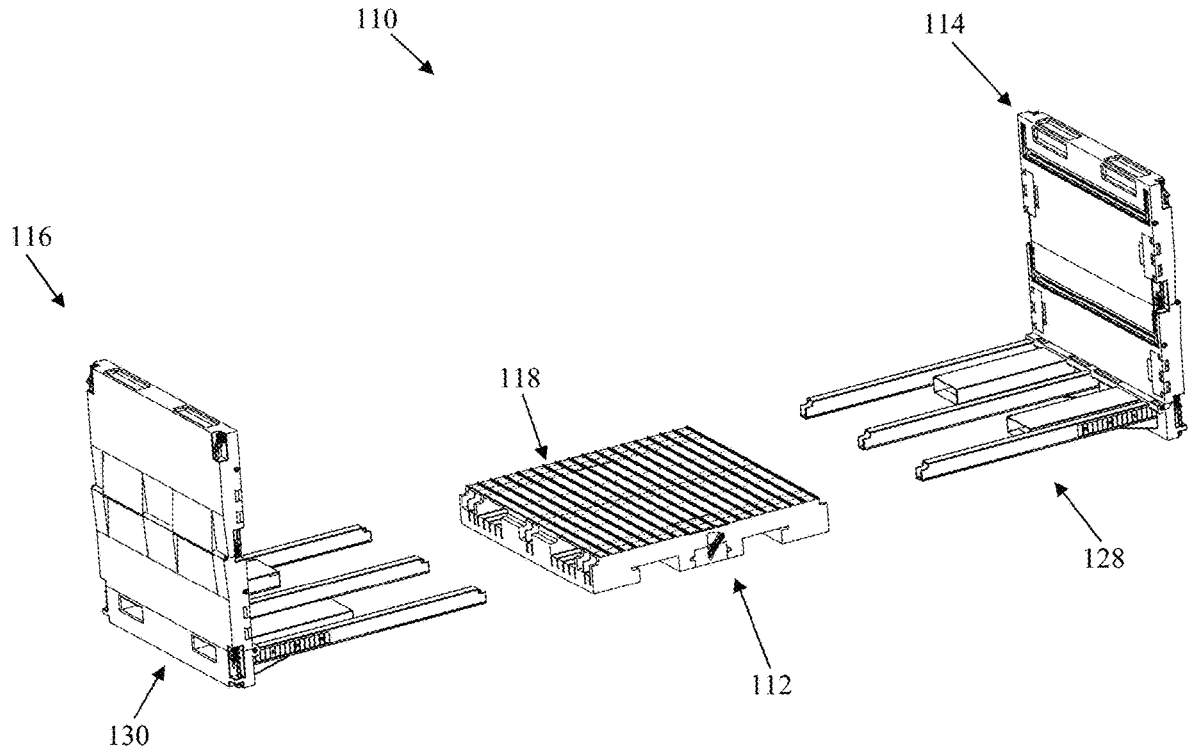
FIG. 26 is an exploded view of the transport container shown in FIGS. 20-25.

The upper portion 160 and lower portion 162 each include opposing upper and lower ends 166, 168, opposing front and rear sides 170, 172 (FIG. 19), and opposing interior and exterior faces or sides 174, 176. The interior side 174 faces the second side wall 116 when the first and second side walls 114, 116 are in the deployed positions. In the deployed position, the upper portion 160 and lower portion 162 are generally upright (e.g., extend generally perpendicular to the base 118). The lower end 168 of the upper portion 160 abuts and is supported by the upper end 166 of the lower portion 162 (e.g., the upper portion 160 is in end-to-end engagement with the lower portion 162). The lower end 168 of the lower portion 162 abuts and is supported by the wall support portion 132 (e.g., an upper surface thereof) of the first extender 128. Referring to FIG. 25, in the collapsed position, the first side wall 114 extends in a generally horizontal direction. In particular, the upper portion 160 and lower portion 162 extend in a generally horizontal direction. In other words, the upper and lower portions 160, 162 (broadly, the first side wall 114) lies generally flat in the collapsed position. In this position, the upper portion 160 generally overlies the lower portion 162 and the lower portion 162 generally overlies the base 118. The exterior side 176 of the upper portion 160 abuts and is supported by the exterior side of the lower portion 162 (e.g., the upper portion 160 is in face-to-face engagement with the lower portion 162). The interior side 174 of the lower portion 162 abuts and is supported by the upper surface 120 of the base 118. In some examples, the upper end 166 of the upper portion 160 is generally aligned with the first end 122 of the base assembly 112 when the first side wall 114 is in the collapsed position. This arrangement forms a relatively wide platform (in combination with the second side wall 116) to support another transport container 110 in the collapsed position stacked thereon (not shown).

Figure 43:
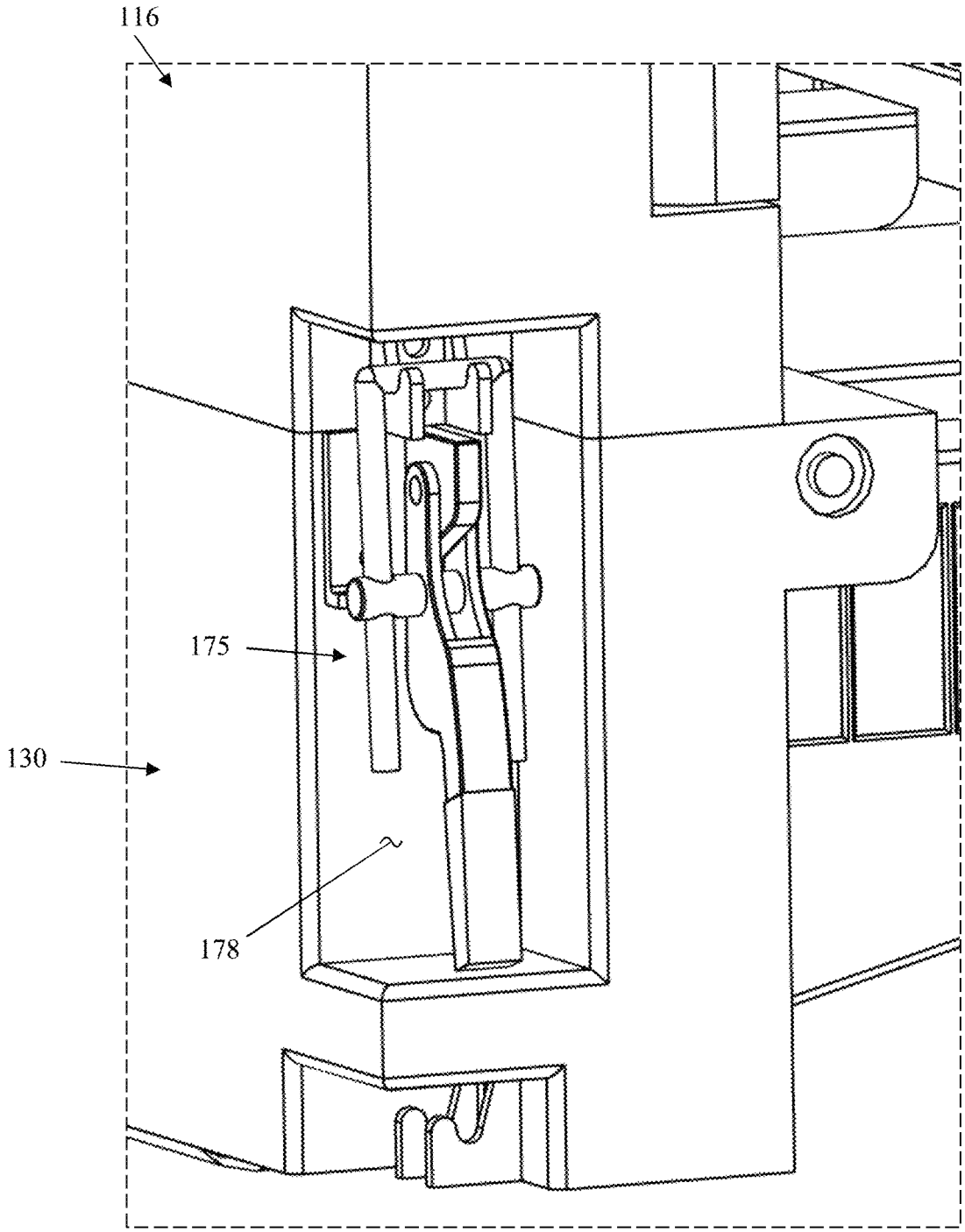
FIG. 43 is a detailed perspective view of a portion of the transport container shown in FIGS. 20-26 and 28 including a latch.

As shown in FIG. 43, the transport container 110 may include one or more latches 175 (e.g., a plurality of latches 175) to facilitate securing the first side wall 114 in the deployed position. For example, at least one latch 175 may be used to secure the upper portion 160 to the lower portion 162 in the deployed position and at least one other latch 175 may be used to secure the lower portion 162 to the first extender 128 in the deployed position. In the illustrated embodiment, the latches 175 are disposed within latch recesses 178 defined by the exterior sides 176. Placing each latch 175 within a latch recess 178 enables the latch 175 to be protected from being mistakenly released, such by adjacent transport containers 110. Each latch recess 178 is defined by the two components that are securable together. For example, the upper portion 160 of the first side wall 114 defines an upper part of the latch recess 178 and the lower portion 162 of the first side wall 114 defines a lower part of the latch recess 178 that the latch 175 used to secure the upper and lower portions 160, 162 together is disposed in. The latch recess 178, the latch 175 used to secure the lower portion 162 to the first extender 128 in the deployed position is disposed in, has portions defined by both the lower portion 162 and the first extender 128. In the illustrated embodiment, the transport container 110 includes two latches 175, one on the front side 170 and one the rear side 172 of the upper and lower portions 160, 162 to secure the upper and lower portions 160, 162 in the deployed position. The transport container 110 includes two latches 175, one on the front side 170 and one the rear side 172 of the lower portion 162 and the first extender 128 to secure the lower portion 162 and first extender 128 in the deployed position. In some examples, the latches 175 are pull down latches (i.e., a toggle latch or a draw latch). Other configurations and arrangements of the latches are within the scope of the present disclosure.

The transport container 110 may include one or more object supports 180A, 180B. In some examples, the object supports 180A, 180B are coupled to the first side wall 114. Each object support 180A, 180B is configured to inhibit the one or more objects O from moving in at least one of a rearward direction or a forward direction. In other words, the object supports 180A, 180B are configured to brace the one or more objects O to keep the objects O on the transport container 110. The rearward and forward directions are generally opposite of one another and generally perpendicular to the longitudinal axis LA.

In the illustrated embodiment, the transport container 110 includes a first or front object support 180A and a second or rear object support 180B. The front and rear object supports 180A, 180B provide lateral support (e.g., support generally perpendicular to the longitudinal axis LA) to the one or more objects O on the transport container 110. In some examples, the upper and lower portions 160, 162 each include the front object support 180A and the rear object support 180B (e.g., the first side wall 114 includes two front object supports 180A and two rear object supports 180B). By including front and rear object supports 180A, 180B on both the upper and lower portions 160, 162, the upper and/or lower portions of the one or more objects O can be supported. The front object support 180A is disposed adjacent the front side 170 of the first side wall 114 and generally inhibits the one or more objects O from moving in the forward direction. The rear object support 180B is disposed adjacent the rear side 172 of the first side wall 114 and generally inhibits the one or more objects O from moving in the rearward direction. In the illustrated embodiment, the front and rear object supports 180A, 180B are generally identical and each include a support flange 182. The front and rear object supports 180A, 180B are movable between a stowed position (as shown in FIG. 40) and a support position (as shown in FIG. 42). In the stowed position, the front and rear object supports 180A, 180B are located such that the object supports 180A, 180B are out of the way and do not brace the one or more objects O. In the illustrated embodiment, the first side wall 114 (e.g., the interior side 174) defines one or more support recesses 186. Each support recess 186 is sized and shaped to receive one or more of the front or rear object supports 180A, 180B when the object supports 180A, 180B are in the stowed position. In the stowed position, the support flange 182 extends generally parallel to the interior side 174 and, in some examples, is generally coplanar with the interior side 174. In the support position, the front and rear object supports 180A, 180B are located to brace the one or more objects O in either the forward or rearward direction. In the support position, the support flange 182 extends generally perpendicular to the interior side 174 (e.g., generally parallel to the longitudinal axis LA) and, in some examples, is generally coplanar with either the front side 170 or rear side 172. In the illustrated embodiment, the front and rear object supports 180A, 180B (e.g., the flange 182) are rotatably connected to the first side wall 114 with a hinge (e.g., hingably coupled to one another), although other configurations are within the scope of the present disclosure. In this manner, the front and rear object supports 180A, 180B rotate between the stowed and support positions. Each front and rear object support 180A, 180B may include a stop 83 (e.g., an abutment surface) configured to engage the first side wall 114 to position the object support 180A, 180B in the support position. The operator may selectively move the front and rear object supports 180A, 180B between the stowed and support positions as desired and/or needed in order to support the one or more objects O on the transport container 110.

Figure 18:
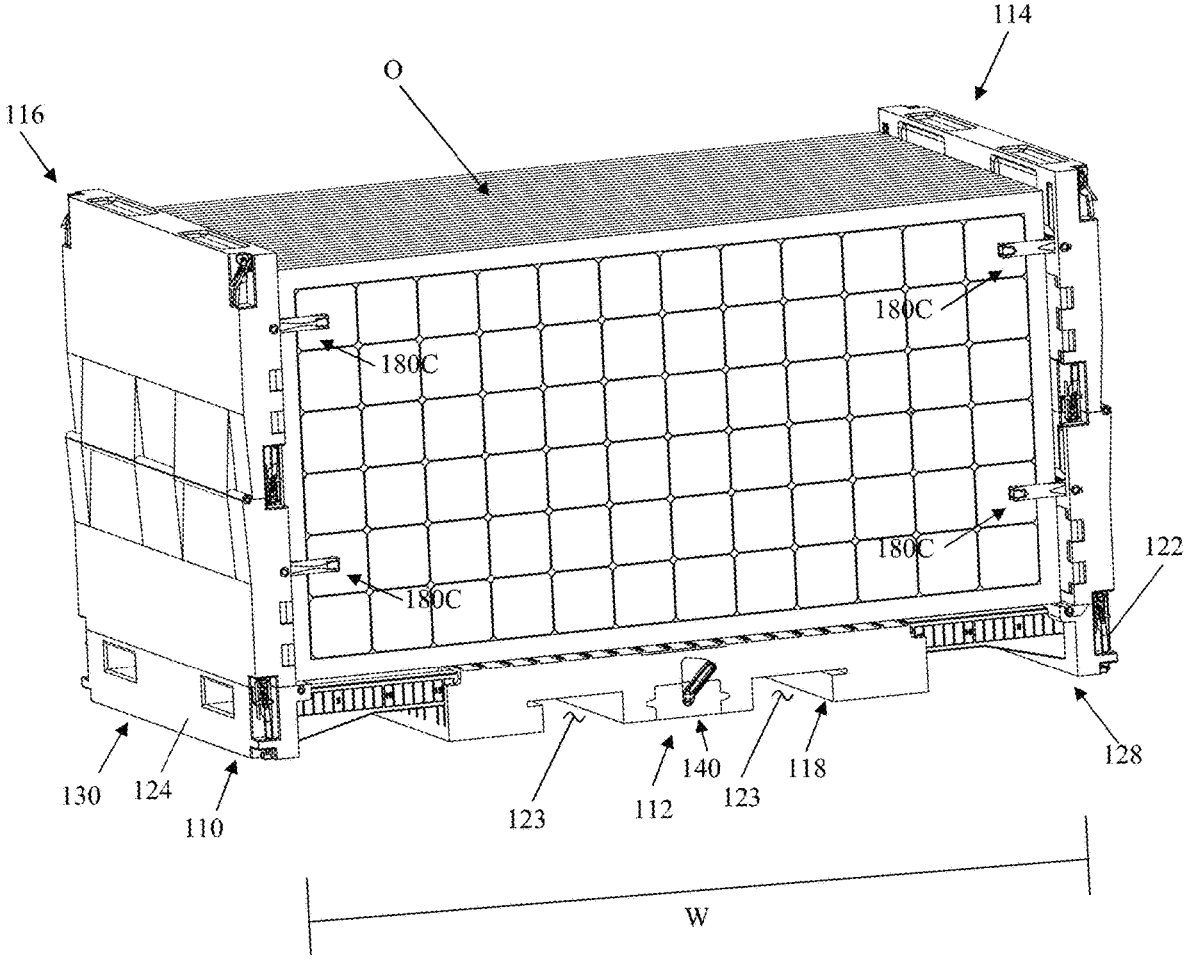
FIG. 18 is a front perspective view of an example system including a transport container according to another embodiment of the present disclosure and a plurality of solar panels positioned in the transport container.
Figure 19:
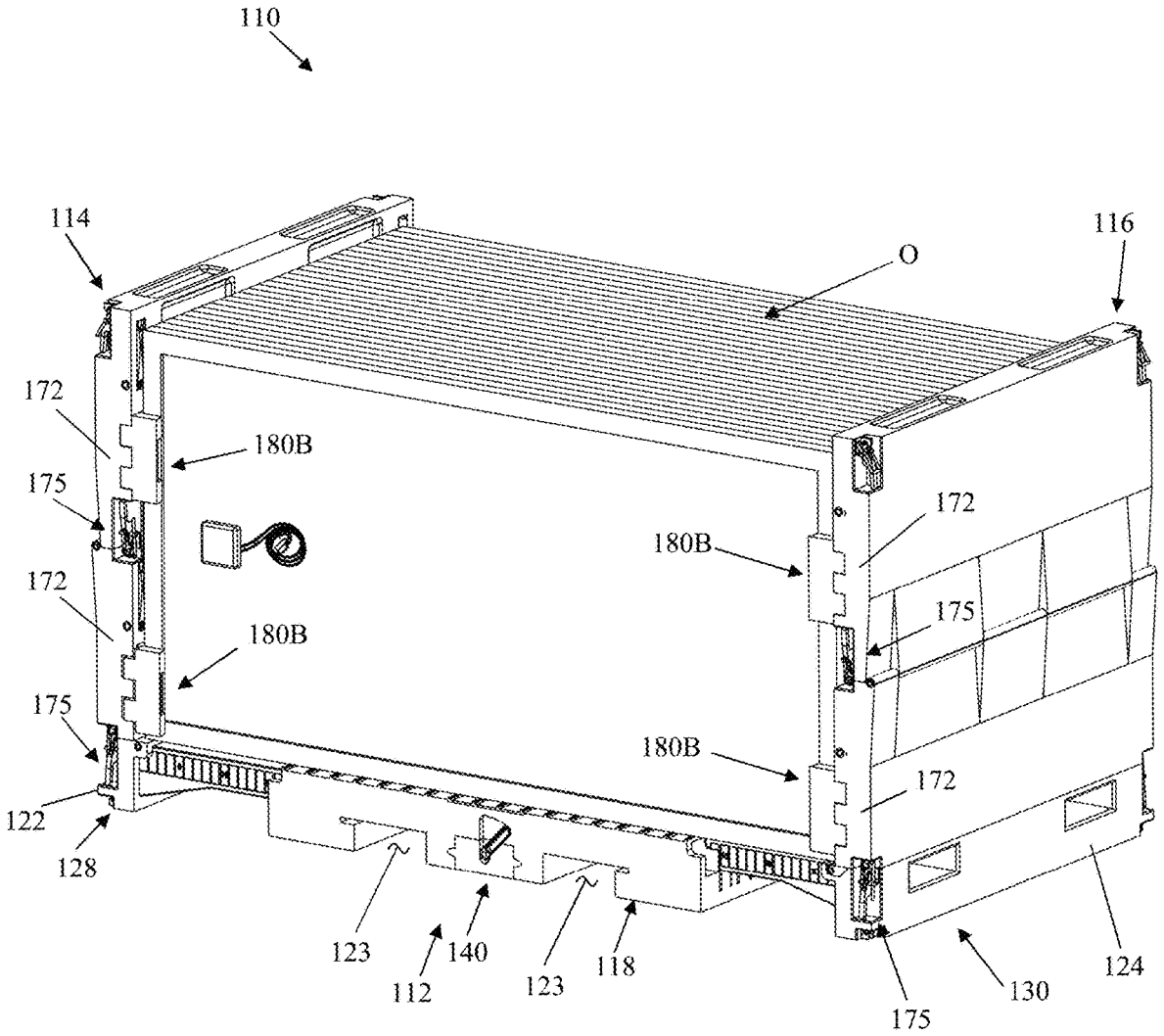
FIG. 19 is a rear perspective view of the system shown in FIG. 18.
Figure 20:
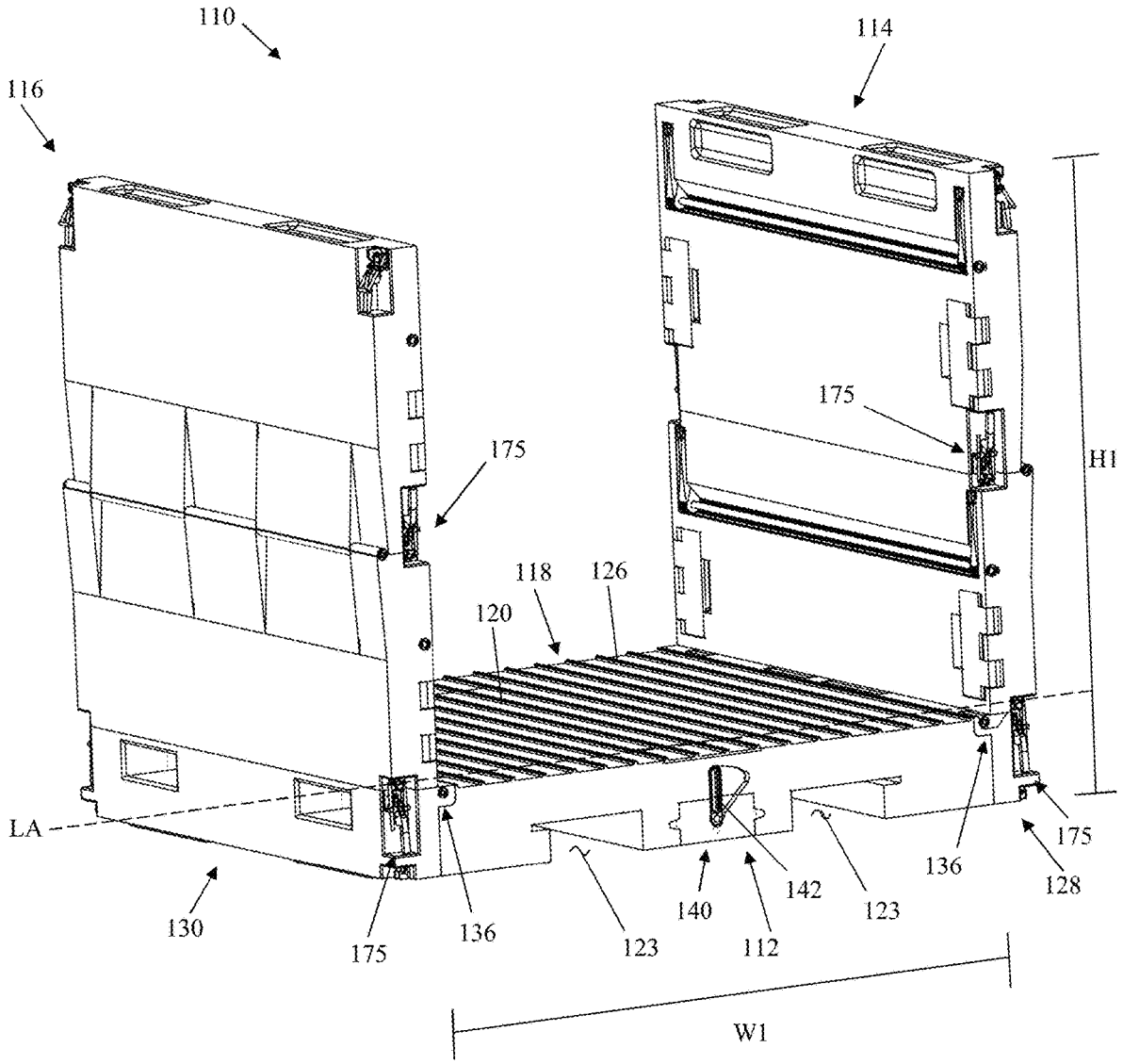
FIG. 20 is a front perspective view of an example transport container, such as the transport container shown in FIGS. 18 and 19, including a base, first and second extenders in a contracted position, first and second side walls in a deployed position, and a retainer in an unlocked position.

Referring to FIGS. 44-47, the transport container 110 may include an adjustable object support 180C. The adjustable object support 180C provides lateral support to the one or more objects O on the transport container 110. In the illustrated embodiment, the upper and lower portions 160, 162 each include the adjustable object support 180C (e.g., the first side wall 114 includes two adjustable object supports 180C). By including adjustable object supports 180C on both the upper and lower portions 160, 162, the upper and/or lower portions of the one or more objects O may be supported. The adjustable object support 180C is selectively movable in the rearward direction or the forward direction. By moving the adjustable object support 180C in the rearward direction or the forward direction, the adjustable object support 180C (in conjunction with the front or rear object supports 180A, 180B) may be used to brace the one or more objects O when the one or more objects O do not extend over the entire depth of the transport container 110 (e.g., when the one or more objects do not extend the full distance between the front and rear object supports 180A, 180B). For example, the adjustable object support 180C may be used to brace the one or more objects O when the transport container 110 is only partially loaded or when the one or more objects O do not extend the entire distance between the front and rear object supports 180A, 180B. The adjustable object support 180C may be adjusted or moved to generally brace the one or more objects O in either the forward or rearward direction. For example, the adjustable object support 180C may sandwich the one or more objects O between itself and the rear object support 180B, thereby bracing the objects from the forward direction (as shown in FIG. 18). In another example, the adjustable object support 180C may sandwich the one or more objects between itself and the front object support 180A, thereby bracing the objects from the rearward direction.

Figure 44:
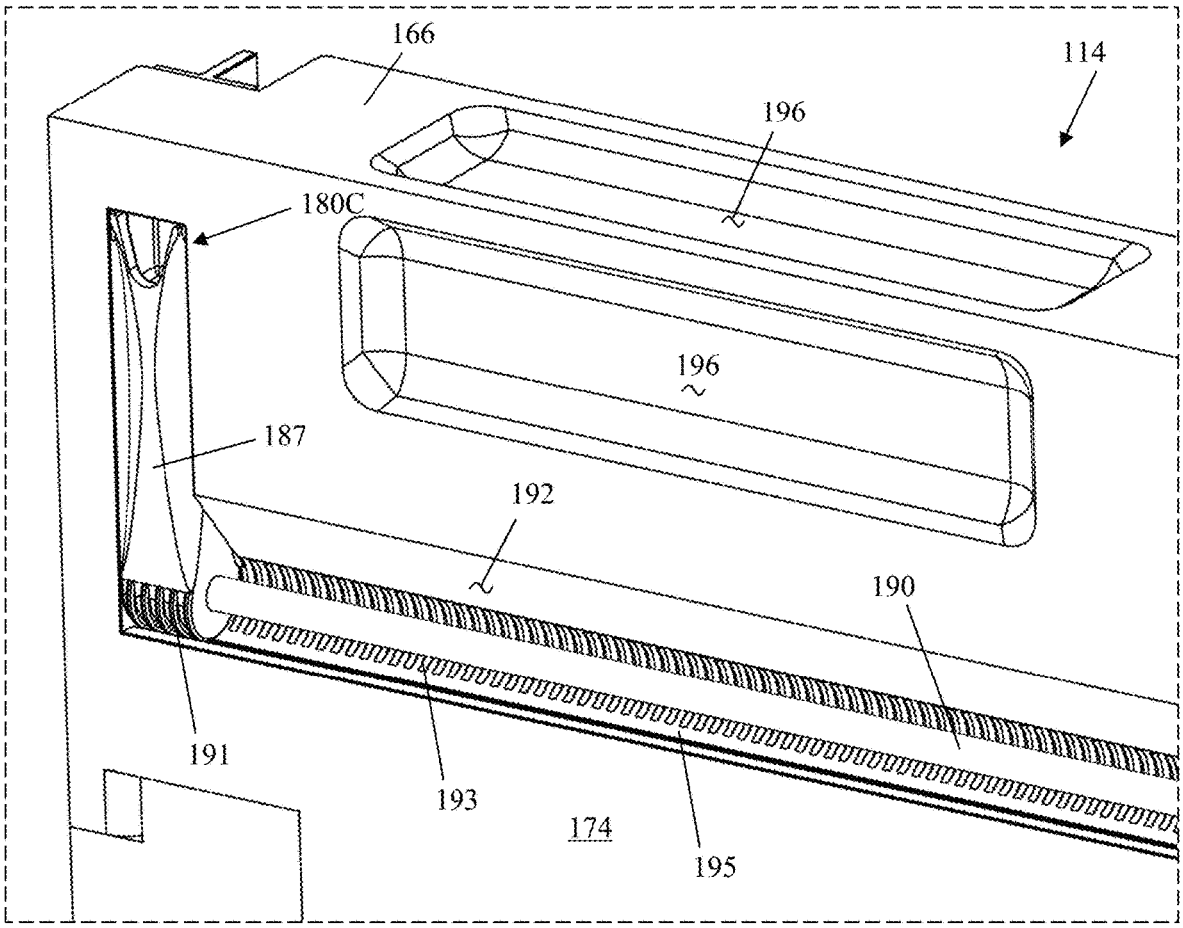
FIG. 44 is a detailed perspective view of a portion of the first side wall shown in FIGS. 40-42 including a third object support in a stowed position.
Figure 45:
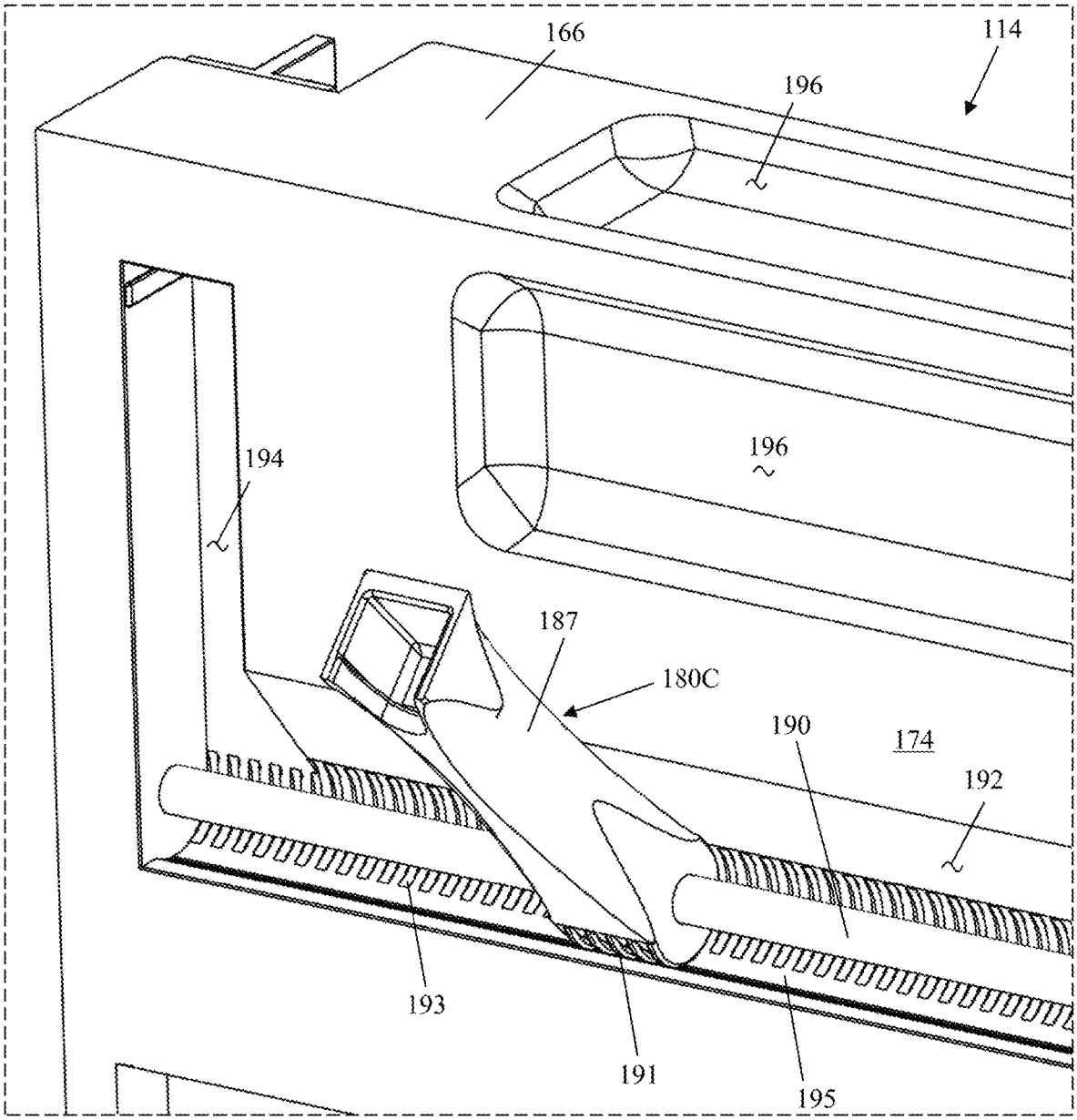
FIG. 45 is a detailed perspective view of the portion of the first side wall shown in FIG. 44 with the third object support in a sliding position.
Figure 46:
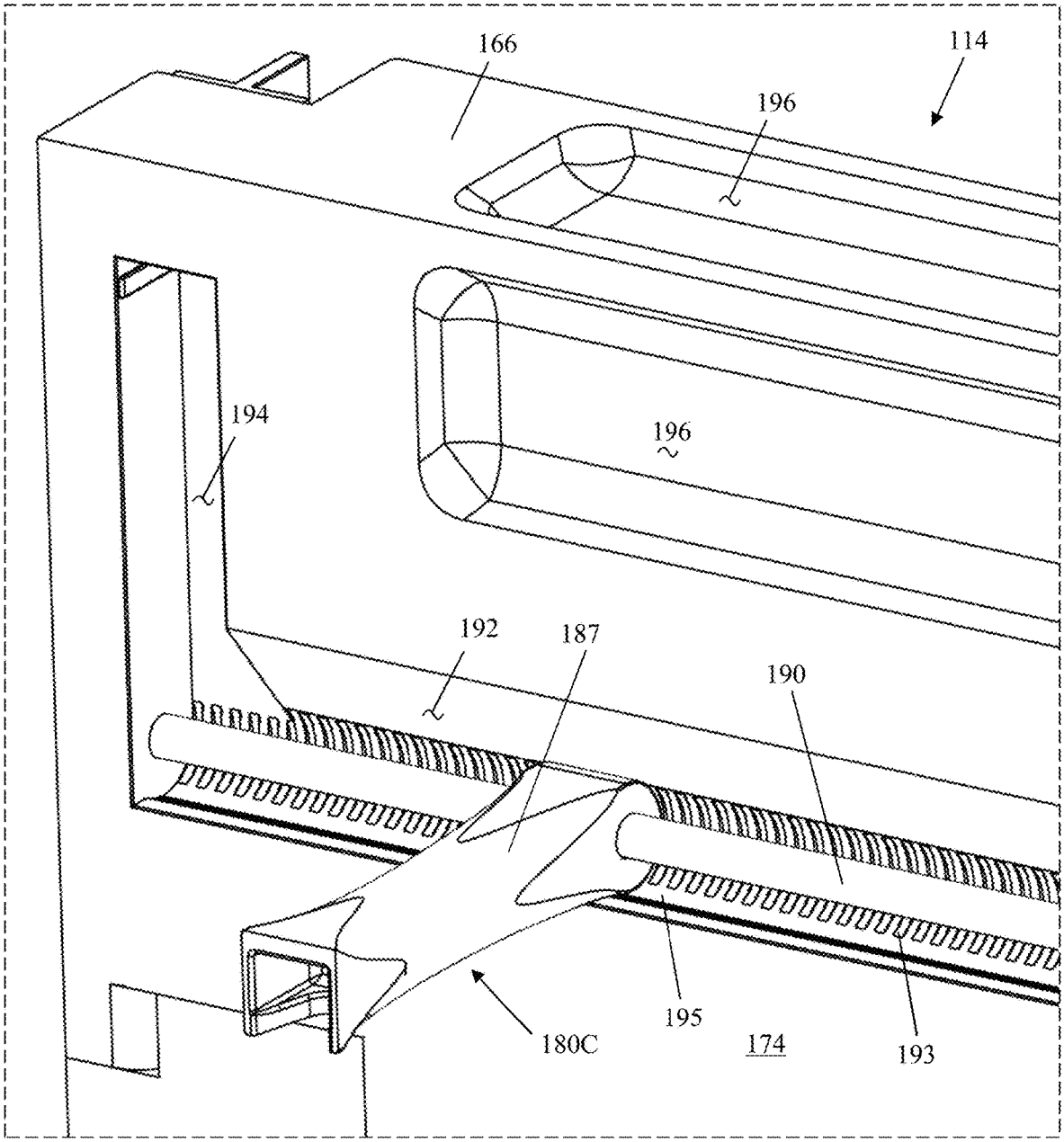
FIG. 46 is a detailed perspective view of the portion of the first side wall shown in FIGS. 44 and 45 with the third object support in a support position.
Figure 47:
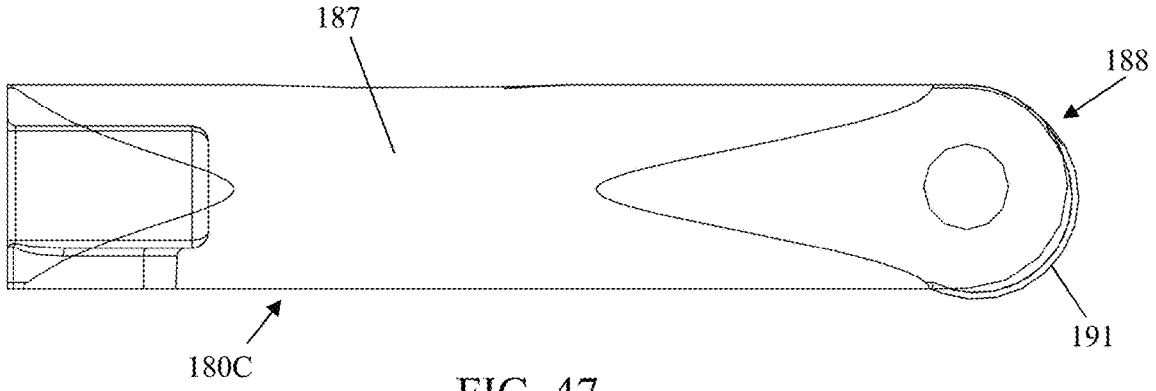
FIG. 47 is a front view of the third object support shown in FIGS. 44-46.

As shown in FIG. 47, the adjustable object support 180C may include a cam or eccentric base 188 and an arm or brace 187 extending outward from the eccentric base 188. The eccentric base 188 is rotatably and slidably mounted on a shaft 190. The eccentric base 188 may be used to secure the adjustable object support 180C in place. As shown in FIGS. 44-46, the shaft 190 may be disposed within a channel 192 of the first side wall 114 (e.g., upper portion 160 or lower portion 162). The shaft 190 and channel 192 extend generally parallel to the upper surface 120 of the base 118 and generally perpendicular to the longitudinal axis LA. The shaft 190 and channel 192 extends in a forward direction from a position generally at or adjacent the rear side 172 and/or in a rearward direction from in a rearward direction from a position generally at or adjacent the front side 170. The channel 192 is defined by an open side facing the interior of the transport container 110 and an opposing closed side 195. The adjustable object support 180C is moveable (e.g., slideable) along the shaft 190 to move the adjustable object support 180C into engagement with the one or more objects O to brace the one or more objects O.

The adjustable object support 180C is rotatable about the shaft 190 between a stowed position (as shown in FIG. 44), a sliding position (as shown in FIG. 45) and a support position (as shown in FIG. 46). In the stowed position, the adjustable object support 180C is located such that the support 180C is out of the way and does not brace the one or more objects O. In the illustrated embodiment, the first side wall 114 (e.g., the interior side 174) defines one or more adjustable support recesses 194. In some examples, the first side wall 114 defines two adjustable support recesses 194, one disposed adjacent the front side 170 and another disposed adjacent rear side 172. Each adjustable support recess 194 is in fluid communication with the channel 192. Each adjustable support recess 194 is sized and shaped to receive the adjustable object support 180C (e.g., a portion thereof). In the stowed position, the adjustable object support 180C (e.g., the brace 187) extends in a generally vertical direction (e.g., generally parallel to the first side wall 114). In the support portion, the adjustable object support 180C is located to brace the one or more objects O in the forward and/or rearward direction. In the support position, the adjustable object support 180C (e.g., the brace 187) extends in a generally horizontal direction (e.g., generally parallel to the longitudinal axis LA and generally perpendicular to the first side wall 114). In the support position, the adjustable object support 180C extends inwardly to engage the one or more objects O. To move the adjustable object support 180C between the stowed and support positions, the adjustable object support 180C is rotated about the shaft 190. For example, the adjustable object support 180C may be rotated about 190 degrees. Moreover, there may be more than one adjustable object support 180C mounted on a single shaft 190, such as two adjustable object supports 180C.

To secure the adjustable object support 180C in the support position, the eccentric base 188 engages the closed side 195 defining of the channel 192. The closed side 195 is generally arcuate. The eccentric base 188 has an arcuate surface generally opposite the brace 187 that, when the adjustable object support 180C is in the support position, engages the closed side 195 to form a friction or interference fit between the adjustable object support 180C and the first side wall 114. In some examples, the arcuate surface of the base 188 may include one or more projections or ribs 191

(e.g., arcuate projections or ribs) and the closed side 195 may define one or more grooves or recesses 193 along the channel 192 that are sized and shaped to receive the ribs 191 of the eccentric base 188 when the adjustable object support 180C is in the support position. By inserting the ribs 191 of the eccentric base 188 into the recesses 193 of the channel 192, the adjustable object support 180C may be securely positioned in the support position. In some examples, the brace 187 may form an interference fit with the first side wall 114 in the stowed position to secure the adjustable object support 180C in the stowed position.

The adjustable object support 180C is selectively movable to one or more positions along the shaft 190. This enables the adjustable object support 180C to brace various quantities of objects O. In the illustrated embodiment, to move the adjustable object support 180C along the shaft 190, the adjustable object support 180C is rotated to the sliding position (as shown in FIG. 45). The adjustable object support 180C is in the sliding position when the adjustable object support 180C is at a predetermined angle (or range of angles) relative to the interior side 174 of the first side wall 114 that is between the stowed and support positions (e.g., between 0 degrees and 190 degrees). For example, the adjustable object support 180C may be in the sliding position when the adjustable object support 180C extends about 45 degrees relative to the interior side 174 of the first side wall 114. In the sliding position, the adjustable object support 180C is outside the adjustable support recess 194 and the eccentric base 188 is free of engagement with the sides of the channel 192. Accordingly, the adjustable object support 180C is free to moved (e.g., slid along the shaft 190) to one or more lateral positions. When the adjustable object support 180C is located in a desired lateral position, the adjustable object support 180C may be rotated to the support position, thereby securing the adjustable object support 180C in position relative to the first side wall 114. To move the adjustable object support 180C from the support position, the operator may rotate the adjustable object support 180C about the shaft 190. When the adjustable object support 180C is at or aligned with the adjustable support recess 194, the operator may rotate the adjustable object support 180C about the shaft 190 into or out from the adjustable support recess 194. The operator may selectively move the adjustable object support 180C between the stowed, sliding, and support positions as desired and/or needed in order to support the one or more objects O on the transport container 110.

Figure 48:
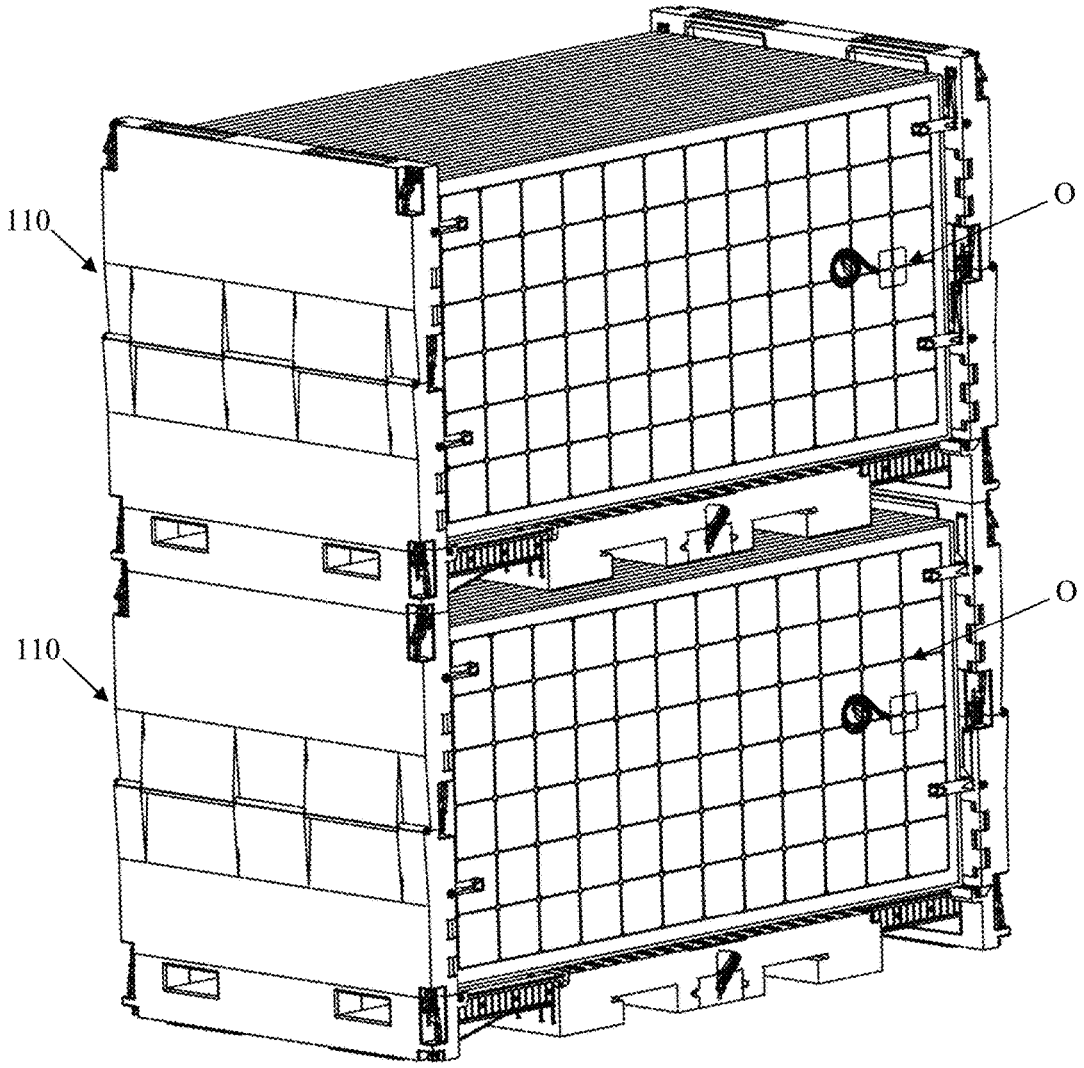
FIG. 48 is a perspective view of an example system including the transport container and solar panels shown in FIG. 18 stacked with another transport container carrying another plurality of solar panels.

Referring to FIGS. 40 and 42, the first side wall 114 may define at least one set of foot recesses 196. Each foot recess 196 is sized and shaped to receive one of the feet 125 from the base 118 of another (e.g., second) transport container 110, when the second transport container 110 is stacked on the first transport container 110 (as shown in FIG. 48). The mating engagement between the feet recesses 196 of the first transport container 110 and the feet 125 of the second transport container 110 secures and aligns the second transport container 110 on the first transport container 110 when the second transport container 110 is stacked on the first transport container 110. In the illustrated embodiment, the first side wall 114 includes a first set (e.g., pair) of feet recesses 196 on the upper end 166 of the upper portion 160 (e.g., an upper surface of the first side wall 114). The first set of feet recesses 196 receives the first set of feet 125 from another transport container 110 stacked thereon when the first side wall 114 is in the deployed position (as shown in FIGS. 18-23). In some examples, the first side wall 114 includes a second set (e.g., pair) of feet recesses 196 on the interior side 174 of the upper portion 160. The second set of feet recesses 196 receives the first set of feet 125 from the other transport container 110 stacked thereon when the first side wall 114 is in the collapsed position (as shown in FIG. 25). Accordingly, the first set of feet recesses 196 is disposed at the same longitudinal position as the second set of feet recesses 196, relative to the base 118, when the first side wall 114 is in the deployed and collapsed positions, respectively.

Having described the features and elements of the first side wall 114, it is appreciated that the second side wall 116 includes these same features and elements, as indicated in the drawings.

As is now apparent, the transport container 110 is movable between a collapsed configuration (FIGS. 18-23) and a deployed configuration (FIG. 25). In the collapsed configuration, the first and second side walls 114, 116 are in their collapsed positions and the first and second extenders 128, 130 are in their contracted positions (e.g., pushed inward to the base 118). In the collapsed configuration, several transport containers 110 may be stacked on top of each other in a relatively compact manner so that the transport containers 110 may be transported (e.g., returned to the sender of the one or more objects O). In the deployed configuration, the first and second side walls 114, 116 are in their deployed positions. The first and second extenders 128, 130 (e.g., the first and second side walls 114, 116) may be at generally any longitudinal location relative to the base 118 to conform the transport container 110 to the size of the one or more objects being carried. For example, the first and second side walls 114, 116 and the first and second extenders 128, 130 may be in the contracted position (e.g., a non-extended or retracted position), which generally corresponds to the first width W1, or the first and second side walls 114, 116 and first and second extenders 128, 130 may be in the first extended position, which generally corresponds to the second width W2. For example, the first and second side walls 114, 116 may be positioned to receive objects, such as solar panels (e.g., panel 4), having a length of about 65 inches (1.65 m) (i.e., the first extended position) or about 77 inches (1.96 m) (i.e., the second extended position), although other arrangements are within the scope of the present disclosure. When supported by the transport container 110, the length of the one or more objects O is generally parallel to the width W of the transport container 110.

Figure 23:
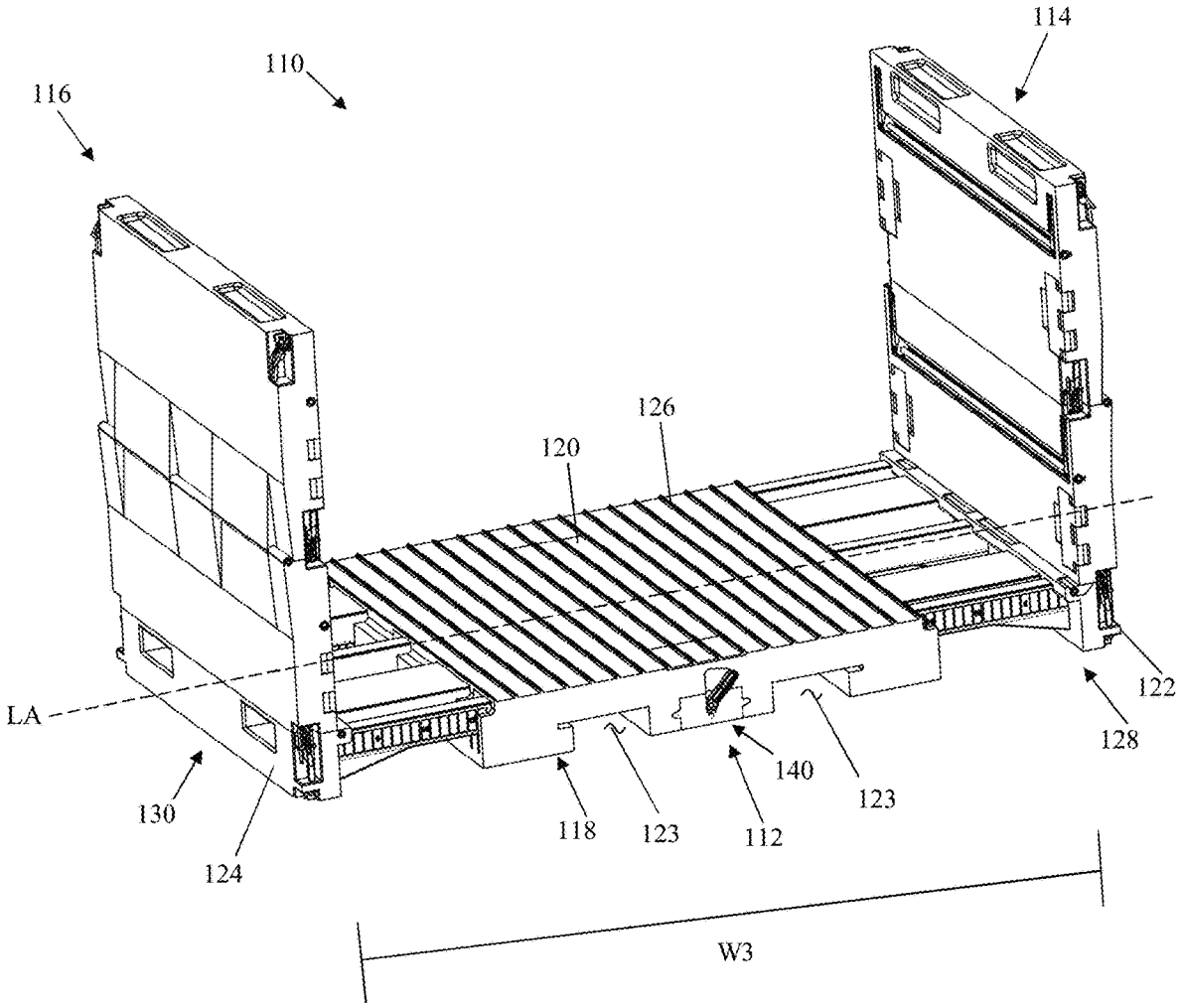
FIG. 23 is a front perspective view of the transport container shown in FIGS. 20-22 with the first and second extenders in a second expanded position and the retainer in a locked position.
Figure 24:
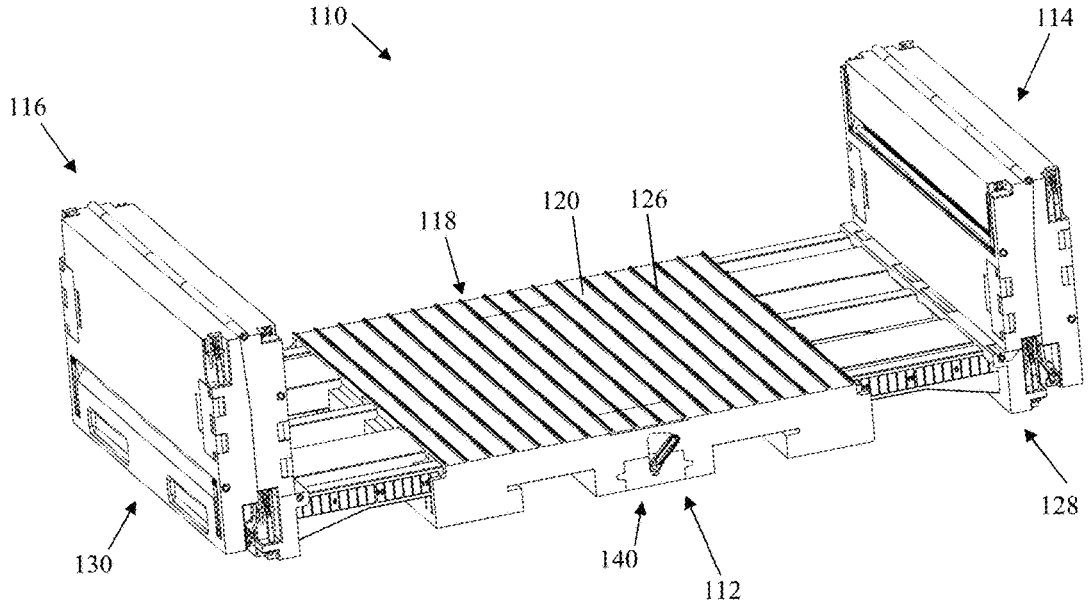
FIG. 24 is a front perspective view of the transport container shown in FIGS. 20-23 with the first and second side walls in a partially collapsed configuration.

In operation, to move the first side wall 114 from the deployed position (as shown in FIGS. 18-23) to the collapsed position (as shown in FIGS. 24 and 25), the operator releases all the latches 175. When the latches 175 are in a released configuration (and all the objects O are removed from the transport container 110), the operator rotates the first side wall 114 (specifically, the lower portion 162) downward toward the base 118 about the hinge 136 until the lower portion 162 lays flat on the base 118. The operator also rotates the upper portion 160 (in a direction generally opposite the rotation of the lower portion 162) downward toward the base 118 about the hinge 164 until the upper portion 160 lays flat on the lower portion 162. Rotation of the upper portion 160 relative to the lower portion 162 may occur simultaneously with or after the rotation of the lower portion 162 relative to the base 118. Alternatively, the upper portion 160 may first be rotated downward alongside the lower portion 162, before the lower portion 162 is rotated toward the base 118 (FIG. 24).

To move the first side wall 114 from the collapsed position to the deployed position, the operator rotates the lower portion 162 upward away from the base 118 about the hinge 136 until the lower end 168 of the lower portion 162 abuts the first extender 128. The operator also rotates the upper portion 160 (in a direction generally opposite the rotation of the lower portion 162) upward away from the lower portion 162 about the hinge 164 until the lower end 168 of the upper portion 160 abuts the upper end 166 of the lower portion 162. Rotation of the upper portion 160 relative to the lower portion 162 may occur simultaneously with, before, or after the rotation of the lower portion 162 relative to the base 118. When the lower portion 162 of the first side wall 114 is generally upright, the operator may secure the latches 175 between the first extender 128 and the lower portion 162 to secure and hold the lower portion 162 in position. When the upper portion 160 of the first side wall 114 is generally upright, the operator may secure the latches 175 between the upper and lower portions 160, 162 to secure and hold the upper portion 160 in position.

In operation, to move the first and second side walls 114, 116 and first and second extenders 128, 130 from the contracted position to one of the extended positions (e.g., a first extended position, a second extended position, etc.), the operator moves the retainer 140 to the unlocked position. In particular, the operator rotates the handle 142 to the vertical orientation. This moves the pawls 146, 148 out of engagement with the rails 134 of the first and second extenders 128, 130, enabling the first and second extenders 128, 130 to move outward. The operator then pulls the first and second side walls 114, 116 and first and second extenders 128, 130 outward to the desired extended position. The operator then moves the retainer 140 back to the locked position to secure the first and second side walls 114, 116 and first and second extenders 128, 130 in place.

Figure 21:
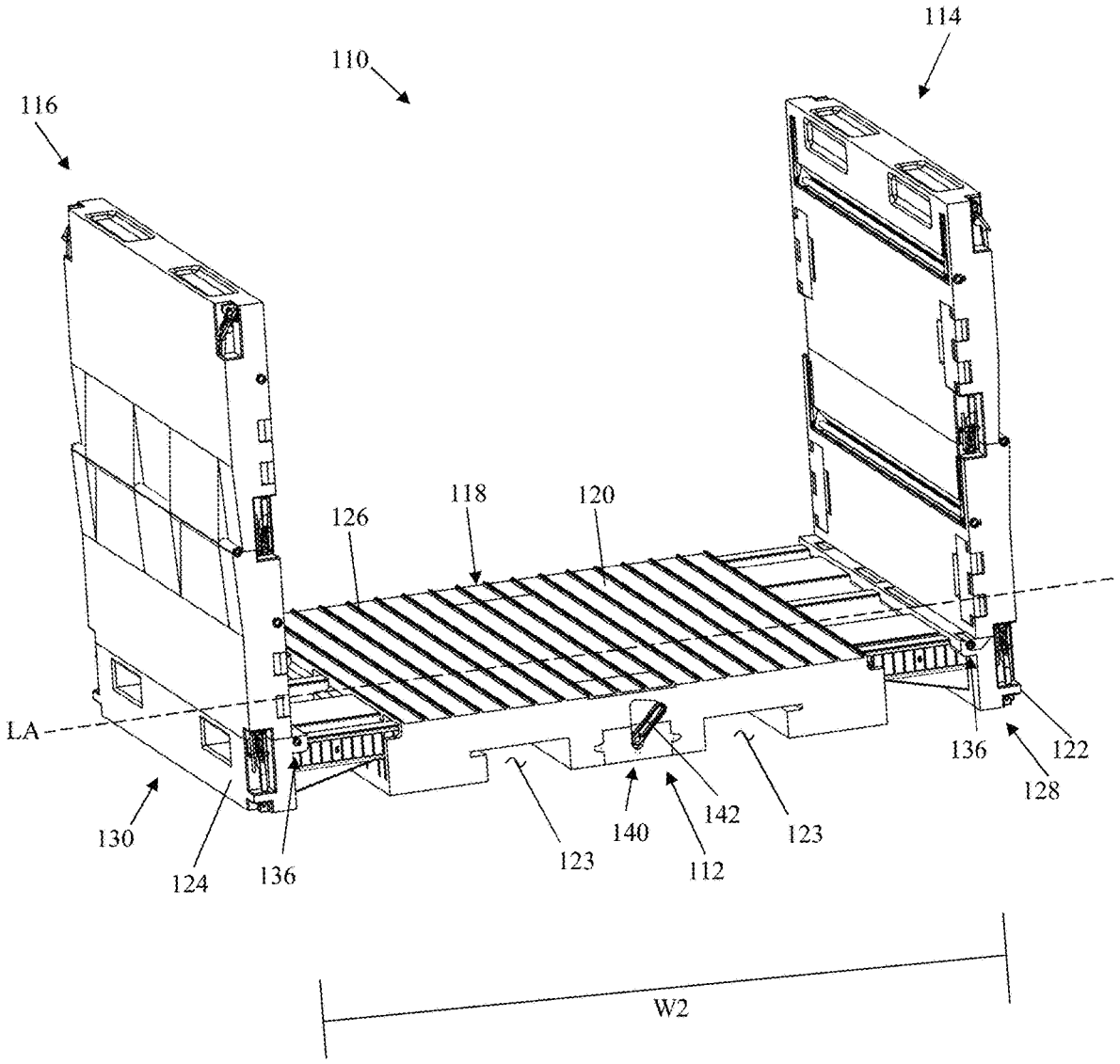
FIG. 21 a front perspective view of the transport container shown in FIG. 20 with the first and second extenders in a first expanded position and the retainer in a locked position.
Figure 22:
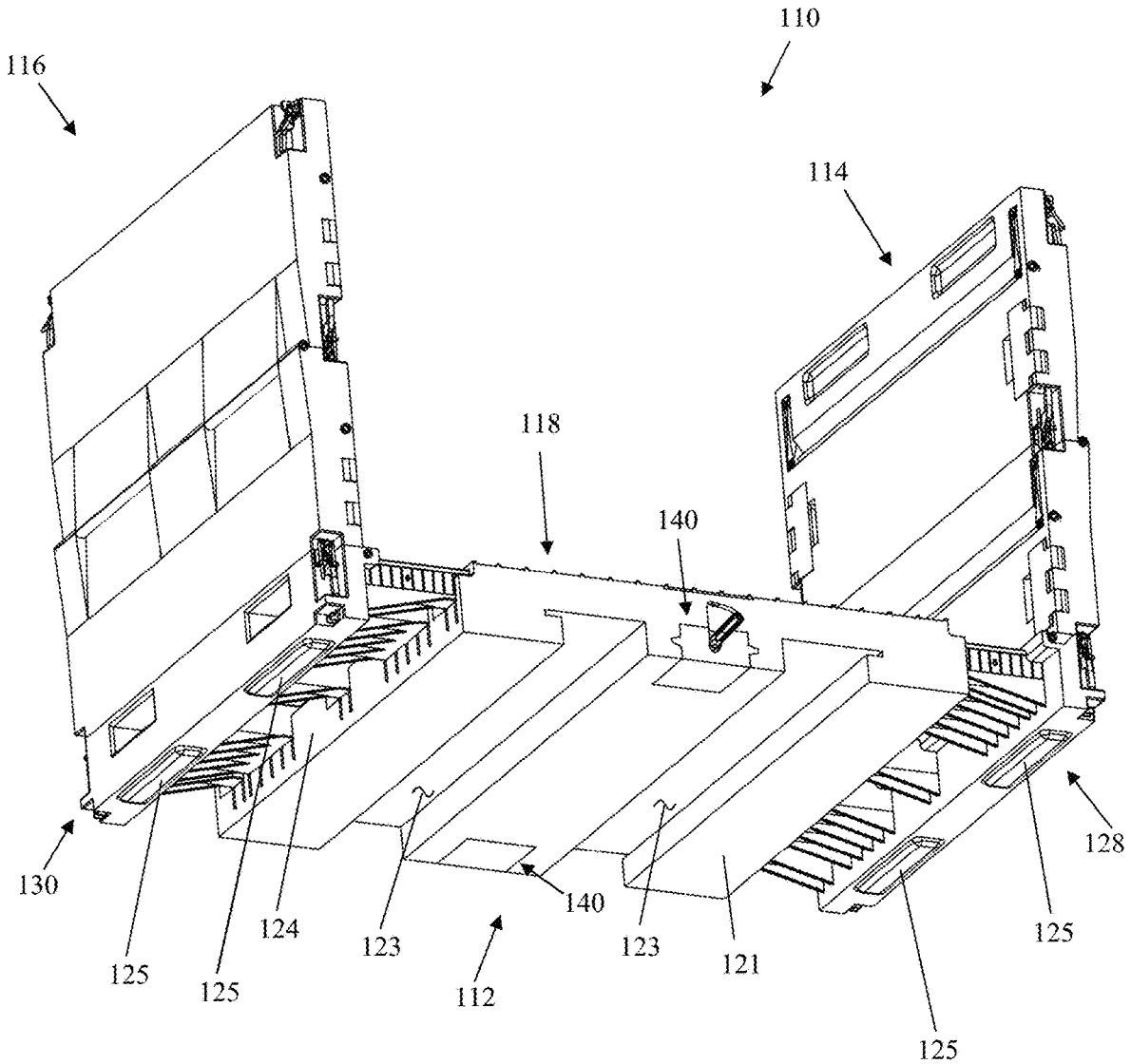
FIG. 22 is a lower perspective view of the transport container shown in FIGS. 20 and 4 with the first and second extenders in the first expanded position and the retainer in the locked position, as shown in FIG. 21.

To move the first and second side walls 114, 116 and first and second extenders 128, 130 one of the extended positions to the contracted position, the operator can simply push the first and second side walls 114, 116 and first and second extenders 128, 130 inward. The retainer 140 permits the first and second side walls 114, 116 and first and second extenders 128, 130 to move inward, even when the retainer 140 is in the locked position. Alternatively, the operator can, but is not required to, move the retainer 140 to the unlocked position before pushing the first and second side walls 114, 116 and first and second extenders 128, 130 toward the contracted position. The operator repeats this same process if the operator wants to move the first and second side walls 114, 116 and first and second extenders 128, 130 from a wider extender position (as shown in FIG. 23) to a narrower extender position (as shown in FIG. 21).

Referring to FIGS. 49-64, another example of a transport container or pallet constructed according to the teachings of the present disclosure is generally indicated at reference numeral 210. The transport container 210 may be used to carry and transport one or more objects O. In particular, the transport container 210 may be used to carry one or more generally planar objects O, such as panels, sheets, boards, etc. In one embodiment, the objects O are solar panels (e.g., panels 4). However, it is understood the transport container 210 may be used to transport objects O of generally any size and shape.

The transport container 210 includes a platform or base 212 and opposing first and second side walls 214, 216 (e.g., first and second side wall assemblies) supported by the base 212. The first and second side walls 214, 216 are operatively connected or coupled to the base 212. The base 212 is configured to support the one or more generally planar objects O. The base 212 includes an upper surface 218 configured to engage and support the one or more generally planar objects O and an opposing lower surface 220 (shown in FIG. 53). The base 212 has opposing first and second ends 222, 224 with a longitudinal axis LA extending between the first and second ends 222, 224. The base 212 may define one or more forklift channels 223. Each forklift channel 223 may be sized and shaped, for example, to receive a fork or tine of a forklift, a pallet jack, or other suitable lifting device (not shown) to enable the lifting device to lift and move the transport container 210. In the illustrated embodiment, each forklift channel 223 extends generally perpendicular to the longitudinal axis LA. Alternatively, one or more forklift channels 223 may extend in any other direction that enables the transport container 210 to function as described herein.

The base 212 may include one or more reinforcing members (not shown) for strengthening the base and enabling the transport container 210 to carry heavier loads. The one or more reinforcing members may extend between first end 222 and second end 224. In one embodiment, the one or more reinforcing members may extend generally parallel to the longitudinal axis LA. The base 212 can include one or more reinforcing channels extending in (e.g., through) the base, each reinforcing channel sized and shaped to receive one of the reinforcing members. The base 212 can include an end cap (not shown) closing on end of the reinforcing channel and an opposite open end, through which the reinforcing member is inserted. The base 212 can include a retainer (not shown), such as a raised lip, at the open end of the reinforcing channel to hold and secure the reinforcing member in the reinforcing channel. The reinforcing members facilitate the transfer of loads from the ends of the base 212 toward (e.g., to) the middle of the base to where the forklift channels 223 are located. This ensures that when the base 212 is picked up by the forks of a forklift, the base 212, via the reinforcing members, can carry the load of the objects O supported thereon and does not collapse under the weight of the objects O. The base 212 may be of a sufficient length that the reinforcing members are necessary to ensure the ends 222, 224 of the base 212 are sufficiently supported and can carry the load of the objects O when the base 212 is picked up, such as by a forklift. In one embodiment, the base 212 (and side walls 214, 216) is made of plastic (e.g., molded plastic) and the reinforcing members are made of metal. For example, the reinforcing members may be steel members such as rods, bars, square tubing, circular tubing, etc. In one embodiment, the reinforcing members in the base 212 are pre-stressed, further strengthening the base 212. In one embodiment, the transport container 210 (e.g., base 212) with the reinforcement members can carry up to about 2,700 lbs (1225 kg).

In one method of assembly, the reinforcing channels of the base 212 are constructed to be curved (about an axis that is generally parallel to the upper or lower surface 218, 220 and generally perpendicular to the longitudinal axis LA). To insert the reinforcing member into the reinforcing channel, the base 212 is bent to substantially straighten the curved reinforcing channel to permit the reinforcing member to be inserted (e.g., slid) into the channel through the open end. In one example, the base 212 is bent or deflected about 1-1½ inches (2.4-3.8 cm). After the reinforcing member is inserted into the reinforcing channel, the tool bending the base 212 is released, allowing the base 212 to return to its unbent or undeflected state. As the base 212 returns to the to its undeflected stated, material of the base 212 stresses (e.g., bends) the reinforcing member (e.g., the reinforcing member becomes pre-stressed). Preferably, the reinforcing member is inserted into the reinforcing channel after (e.g., immediately after) the base 212 exists the injection molding machine. As a result, the base 212 is bent while the base 212 is still warm from the injection molding machine, which makes it easier to bend the base 212. Further, inserting the reinforcement member while the base 212 is still cooling down from the molding process, results in the plastic material of the base 212 constricting around the reinforcing member as the plastic material cools, further securing the reinforcing member to the base 212.

The size of the transport container 210 is selectively configurable to fit the size and shape of the one or more objects O the transport container 210 is carrying. In particular, a width of the transport container 210 (e.g., a distance between the first and second side walls 214, 216) is selectively adjustable to fit a dimension, such as the width, length or height, of the one or more objects O. In other words, at least one of the first and second side walls 214, 216 is movable relative to the other of the first and second side wall 214, 216 (and relative to the base 212) to change a distance (e.g., width) between the first and second side walls 214, 216 to conform or match the distance to a dimension (e.g., length) of the one or more objects O.

Figure 51:
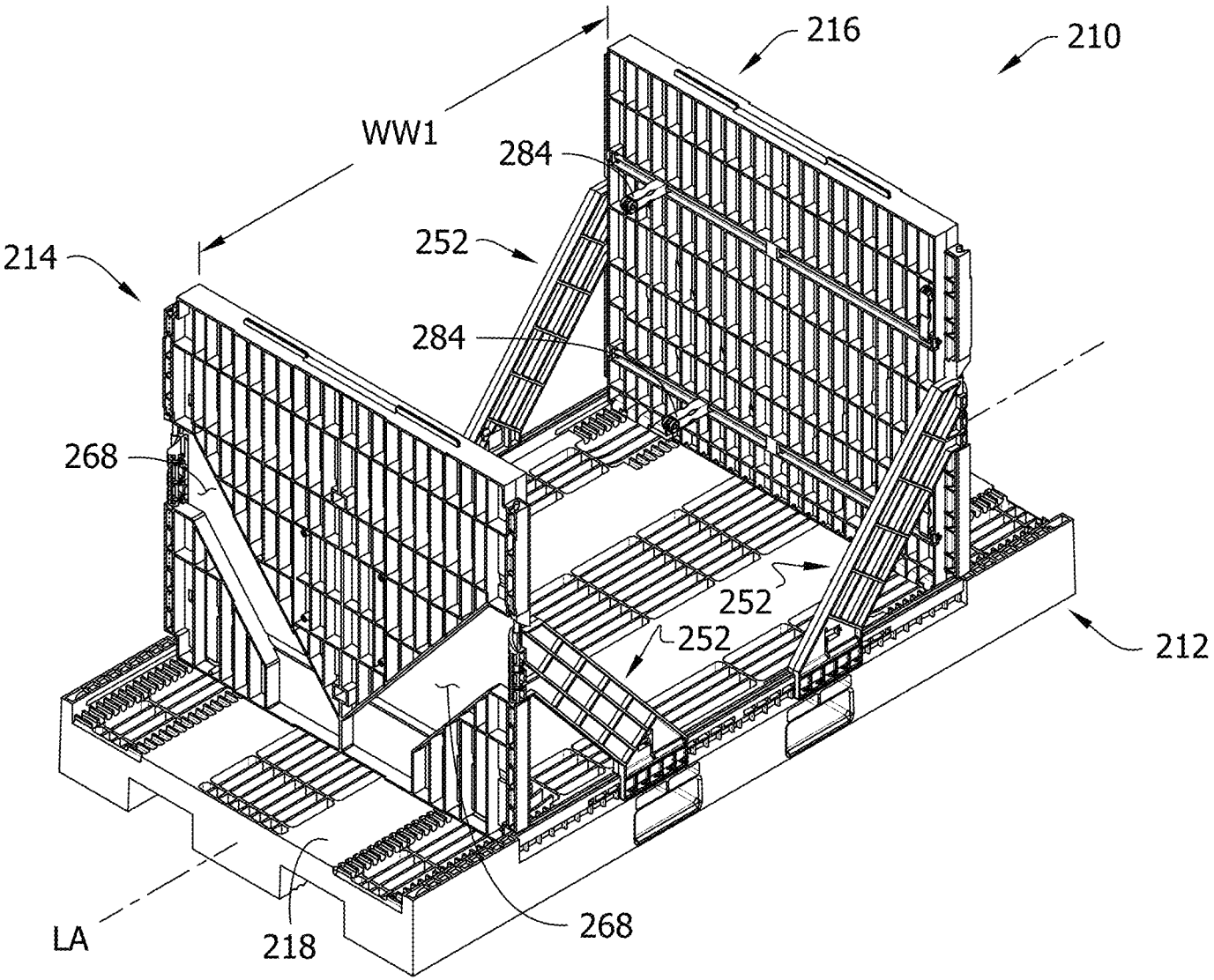
FIG. 51 is a front perspective view of the transport container shown in FIG. 49 with the side walls in a contracted position.

At least one of the first and second side walls 214, 216 may be moved between an extended position (generally shown in FIG. 49) and a contracted position (generally shown in FIG. 51). Broadly, the extended and contracted positions are different (e.g., first and second) longitudinal positions. The transport container 210 has a first width WW1 extending between the first and second side walls 214, 216 (shown in FIG. 51) when said at least one of the first and second side walls 214, 216 is in the contracted position and a second width WW2 (shown in FIG. 49) different than the first width WW1 when said at least one of the first and second side walls 214, 216 is in the extended position (e.g., first extended position). In the illustrated embodiment, the second width WW2 is greater than the first width WW1. In other embodiments or methods of use, the second width WW2 may be less than the first width WW1. At least one of the first and second side walls 214, 216 are selectively movable to a plurality of different longitudinal positions and, thus, other widths are possible. For example, the at least one of the first and second side walls 214, 216 is movable between a plurality of different positions (e.g., a plurality of longitudinal positions), such as a contracted position, a first extended position, a second extended position, a third extended position, a fourth extended position, etc., and thereby have a plurality of different widths (e.g., a first width, a second width, a third width, a fourth width, etc.). In this manner, the transport container 210 may be arranged to fit the size or dimension of a plurality of different objects O. Moreover, by arranging the transport container 210 to conform or fit the size of the objects O supported thereon, the transport container 210 may better protect and carry the objects.

In the illustrated embodiment, each of the first and second side walls 214, 216 are movable between the contracted position and extended position (broadly, a plurality of different positions). The first and second side walls 214, 216 are configured to move in opposite directions when moving between the different positions. For example, the first and second side walls 214, 216 move outward (e.g., away from the center of the base 212) along (e.g., parallel to) the longitudinal axis LA to increase the width of the transport container 210 (e.g., the distance between the first and second side walls 214, 216). In another example, the first and second side walls 214, 216 move inward (e.g., toward the center of the base 212) along (e.g., parallel to) to the longitudinal axis LA to decrease the width of the transport container 210. In some examples, the first and second side walls 214, 216 move outward toward the extended position (e.g., to the second width WW2) from the contracted position and move inward toward the contracted position (e.g., to the first width WW1) from the extended position. The first and second side walls 214, 216 are independently movable relative to each other. For example, the first side wall 214 can move between the extended and contracted positions while the second side wall 216 remains in place.

Figure 49:
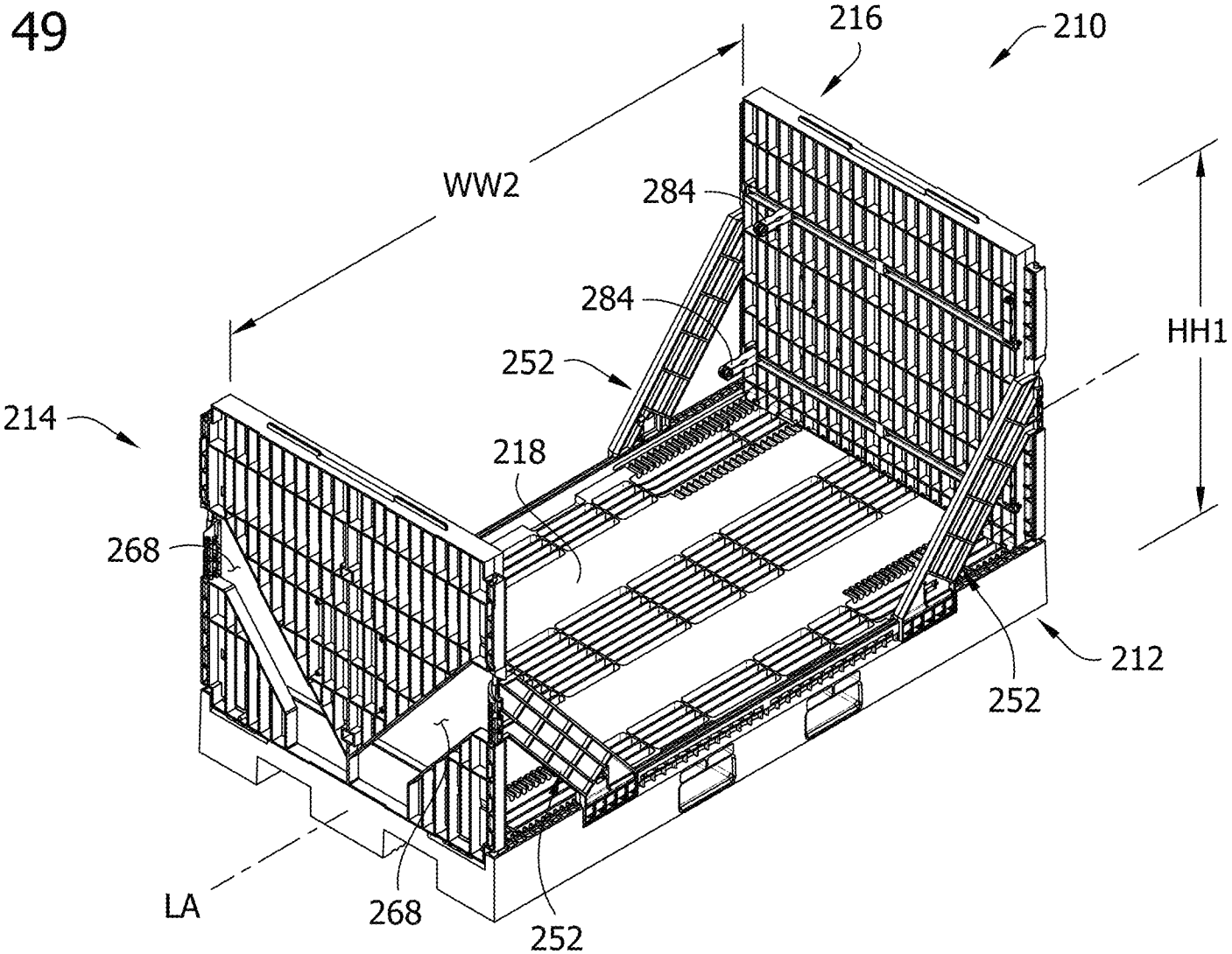
FIG. 49 is a front perspective view of another example transport container of the present disclosure, with side walls of the transport container in an extended position.
Figure 50:
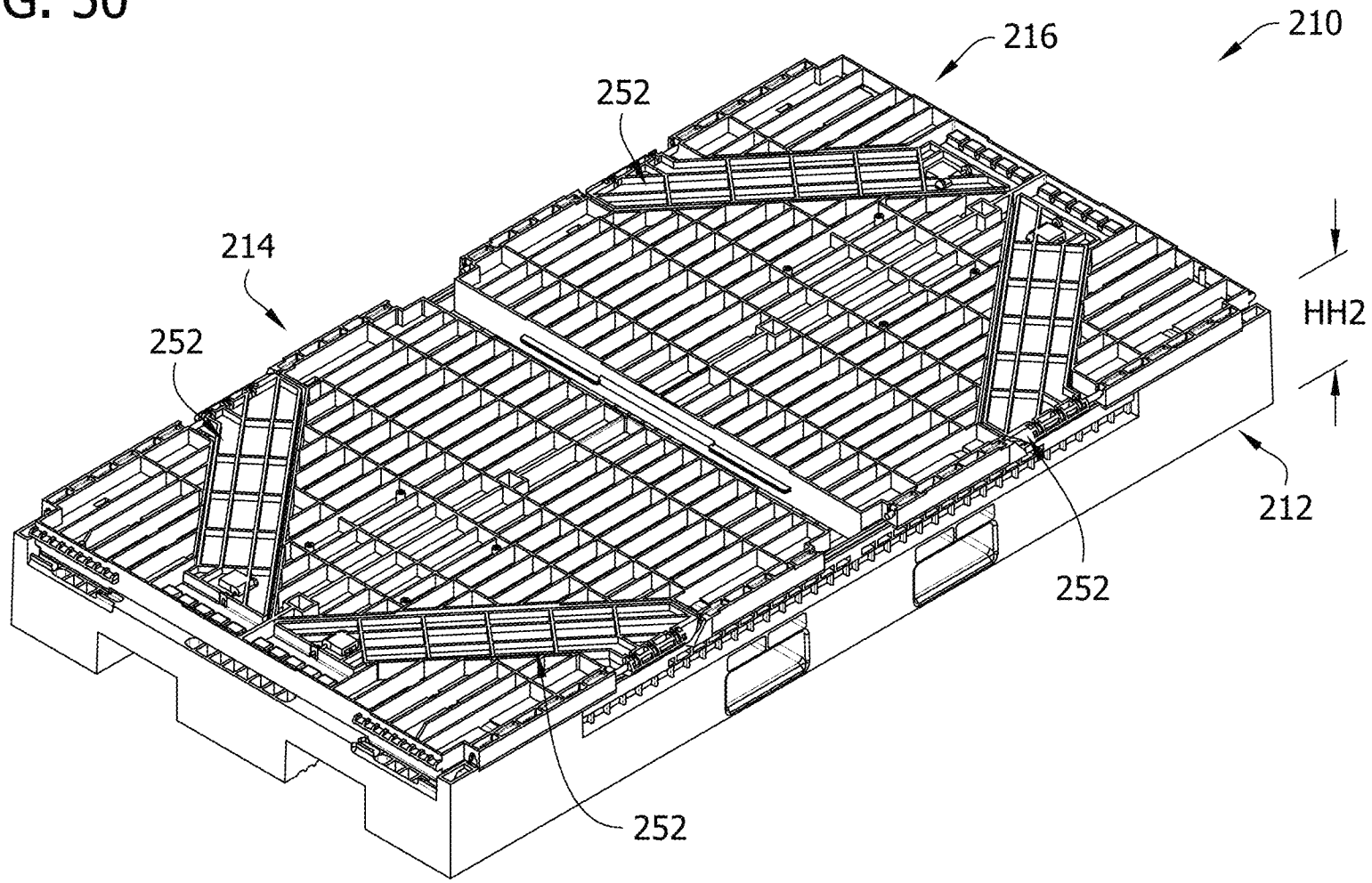
FIG. 50 is a front perspective view of the transport container shown in FIG. 49 with the first and second side walls in a collapsed configuration.

Referring to FIGS. 49-51, the first and second side walls 214, 216 are movable between a deployed position (FIGS. 49 and 51) and a collapsed position (FIG. 50). In this manner, the transport container 210 may be moved between a deployed configuration and a collapsed configuration. In the deployed position, the first and second side walls 214, 216 are arranged to receive the one or more objects O therebetween. The first and second side walls 214, 216 are generally upright when in the deployed position. For example, the first and second side walls 214, 216 may be moved to extend generally perpendicular to the base 212. In the collapsed position, the first and second side walls 214, 216 are arranged to reduce the overall size and shape of the transport container 210. The first and second side walls 214, 216 lay generally flat on the base 212 when in the collapsed position. For example, the first and second sidewalls 214, 216 may be moved to extend generally parallel to the base 212. The first and second side walls 214, 216 are independently movable between the deployed position and the collapsed position. In the illustrated embodiment, the first and second side walls 214, 216 are pivotably (e.g., rotatably) coupled to the base 212 for pivoting (e.g., rotating) between the deployed position and the collapsed position. For example, the first and second side walls 214, 216 may rotate toward the middle of the base 212 as the side walls 214, 216 move toward the collapsed position and may rotate away from the middle of the base as the side walls 214, 216 move toward the deployed position.

As is apparent, the transport container 210 has a first height HH1 (shown in FIG. 49) when the first and second side walls 214, 216 are in the deployed position and a second height HH2 (shown in FIG. 50) different than the first height HH1 when the first and second side walls 214, 216 are in the collapsed position. Specifically, the second height HH2 is less than the first height HH1. Placing the first and second side walls 214, 216 in the collapsed position makes it easier to transport the transport container 210 when the transport container 210 is empty (e.g., when no objects O are on the base 212) and to pack several transport containers 210 together and return them after the transport containers 210 have been used to deliver the one or more objects O.

Referring to FIGS. 49-57, in the illustrated embodiment, the first and second side walls 214, 216 are similar or generally identical (e.g., the first and second side walls 214, 216 are mirror images of each other). Accordingly, the first side wall 214 will be described in further detail herein with the understanding that the second side wall 216 has essentially a similar or the same construction. Thus, descriptions regarding the first side wall 214 also generally apply to the second side wall 216 as well. The first side wall 214 includes opposing upper and lower ends 226, 228, opposing front and rear sides 230, 232, and opposing interior and exterior faces or sides 234, 236. The interior side 234 faces the second side wall 216 when the first and second side walls 214, 216 are in the deployed positions. In the deployed position, the lower end 228 of the first side wall 214 abuts and is supported by the base 212. Referring to FIG. 50, in the collapsed position, the first side wall 214 extends in a generally horizontal direction. The first side wall 214 lies generally flat on the base 212 (e.g., overlies the base 212) in the collapsed position. The interior side 234 faces the upper surface 218 of the base 212. In some examples, the lower end 228 is generally aligned with the end 222 of the base 212 when the first side wall 214 is in the collapsed position. This arrangement forms a relatively wide platform (in combination with the second side wall 216) to support another transport container 210 in the collapsed position stacked thereon (not shown).

Figure 56:
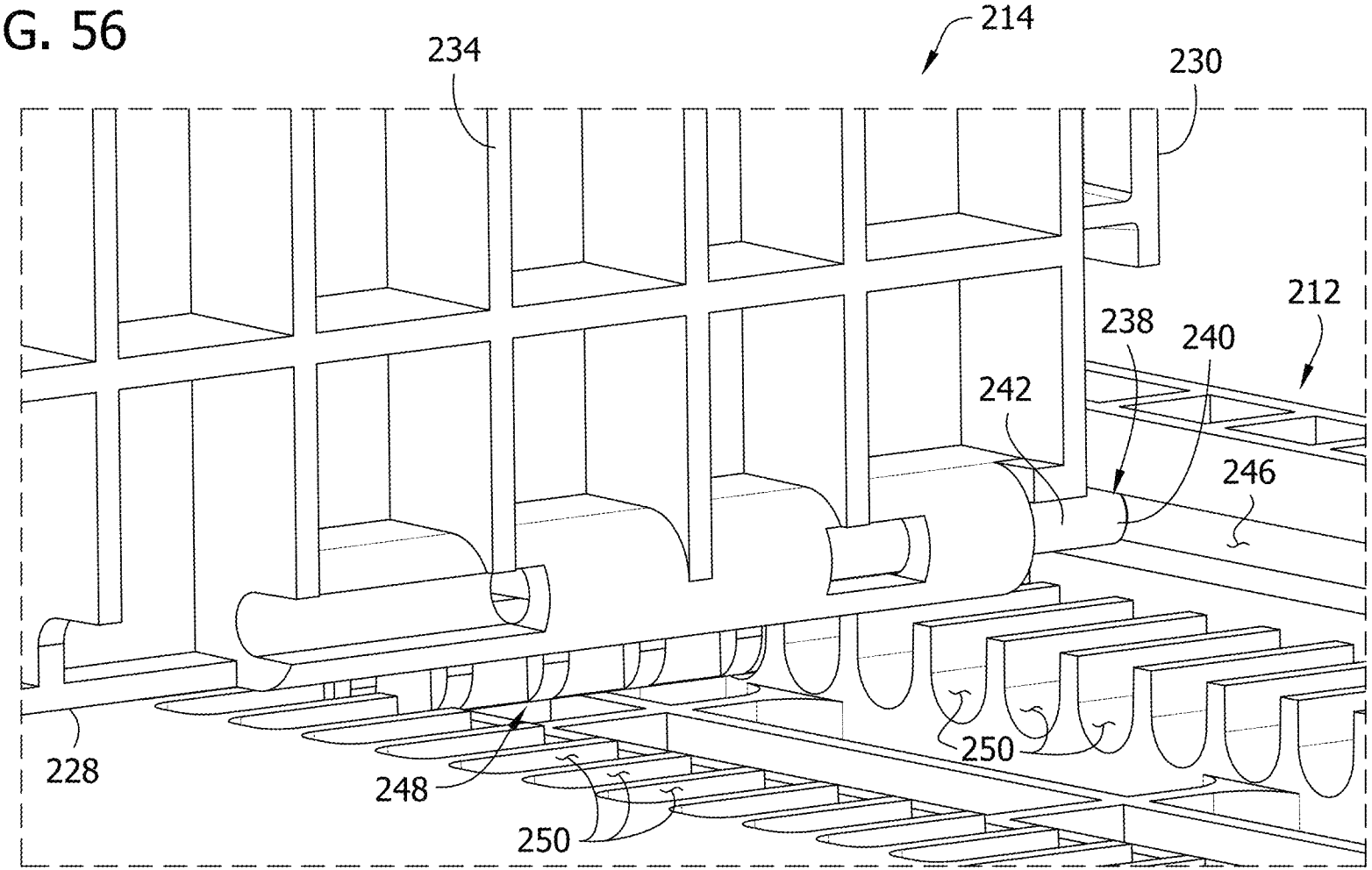
FIG. 56 is a detailed front side view showing the connection of the side wall to the base of the transport container shown in FIG. 49.
Figure 57:
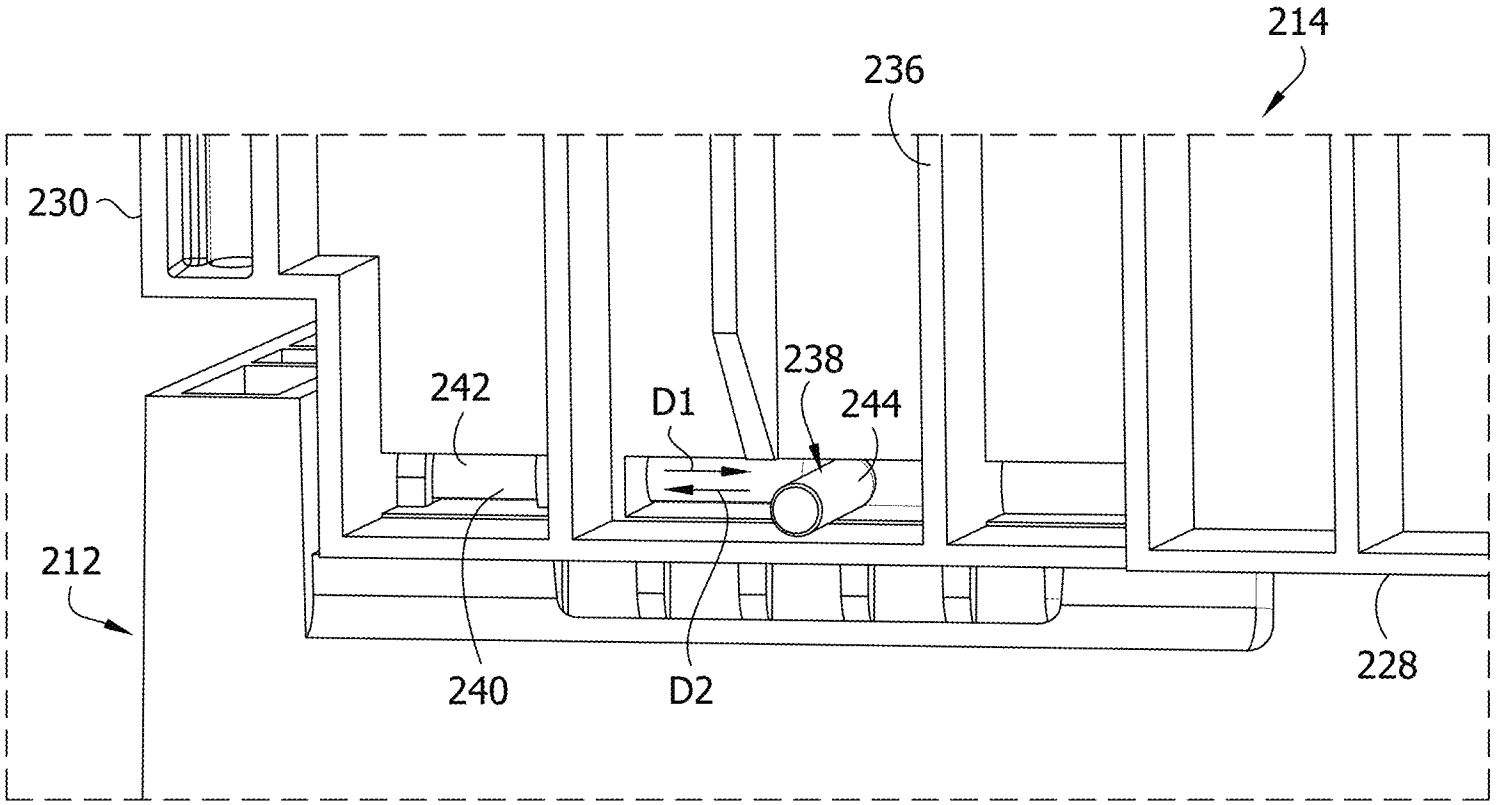
FIG. 57 is a detailed back side view showing the connection of the side wall to the base of the transport container shown in FIG. 49.

Referring to FIGS. 56 and 57, the first side wall 214 is releasably coupled to the base 212. The transport container 210 (e.g., the first side wall 214) may include at least one retainer 238 (e.g., at least one retainer 238 for each side wall 214, 216). For example, in the illustrated embodiment, the first side wall 214 includes two retainers 238. One retainer 238 is adjacent to the front side 230 and the other retainer 238 is adjacent to the rear side 232. The retainers 238 are generally identical (e.g., mirror images of each other). The at least one retainer 238 releasably couples the first side wall 214 to the base 212. Each retainer 238 is movable relative to the first side wall 214 and/or base 212 between a coupling position (shown in FIGS. 56 and 57) and a release position (not shown). In the coupling position, the retainer 238 couples the first side wall 214 to the base 212. For example, the retainer 238 may pivoatably (e.g., rotatably) couple the first side wall 214 to the base 212 when in coupling position. In this position, the retainer 238 generally engages the base 212. In the release position, the retainer 238 is arranged to permit or allow the first side wall 214 to decouple or move (e.g., freely move) from the base 212. For example, in this position, the retainer 238 may be disengaged from the base 212. This permits the first side wall 214 to be manually moved from the base 212, if desired. Accordingly, the at least one retainer 238 enables easy coupling and decoupling of the first side wall 214 to and from the base 212.

In the illustrated embodiment, each retainer 238 comprises a sliding rod or pin 240. The sliding pin 240 extends through one or more aligned openings in the first side wall 214. The sliding pin 240 may be manually moved within and/or through the aligned openings in the first side wall 214 to move the sliding pin 240 between the coupling position and the release position. In some examples, the sliding pin 240 has a generally L-shape with a long leg 242 and a short leg 244 extending from the long leg 242. The long leg 242 may extend through the aligned openings in the first side wall 214, and the short leg 244 may be manually engaged or manipulated by a user. In the illustrated embodiment, the base 212 defines at least one channel 246 therein. For example, a channel 246 may be defined along each side of the base 212. The channels 246 face inwardly (e.g., are open toward each other) and are generally parallel to the longitudinal axis LA. When the sliding pin 240 is in the coupling position, the long leg 242 of the sliding pin 240 is disposed in or extended through one of the channels 246, thereby coupling the first side wall 214 to the base 212. In some examples, the long leg 242 of the sliding pin 240 is permitted to pivot or rotate within the channel 246 such that the first side wall 214 is rotatably coupled to the base 212. The first side wall 214 may pivot about the long leg 242 of the sliding pin 240, for example, to move between the deployed and collapsed position. The channels 246 may permit the sliding pin 240 to longitudinally move therein while the first side wall 214 is moved to different longitudinal positions (e.g., the extended position, the retracted position, etc.). Thus, the retainers 238 may releasably and rotatably couple the first side wall 214 to the base 212 while permitting the first side wall 214 to move between the different longitudinal positions while coupled to the base 212. To move the retainer 238 toward the release position, a user may push or pull the short leg 244 to move the sliding pin 240 in the direction D1 (shown in FIG. 57). To move the retainer 238 toward the coupling position, the user may push or pull the short leg 244 to move the sliding pin 240 in the direction D2 (shown in FIG. 57). Other configurations of the retainers 238 are within the scope of the present disclosure.

Figure 52:
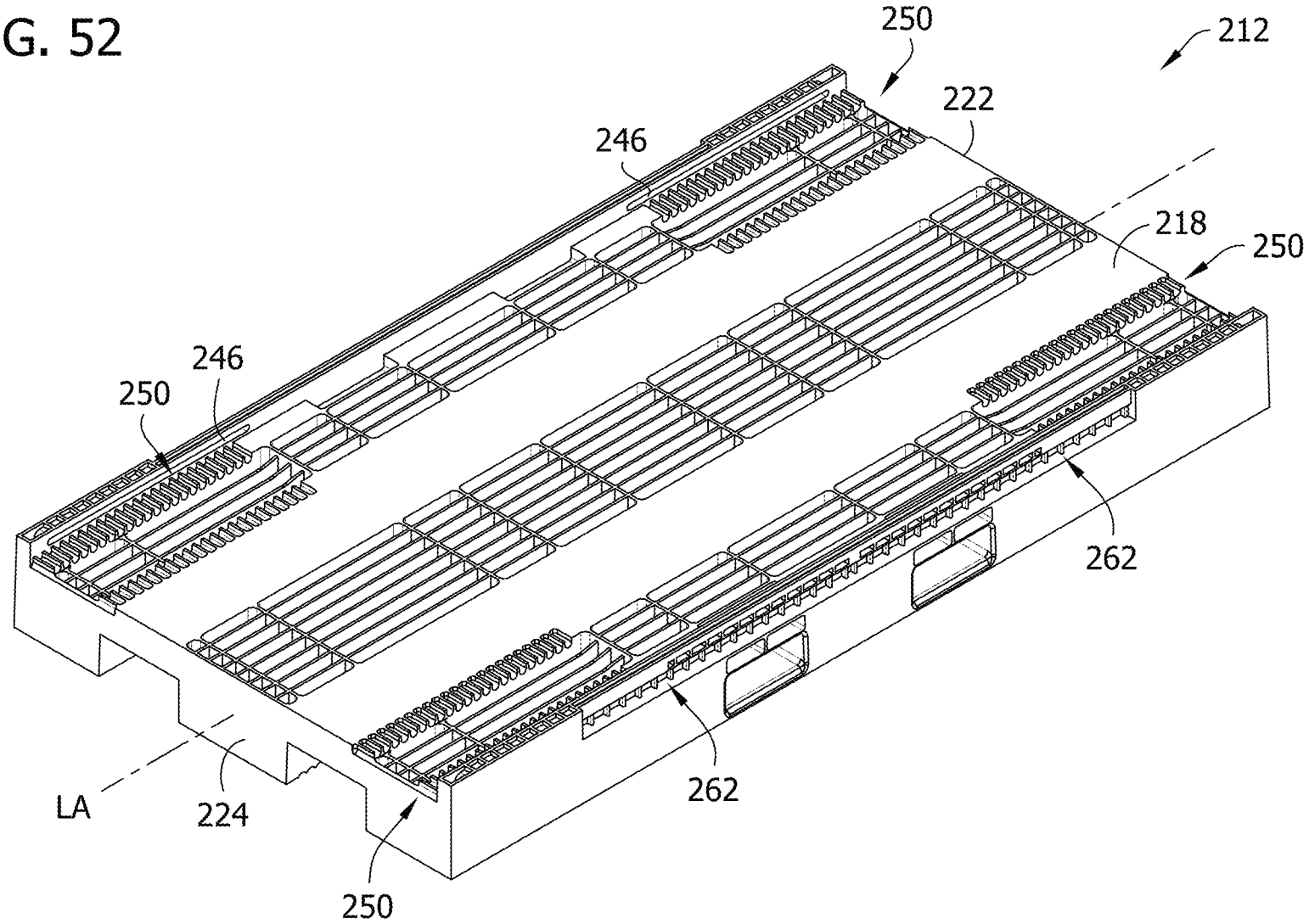
FIG. 52 is an upper perspective view of a base of the transport container shown in FIG. 49.
Figure 55:
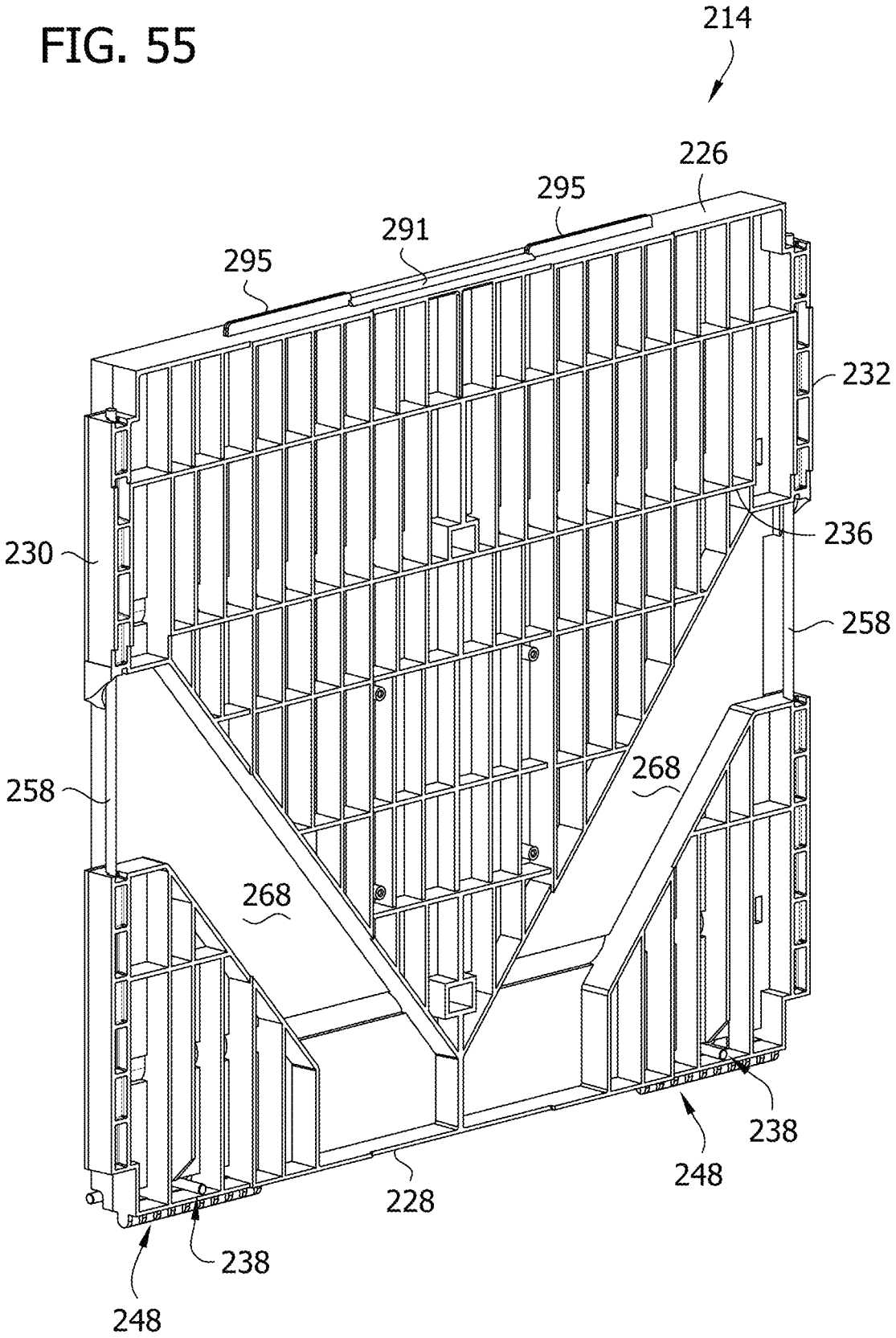
FIG. 55 is a back side perspective view of one of the side walls of the transport container shown in FIG. 49.

Referring to FIGS. 52, 55, and 56, the first side wall 214 is movable (e.g., configured to move) at discrete increments between the extended position and the contracted position. In other words, the first side wall 214 may be moved to one or more discrete longitudinal positions relative to (e.g., on) the base 212. As shown in FIGS. 55 and 56, the first side wall 214 includes at least one locator 248 configured to engage the base 212 when the first side wall 214 is at one of the discrete longitudinal positions. In the illustrated embodiment, the first side wall 214 includes two locators 248, one adjacent the front side 230 and one adjacent the rear side 232. Each locator 248 extends downward from the lower end 228 of the first side wall 214. The base 212 includes (e.g., defines) a plurality of locator recesses 250 defining the discrete longitudinal positions. Each locator recess 250 defines one discrete longitudinal position. Each locator recess 250 is sized and shaped to receive the locator 248 to position the first side wall 214 at the discrete longitudinal position defined by the locator recess 250 (when the first side wall 214 is in the deployed position). Each locator recess 250 extends generally downward from the upper surface 218 of the base 212. The locator recesses 250 are spaced apart longitudinally along the base 212 at the discrete increments. In one embodiment, the locator recesses 250 may be spaced apart by discrete increments of about 2 inches (5 cm), although other sizes are within the scope of the present disclosure. In the illustrated embodiment, the base 212 includes two sets of locator recesses 250, one set for each locator 248 of the first side wall 214. Similar to the two locators 248, the one set of locator recesses 250 is adjacent the front side of the base 212 and the other set of locator recesses 250 is adjacent to the rear side of the base 212. The sets of locator recesses 250 are adjacent the first end 222 of the base 212 and extend longitudinally inward therefrom. In some examples, the locators 248 are disposed longitudinally outward of the retainers 238 (e.g., long leg 242), as shown in FIG. 55, so that as the first side wall 214 is rotated toward the deployed position, the locators 248 move into the desired locator recesses 250 and as the first side wall 214 is rotated toward the collapsed position, the locators 248 move out of the corresponding locator recesses 250.

Referring to FIGS. 49-51 and 61-64, the transport container 210 includes at least one brace 252 configured to secure the first side wall 214 in the deployed position. In the illustrated embodiment, the transport container 210 includes two braces 252 for securing the first side wall 214 in the deployed position. The two braces 252 are similar or generally identical (e.g., the braces 252 are mirror images of each other). Accordingly, the one brace 252 will be described in further detail herein with the understanding that the other brace 252 has essentially a similar or the same construction. Thus, descriptions regarding one brace 252 also generally apply to the other brace 252 as well. The brace 252 is elongate and includes opposing first (e.g., wall) and second (e.g., base) end portions 254, 256. The wall end portion 254 is coupled to the first side wall 214. In particular, the wall end portion 254 of the brace 252 is movably (e.g., rotatably) coupled the first side wall 214. The wall end portion 254 of the brace 252 defines a shaft opening through which a shaft 258 (shown in FIG. 64) of the first side wall 214 extends to rotatably couple the brace 252 to the first side wall 214. This movement allows the brace 252 to move between a bracing position (shown in FIGS. 49 and 51) and a stowed position (shown in FIG. 50). In addition, because the brace 252 is coupled to the first side wall 214, the brace 252 moves with the first side wall 214 as the first side wall 214 moves between the extended position and the contracted position.

In the bracing position, the brace 252 secures the first side wall 214 in the deployed position. In other words, the first side wall 214 is restricted from moving between the collapsed position and the deployed position. Specifically, the brace 252 engages the base 212 in the bracing position to secure the first side wall 214 in the deployed position. The base end portion 256 is configured to be releasably attached to the base 212. The base end portion 256 includes at least one brace interconnection member 260 configured to mate and connect with at least one base interconnection member 262 (shown in FIG. 52) of the base 212, or at least a portion thereof. The engagement and mating between the brace interconnection member 260 and the base interconnection member 262 inhibits movement of the brace 252, and by extension the first side wall 214, relative to the base 212. Specifically, the interconnection of the brace 252 and base interconnection members 260, 262 inhibits longitudinal movement and rotational movement about an axis (not shown) generally perpendicular to the longitudinal axis LA and generally parallel to the upper surface 218 of the brace 252 and the first side wall 214. As a result, the brace 252 generally braces, strengthens and stiffens the first side wall 214 when the first side wall 214 is in the deployed position.

In the illustrated embodiment, the brace interconnection member 260 includes a plurality of plurality of projections or fingers 264. The fingers 264 are spaced apart from each other. The base interconnection member 262 is disposed on and extends longitudinally along a side (e.g., a front side, a rear side) of the base 212. It is understood the base 212 includes at least one base interconnection member 262 on the front side and the rear side of the base 212 for engaging two braces 252, respectively, bracing the first side wall 214. The base interconnection member 262 defines a plurality of recesses 266. Each recess 266 is sized and shaped to correspond to and receive one of the fingers 264 of the brace 252, thereby inhibiting movement between the brace 252 (and the first side wall 214) and the base 212. The recesses 266 of the base interconnection member 262 are arranged longitudinally, in a linear manner along the side of the base 212. The recesses 266 are arranged to correspond to the discrete positions the base 212 defines for the first side wall 214 so that regardless of what longitudinal position the first side wall 214 is in (e.g., extended position, contracted position, etc.), at least a portion of the recesses 266 are arranged to receive the fingers 264 of the brace 252. Accordingly, regardless of what discrete longitudinal position the first side wall 214 is in, the brace interconnection member 260 of the brace 252 may be interconnected with at least a portion of the base interconnection member 262 of the base 212 to secure the first side wall 214 in the deployed position.

In the bracing position, the brace 252 extends a side (e.g., front side 230) of the first side wall 214 to a side (e.g., a front side) of the base 212. As illustrated in FIGS. 49 and 51, the brace 252 extends over the open front or rear side of the transport container 210. Thus, the brace 252 may also act as an object support and is configured to inhibit the one or more objects O from moving in at least one of a rearward direction or a forward direction. In other words, the brace 252 is configured to brace the one or more objects O to keep the objects O on the transport container 210. The rearward and forward directions are generally opposite of one another and generally perpendicular to the longitudinal axis LA. The brace 252 may provide lateral support (e.g., support generally perpendicular to the longitudinal axis LA) to the one or more objects O on the transport container 210. For example, by extending over the open front side of the transport container 210, the brace 252 may generally inhibit the one or more objects O from moving in the forward direction.

In the stowed position (as shown in FIG. 50), the brace 252 does not secure the first side wall 214 in the deployed position. Accordingly, when the brace 252 is in the stowed position, the first side wall 214 is free to move between the collapsed position and the deployed position. In the stowed position, the brace 252 may not engage the base 212 and be in a stored arrangement. In the illustrated embodiment, the first side wall 214 defines a brace recess 268 (shown in FIG. 55). The brace recess 268 is sized and shaped to receive the brace 252 when the brace 252 is in the stowed position. In other words, in the stowed position, the brace 252 is disposed in the brace recess 268. The brace recess 268 is disposed on the exterior side 236 of the first side wall 214. The first side wall 214 may be configured to hold the brace 252 in the stowed position. For example, the first side wall 214 may form an interference fit with the brace 252 (at least a portion thereof) to hold the first side wall 214 in the stowed position.

Figure 62:
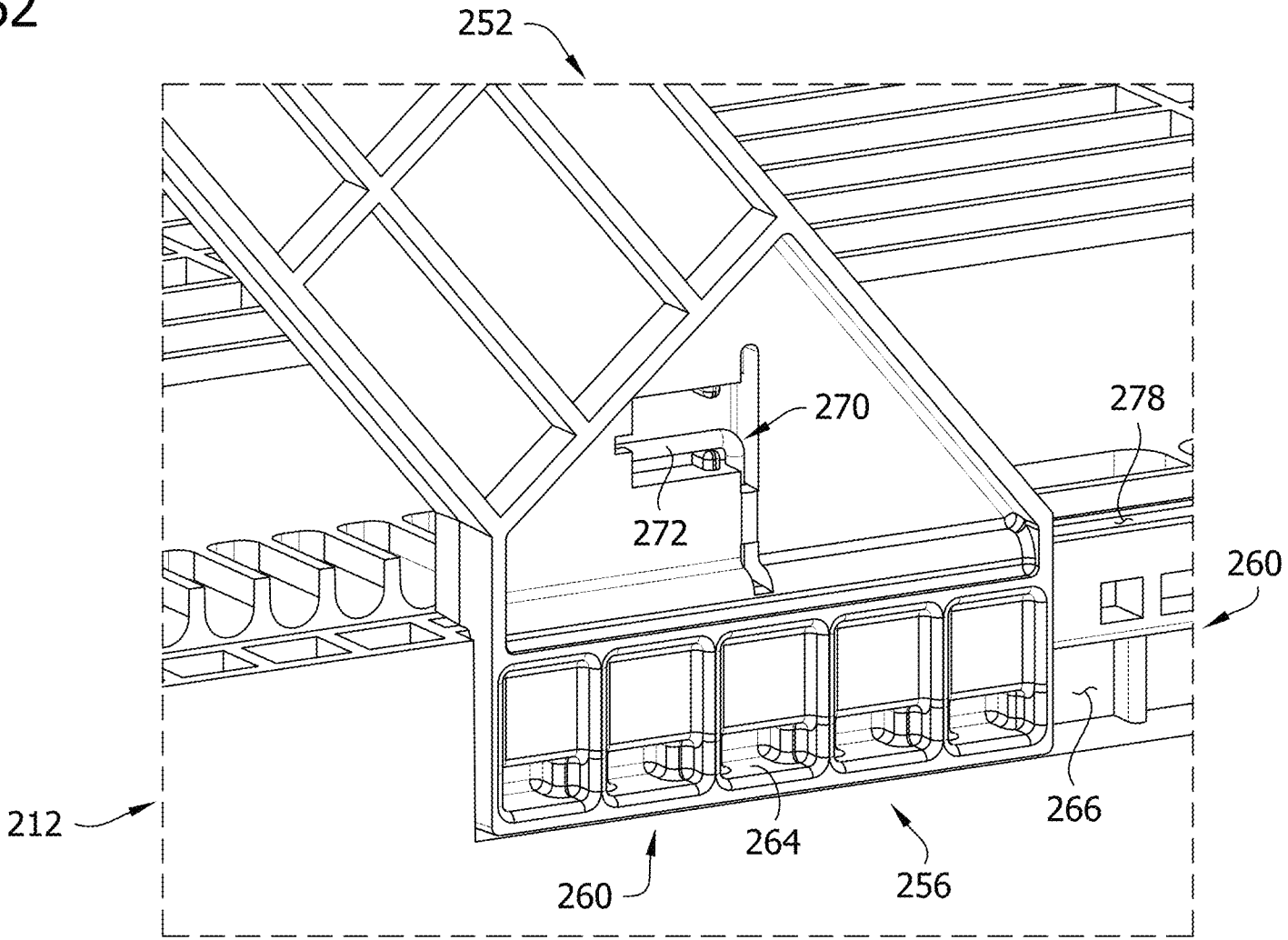
FIG. 62 is a detailed perspective view showing the engagement of the wall brace with the base of the transport container shown in FIG. 49.
Figure 63:
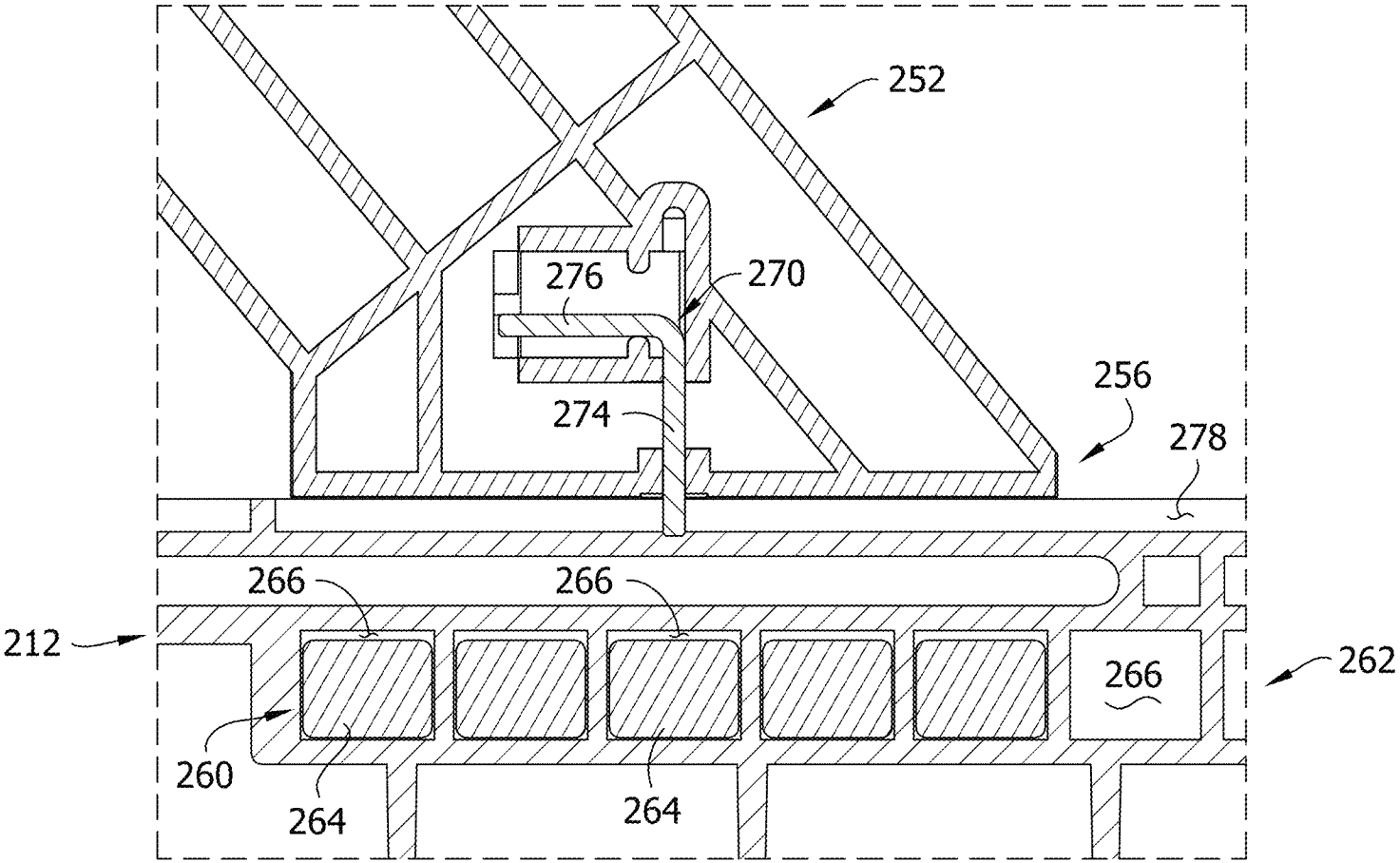
FIG. 63 is a detailed cross-sectional view of the engagement of the wall brace with the base of the transport container shown in FIG. 49.

The brace 252 rotates between the stowed position and the bracing position about the shaft 258 of the first side wall 214. Referring to FIGS. 62 and 63, the brace 252 includes a brace retainer 270 configured to secure the brace 252 in the bracing position. For example, the brace retainer 270 may inhibit the brace 252 from moving or rotating about the shaft 258 between the stowed position and the bracing position (e.g., inhibit the unintentional disconnection of the brace and base interconnection members 260, 262).

In the illustrated embodiment, the brace retainer 270 comprises a sliding rod or pin 272. The sliding pin 272 extends through one or more aligned openings in the brace 252. The sliding pin 272 may be manually moved within and/or through the aligned openings in the brace 252 to move the sliding pin 272 between the coupling position and the release position. In some examples, the sliding pin 272 has a generally L-shape with a long leg 274 and a short leg 276 extending from the long leg 274. The long leg 274 may extend through the aligned openings in the brace 252, and the short leg 276 may be manually engaged or manipulated by a user. In the illustrated embodiment, the base 212 defines at least one channel 278 therein. For example, a channel 278 may be defined along each side of the base 212. The channel 278 faces upwardly and is generally parallel to the longitudinal axis LA. When the sliding pin 272 is in a coupling position (shown in FIGS. 62 and 63), the long leg 274 of the sliding pin 272 is disposed in or extended through one of the channels 278, thereby securing the brace 252 in the bracing position (e.g., inhibiting rotation of the brace 252 about the shaft 258). Since the channel 278 is elongate and extends parallel to the longitudinal axis LA, the sliding pin 272 may be inserted into the channel 278 to secure the brace 252 in the bracing position, regardless of the longitudinal position of the brace 252 (e.g., regardless of the longitudinal position of the first side wall 214). To move the brace retainer 270 toward the coupling position, the user moves the brace retainer 270 downward to move the sliding pin 272 into the channel 278. To move the brace retainer 270 toward a release position (not shown), a user moves the brace retainer 270 upward to move the sliding pin 272 out of the channel 278. Other configurations of the brace retainer are within the scope of the present disclosure. In the illustrated embodiment, the base 212 includes one continuous channel 278 on each side for receiving the brace retainers 270 of the braces 252 supporting the first and second side walls 214, 216.

Figure 64:
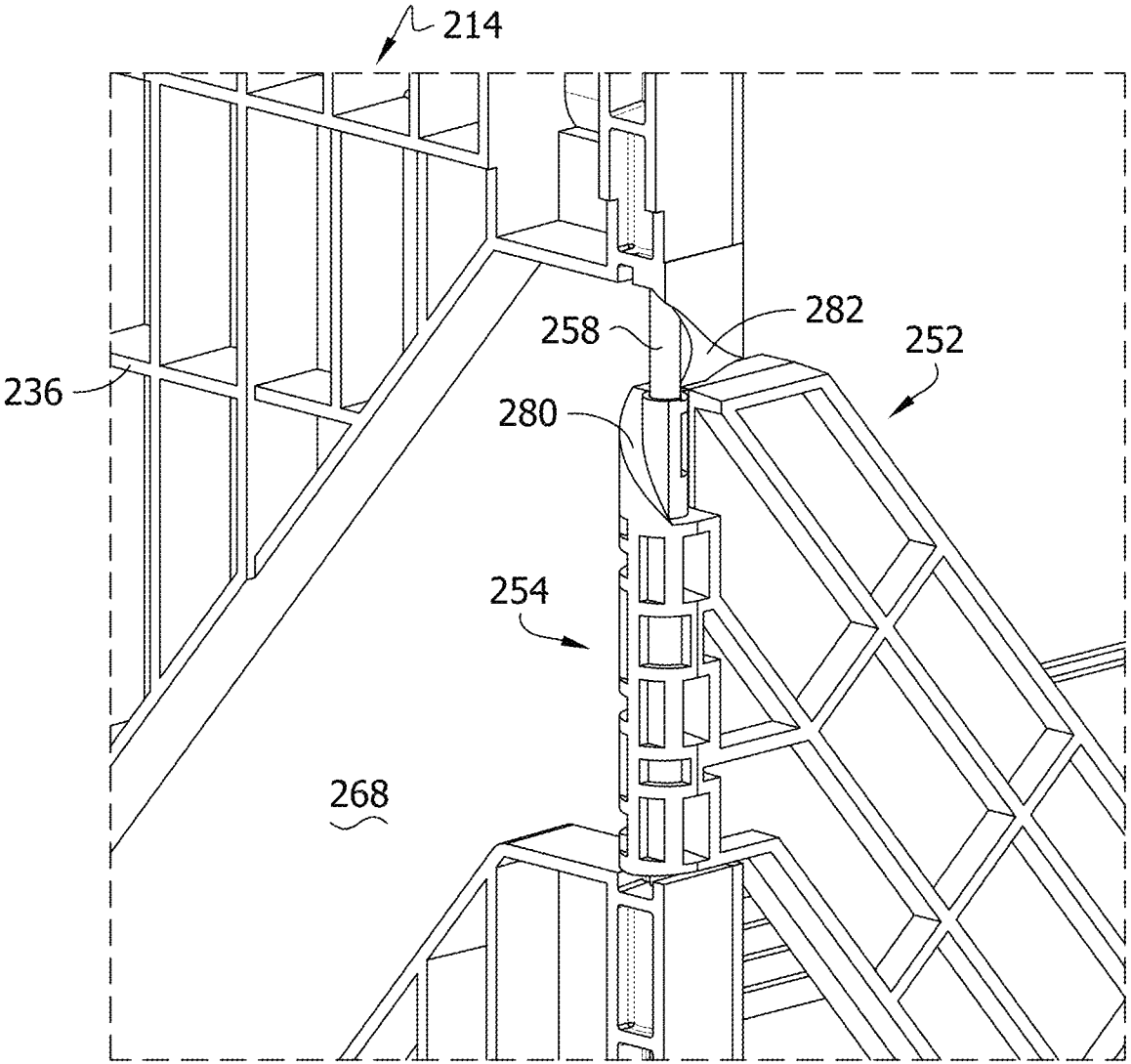
FIG. 64 is a detailed perspective view of the wall brace attached to the side wall of the transport container shown in FIG. 49.

The brace 252 is configured to slide along the shaft 258 of the first side wall 214 as the brace moves between the bracing position and the stowed position. Generally, the brace 252 moves downward along the shaft 258 to position the brace 252 to engage the base 212 (e.g., to vertically align the brace interconnection member 260 with the base interconnection member 262). By sliding the brace 252 along the shaft 258, the brace 252 is able to be disposed within the first side wall 214 when the brace 252 is in the stowed position, providing a more compact configuration. Referring to FIG. 64, the brace 252 and the first side wall 214 include corresponding helical surfaces or ramps 280 and 282, respectively. The helical ramps 280, 282 extend around the shaft 258. The helical ramps 280, 282 of the respective brace 252 and the first side wall 214 may engage each other as the brace 252 is rotated between the stowed position and the bracing position to facilitate rotation of the brace 252 about the shaft 258 and/or to facilitate the sliding of the brace 252 along the shaft 258 to vertically position the brace 252 to engage the base 212 (e.g., to vertically align the brace interconnection member 260 with the base interconnection member 262). In the illustrated embodiment, the helical ramp 280 of the brace 252 is disposed toward the upper end of the opening in the brace 252 through which the shaft 258 extends, with the helical ramp 282 of the first side wall 214 arranged accordingly. In another embodiment, in addition to or instead of the helical ramp 280 of the brace 252, the brace 252 may include a helical ramp (similar to helical ramp 280) toward the lower end of the opening in the brace 252 through which the shaft 258 extends, with the first side wall 214 including a helical ramp 280 arranged accordingly. Other configurations are within the scope of the present disclosure. For example, in some embodiments the transport container 210 may not include helical ramps 280.

Having described the features and elements of one brace 252, it is appreciated that the other braces 252 of the transport container 210 includes these same features and elements, as indicated in the drawings.

Referring to FIGS. 54 and 58-60, transport container 210 may include one or more adjustable object supports 284. The adjustable object support 284 provides lateral support to the one or more objects O on the transport container 210. The first side wall 214 may include adjustable object supports 284 adjacent the upper end 226 and adjacent the lower end 228. In the illustrated embodiment, the first side wall 214 includes two object supports 284 adjacent the upper end 226 and two object supports 284 adjacent the lower end 228. More or fewer and/or other arrangements of the object supports 284 are within the scope of the present disclosure. By including adjustable object supports 184 adjacent the upper and lower ends 226, 228, the upper and/or lower portions of the one or more objects O may be supported. Each adjustable object support 284 is selectively movable in the rearward direction and/or the forward direction. By moving the adjustable object support 284 in the rearward direction or the forward direction, the adjustable object support 284 (in conjunction with the brace 252) may be used to brace the one or more objects O when the one or more objects O do not extend over the entire depth of the transport container 210 (e.g., when the one or more objects O do not extend the full distance between the front and rear braces 252). For example, the adjustable object support 284 may be used to brace the one or more objects O when the transport container 210 is only partially loaded or when the one or more objects O do not extend the entire distance between the front and rear braces 252. The adjustable object support 284 may be adjusted or moved to generally brace the one or more objects O in either the forward or rearward direction. For example, the adjustable object support 284 may sandwich the one or more objects O between itself and the brace 252. In another example, two adjustable object support 284 may sandwich the one or more objects O between themselves.

Figure 58:
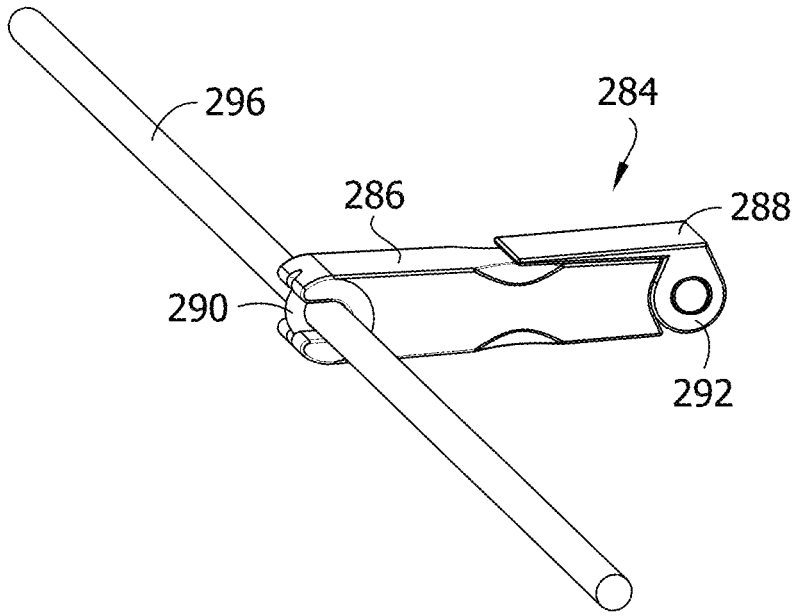
FIG. 58 is a perspective view of an object support of the transport container shown in FIG. 49, the object support in a locked configuration.
Figure 59:
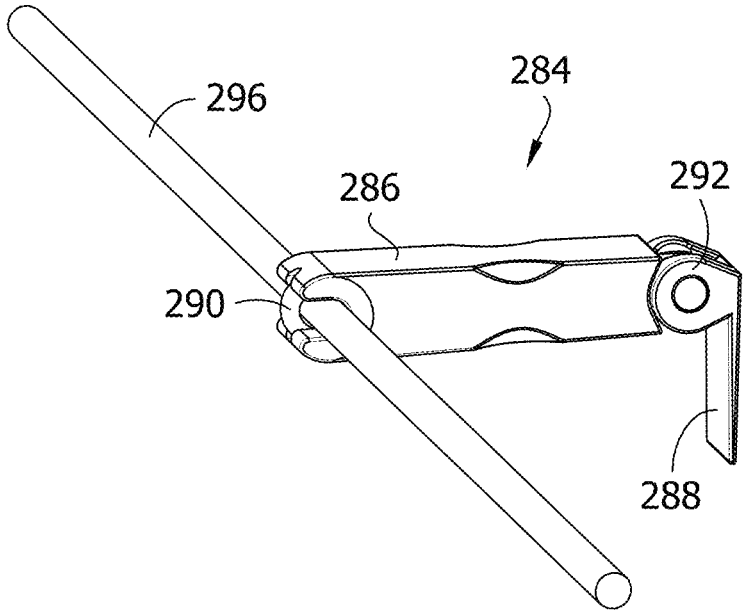
FIG. 59 is a perspective view of the object support of the transport container shown in FIG. 49, the object support in a release configuration.
Figure 60:
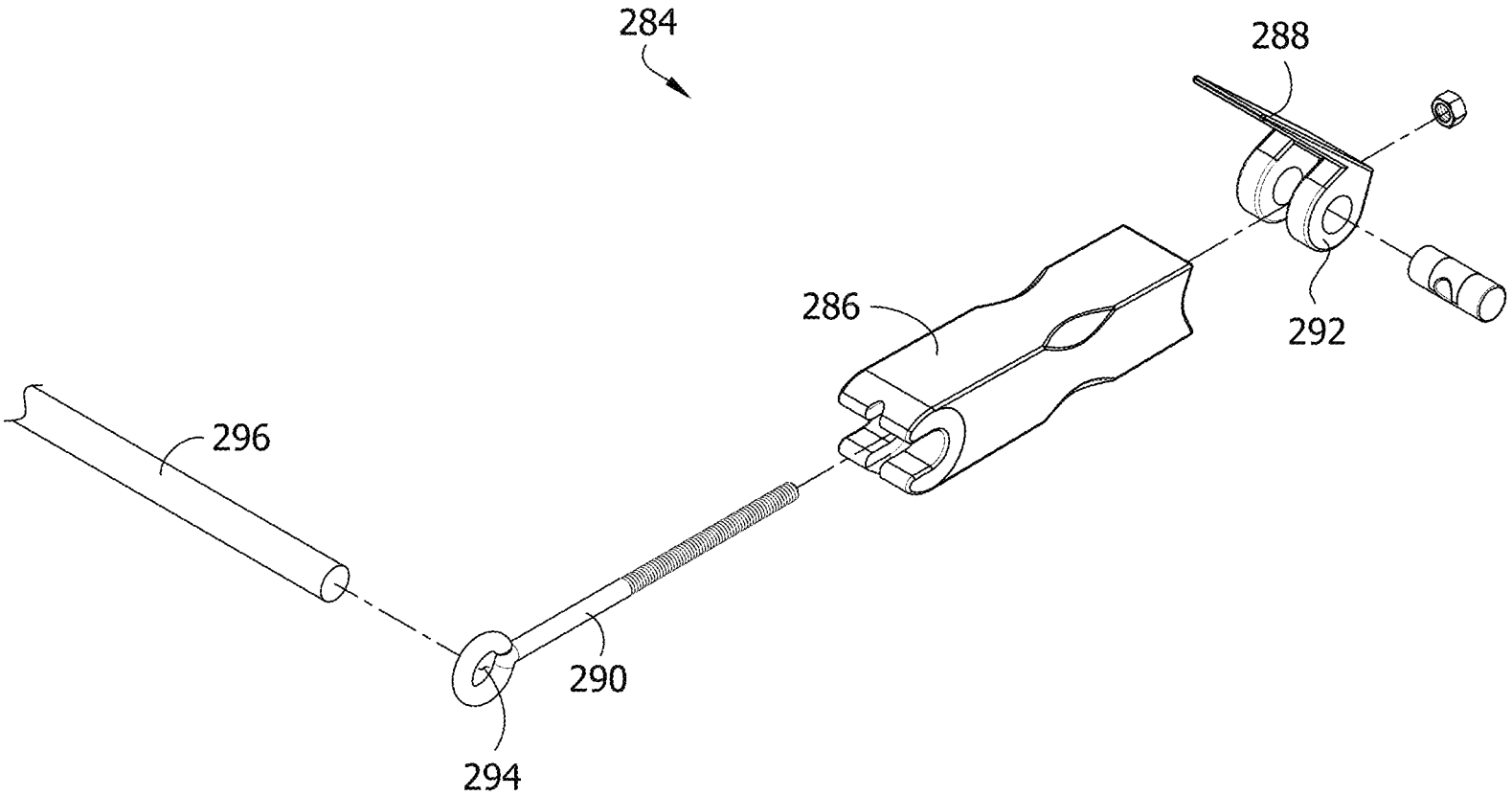
FIG. 60 is an exploded view of the object support of the transport container shown in FIG. 49.
Figure 61:
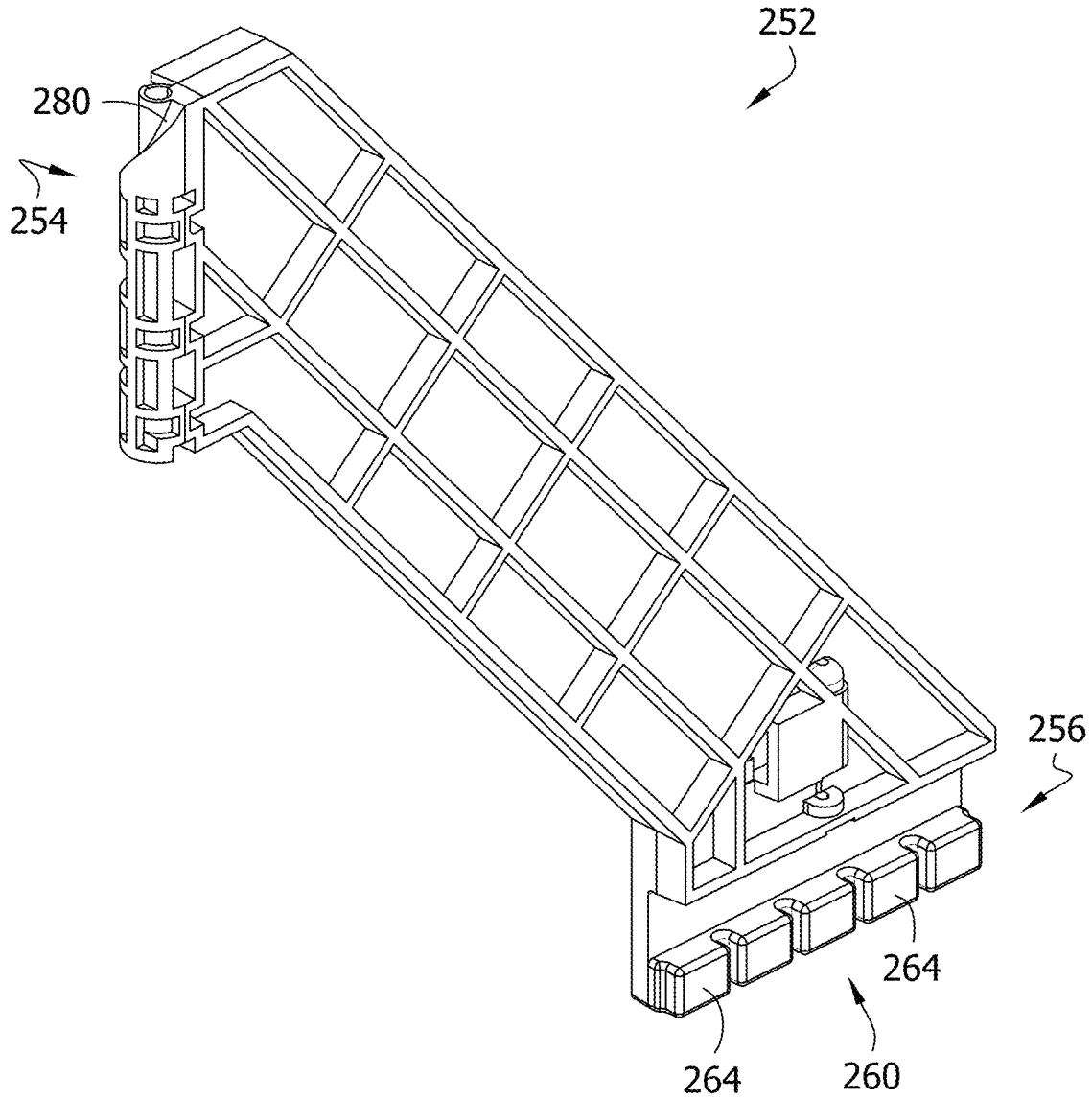
FIG. 61 is a perspective view of a wall brace of the transport container shown in FIG. 49.

Referring to FIGS. 58-60, the adjustable object support 284 includes a brace or arm 286, a lever 288 and a locking member 290. The lever 288 is rotatably connected to the arm 286 and includes a cam or eccentric base 292. The lever 288 is also connected (e.g., operatively connected) to the locking member 290. In the illustrated embodiment, the locking member 290 comprises an eye bolt defining a rod opening 294 through which a rod or shaft 296 of first side wall 214 extends, coupling the adjustable object support 284 to first side wall 214. The lever 288 is disposed at a first end of the arm 286 with the rod opening 294 disposed at the opposing second end of the arm 286, a shaft of the eye bolt extending through the arm 286 from the rod opening 294 to the lever 288. The locking member 290 is movable relative to the arm 286.

The lever 288 and locking member 290 are movable (e.g., rotatable) between a locked position (shown in FIG. 58) and an unlocked position (shown in FIG. 59). In the locked position, the locking member 290 clamps the shaft 296 against the arm 286, thereby preventing the adjustable object support 284 from moving relative to the shaft 296. Specifically, a portion of the locking member 290 defining the rod opening 294 clamps the shaft 296 against a portion of the arm 286. In the unlocked position, the locking member 290 does not inhibit the movement (e.g., longitudinal movement, rotational movement) of the adjustable object support 284 relative to the shaft 296. That is in the unlocked position, the adjustable object support 284 is free to move relative to the shaft 296 of the first side wall 214. Specifically, the portion of the locking member 290 defining the rod opening 294 is arranged to provide the necessary clearance to permit the shaft 296 to move freely within the rod opening 294. The eccentric base 292 of the lever 288 includes an articulating surface that engages an articulating surface of the arm 286. As the eccentric base 292 of the lever 288 is rotated relative to the arm 286 between the locked and unlocked positions, the eccentricity of the eccentric base 292 moves the locking member 290 relative to the arm 286. Specifically, as the lever 288 is rotated to the locked position, the lever 288 moves the locking member 290 (e.g., the portion defining the rod opening 294) toward the first end of the arm 286 to clamp the shaft 296 to the arm 286. Similarly, as the lever 288 is rotated to the unlocked position, the lever 288 moves the locking member 290 away from the first end of the arm 286, to release the shaft 296.

Figure 54:
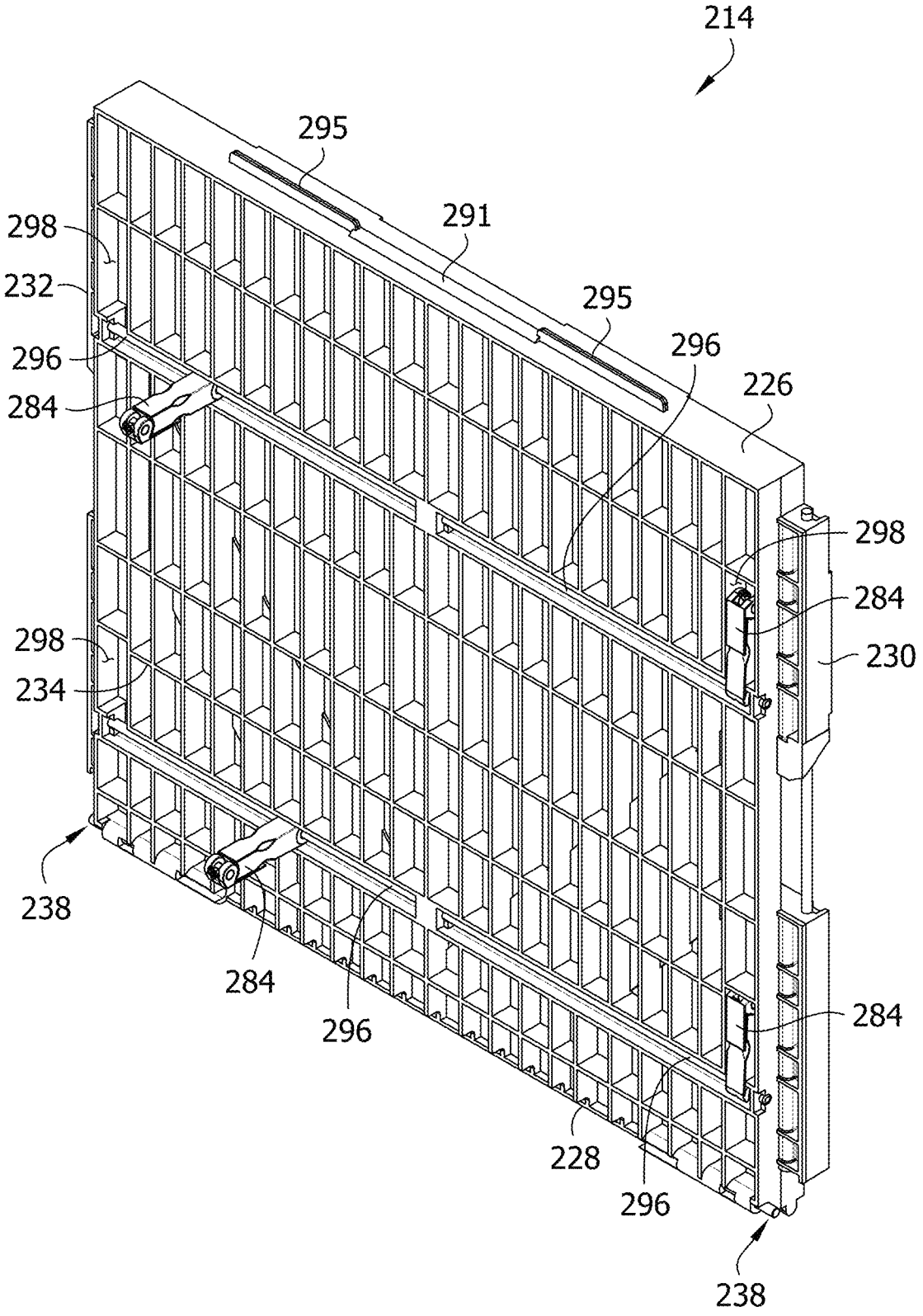
FIG. 54 is a front side perspective view of one of the side walls of the transport container shown in FIG. 49.

As shown in FIG. 54, the adjustable object support 284 is movable (e.g., rotatable and/or translatable along the shaft 296) relative to the shaft 296 between a stowed position and a support position. In the stowed position, the adjustable object support 284 is located such that the support 284 is out of the way and does not brace the one or more objects O. In the illustrated embodiment, the first side wall 214 (e.g., the interior side 234) defines one or more adjustable support recesses 298. In the illustrated embodiment, the first side wall 214 defines four adjustable support recesses 298, one for each adjustable object support 284. Each adjustable support recess 298 is sized and shaped to receive the adjustable object support 284 (e.g., a portion thereof). In the stowed position, the adjustable object support 284 (e.g., the arm 286) extends in a generally vertical direction (e.g., generally parallel to the first side wall 214). In the support portion, the adjustable object support 284 is located to brace the one or more objects O in the forward and/or rearward direction. In the support position, the adjustable object support 284 (e.g., the arm 286) extends in a generally horizontal direction (e.g., generally parallel to the longitudinal axis LA and generally perpendicular to the first side wall 214). In the support position, the adjustable object support 284 extends inwardly to engage the one or more objects O. To move the adjustable object support 284 between the stowed and support positions or between different support positions, the lever 288 is moved to the unlocked position permitting the adjustable object support 284 to be rotated about the shaft 296 and moved along the shaft 296. One the adjustable object support 284 is in the desired position (e.g., stowed or support position), the lever 288 is moved to the locked position, thereby securing the adjustable object support 284 in the desired position. Thus, the adjustable object support 284 is selectively movable to one or more positions along the shaft 296 (e.g., lateral positions relative to the first side wall 214). This enables the adjustable object support 284 to brace various quantities of objects O. The operator or user may selectively move the adjustable object support 284 between the stowed and support positions as desired and/or needed in order to support the one or more objects O on the transport container 210.

Figure 53:
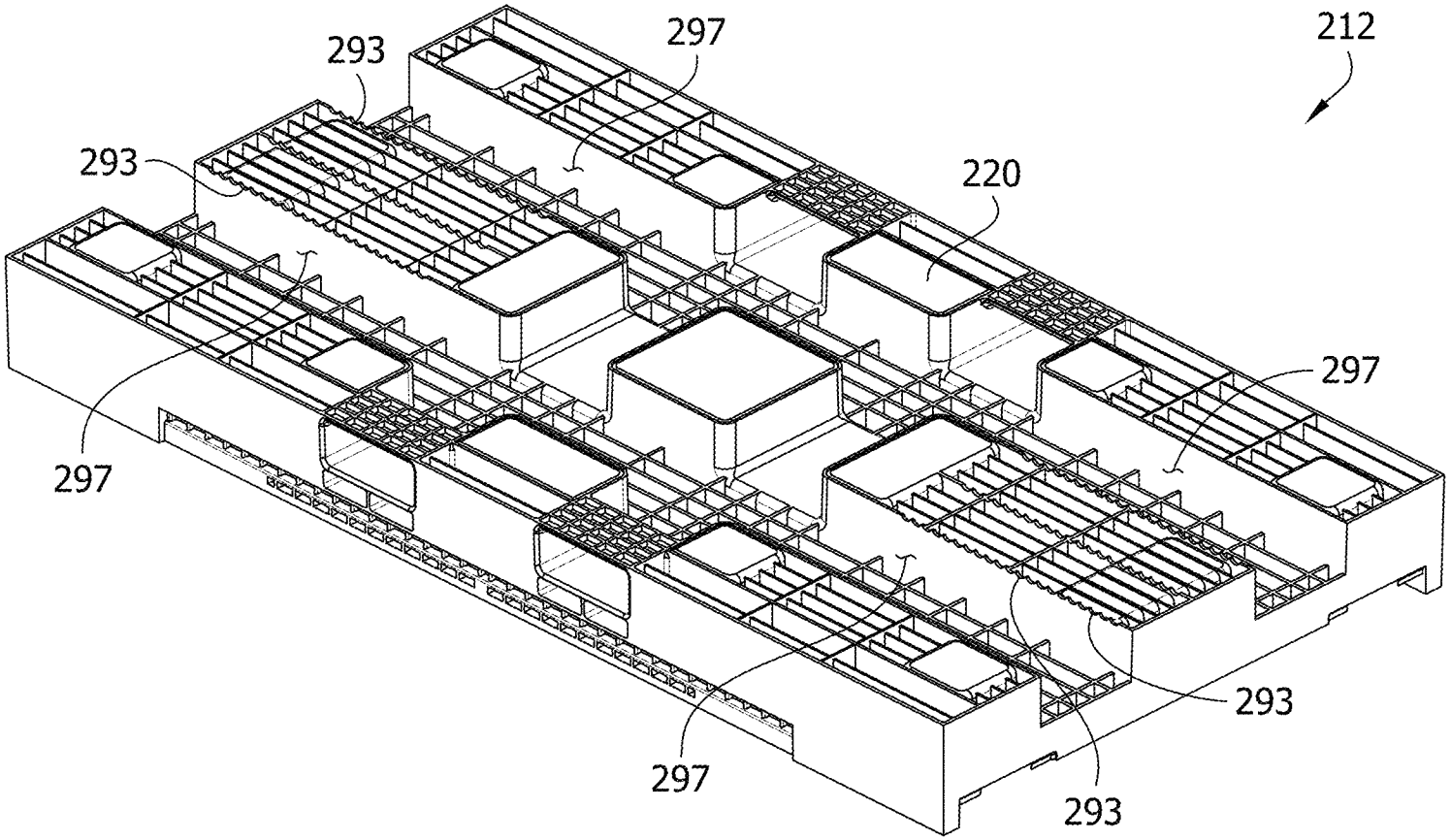
FIG. 53 is a lower perspective view of the base of the transport container shown in FIG. 49.

Referring to FIGS. 53-55, the first side wall 214 includes at least one first stacking projection 291. The first stacking projection 291 is configured to engage the base 212 of a second transport container 210 stacked on the first side wall 214 to inhibit movement (e.g., longitudinal movement) of the second transport container 210 relative to the first transport container 210. The first stacking projection 291 extends generally upward from the upper end 226 of the first side wall 214. The base 212 also includes (e.g., defines) a plurality (e.g., set) of stacking recesses 293. Each stacking recess 293 extends generally upward from the lower surface 220 of the base 212. Each stacking recess 293 is size and shaped to receive a first stacking projection 291 of another (e.g., second) transport container 210, when the second transport container 210 is stacked on the first transport container 210 (similar to what is shown in FIG. 48). The first stacking projection 291 and the stacking recess 293 may have generally any shape, as long as the shapes correspond to one another. The mating engagement between one of the stacking recesses 193 of a second transport container 210 and the first stacking projection 291 of the first transport container 210 facilitates the securement and aligning of the second transport container 210 on the first transport container 210 when the second transport container 210 is stacked on the first transport container 210. Specifically, the mating engagement between one of the stacking recesses 193 of a second transport container 210 and the first stacking projection 291 of the first transport container 210 inhibits longitudinal movement of the two stacked transport containers 210 relative to one another. The stacking recesses 293 (e.g., each set of stacking recesses 293) are arranged longitudinally, in a linear manner along the base 212. The stacking recesses 293 are arranged to correspond to the discrete positions the base 212 defines for the first side wall 214 so that regardless of what longitudinal position (e.g., extended position, contracted position, etc.) the first side wall 214 of the lower transport container 210 is in, one of the stacking recesses 293 of the upper transport container 210 are arranged to receive the first stacking projection 291 of the first side wall 214.

The first side wall 214 may also include at least one second stacking projection 295. The second stacking projection 295 is configured to engage the base 212 of a second transport container 210 stacked on the first side wall 214 to inhibit movement (e.g., lateral movement) of the second transport container 210 relative to the first transport container 210. The second stacking projection 295 extends generally upward from the upper end 226 of the first side wall 214. The base 212 also includes (e.g., defines) a stacking channel 297 (broadly, at least one stacking channel 297). The stacking channel 297 extends generally upward from the lower surface 220 of the base 212. The stacking channel 297 is generally parallel to the longitudinal axis LA. The stacking channel 297 is size and shaped to receive a second stacking projection 295 of another (e.g., second) transport container 210, when the second transport container 210 is stacked on the first transport container 210 (similar to what is shown in FIG. 48). The mating engagement between the stacking channel 297 of a second transport container 210 and the second stacking projection 295 of the first transport container 210 facilitates the securement and aligning of the second transport container 210 on the first transport container 210 when the second transport container 210 is stacked on the first transport container 210. Specifically, the mating engagement between the stacking channel 297 of a second transport container 210 and the second stacking projection 295 of the first transport container 210 inhibits lateral movement (e.g., movement generally transverse to the longitudinal axis LA) of the two stacked transport containers 210 relative to one another. Specifically, engagement between sides defining the stacking channel 297 and the second stacking projection 295 inhibit lateral movement. Since the stacking channel 297 extends longitudinally, the stacking channel 297 may receive the second stacking projection 295 regardless of which discrete longitudinal position (e.g., extended position, contracted position, etc.) the first side wall 214 is disposed at.

Accordingly, regardless of what discrete longitudinal position the first side wall 214 is in, the first side wall 214 of a first or lower transport container 210 can be used to support and secure the base 212 of a second or upper transport container 210 stacked thereon.

Having described the features and elements of the first side wall 214, it is appreciated that the second side wall 216 includes these same features and elements, as indicated in the drawings.

As is now apparent, the transport container 210 is movable between a collapsed configuration (shown in FIG. 50) and a deployed configuration (shown in FIGS. 49 and 51). In the collapsed configuration, the first and second side walls 214, 216 are in their collapsed positions and the braces 252 are in their stowed positions. In the collapsed configuration, several transport containers 210 may be stacked on top of each other in a relatively compact manner so that the transport containers 210 may be transported (e.g., returned to the sender of the one or more objects O). In the deployed configuration, the first and second side walls 214, 216 are in their deployed positions and the braces 252 are in their bracing position. The first and second side walls 214, 216 may be at generally any longitudinal location relative to the base 212 to conform the transport container 210 to the size of the one or more objects being carried. For example, the first and second side walls 214, 216 may be in the contracted position (e.g., a non-extended or retracted position), which generally corresponds to the first width WW1 (shown in FIG. 51), or the first and second side walls 214, 216 may be in the extended position, which generally corresponds to the second width WW2 (shown in FIG. 49). For example, the first and second side walls 214, 216 may be positioned to receive objects O, such as solar panels (e.g., panel 4), having a length of about 65 inches (1.65 m) (i.e., the first extended position) or about 77 inches (1.96 m) (i.e., the second extended position), although other arrangements are within the scope of the present disclosure. When supported by the transport container 210, the length (broadly, a dimension) of the one or more objects O is generally parallel to the width W of the transport container 210.

In operation, to collapse the transport container 310 from the deployed configuration, the operator moves the braces 252 to the stowed position. To move each brace 252, the brace retainer 270 is moved to the release position and then the brace 252 is moved (e.g., rotated) to the stowed position. After, the first and second side walls 214, 216 are rotated downward toward the base 212 about the retainers 238 to the collapsed position (as shown in FIG. 50).

To erect the transport container 210 from the collapsed configuration, the operator rotates the first and second side walls 214, 216 upward, away from the base 212 about the retainers 238 until the lower end 228 of each side wall 214, 216 abuts the base 212. Simultaneously or intermittently with the rotation, the operator may longitudinally move each side wall 214, 216 relative to the base 212 to a desired longitudinal position (e.g., extended position, contracted position, etc.). The locators 248 of each side wall 214, 216 are moved into alignment with the desired locator recesses 250 defining the desired longitudinal position the first and second side wall 214, 216 are to be positioned in. After the locators 248 of each side wall 214, 216 are aligned with the desired locator recesses 250, the side walls 214, 216 are continued to be rotated upward, thereby moving the locators 248 into their corresponding locator recesses 250. Erection (e.g., rotation) of the first and second side walls 214, 216 is completed when the lower end 228 of each side wall 214, 216 abuts the base 212. After the first and second side walls 214, 216 are in the upright position, the braces 252 are moved to bracing position. The brace retainer 270 of each brace 252 is moved to the coupling position once the brace 252 is in the bracing position to secure the brace 252 in the bracing position. After the transport container 210 is erected, one or more of the adjustable object supports 284 may be moved (before or after the objects O are loaded into the transport container 210) for bracing the one or more objects O supported by the transport container 210.

It is apparent and understood that the elements, features, and/or teachings set forth in each embodiment disclosed herein are not limited to the specific embodiment(s) the elements, features, and/or teachings are described in. Accordingly, it is apparent and understood that the elements, features, and/or teachings described in one embodiment may be applied to one or more of the other embodiments disclosed herein. For example, it is understood that any of the transport containers disclosed herein can include the adjustable object supports 284 shown in FIGS. 58-60.

Various objects and advantages of the present disclosure is thus apparent from the description herein taken in conjunction with the accompanying drawings wherein, by way of illustration and example, certain embodiments of this disclosure are set forth. The drawings submitted herewith constitute a part of this specification, include exemplary embodiments of the present disclosure, and illustrate various objects and features thereof.

Modifications and variations of the disclosed examples are possible without departing from the scope of the disclosure defined in the appended claims. For example, where specific dimensions are given, it will be understood that they are exemplary only and other dimensions are possible.

When introducing elements of the present disclosure or the example(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the present disclosure, it is intended that all matter contained in the above description and shown in the accompanying drawings shall be interpreted as illustrative and not in a limiting sense.

What is claimed is:

1. A transport container for carrying one or more generally planar objects, the transport container comprising:

a base configured to support the one or more generally planar objects;

opposing first and second side walls operatively connected to the base, the first and second side walls each having a lower end and a generally planar surface, at least one of the first and second side walls movable between an extended position and a contracted position, wherein the transport container has a first width between the first and second side walls when said at least one of the first and second side walls is in the extended position and a second width between the first and second side walls when said at least one of the first and second side walls is in the contracted position, the second width different from the first width;

wherein the first and second side walls are movable between a deployed position and a collapsed position, wherein the transport container has a first height when the first and second side walls are in the deployed position and a second height different than the first height when the first and second side walls are in the collapsed position; and a locator extending downward from the lower end of at least one of the first and second side walls beyond the generally planar surface, wherein the base defines a plurality of locator recesses sized and shaped to receive the locator such that the at least one of the first and second side walls is configured to move at discrete increments between the extended position and the contracted position when the locator is moved into a different locator recess of the plurality of locator recesses.

2. The transport container of claim 1, wherein the first and second side walls are each movable between the extended position and the contracted position.

3. The transport container of claim 1, wherein the first and second side walls are configured to move in opposite directions when moving between the extended position and the contracted position.

4. The transport container of claim 1, wherein the first and second side walls are releasably coupled to the base.

5. The transport container of claim 1, wherein the first and second side walls each include at least one retainer movable between a coupling position and a release position, wherein, when the at least one retainer is in the coupling position, the at least one retainer couples a corresponding side wall to the base, and wherein, when the at least one retainer is in the release position, the corresponding side wall is free to move from the base.

6. The transport container of claim 1, wherein the first and second side walls extend generally perpendicular to the base in the deployed position.

7. The transport container of claim 1, wherein the first and second side walls extend generally parallel to the base in the collapsed position.

8. The transport container of claim 1, further comprising a first brace configured to secure the first side wall in the deployed position and a second brace configured to secure the second side wall in the deployed position.

9. The transport container of claim 1, further comprising first and second braces movable between a bracing position and a stowed position, wherein, when the first and second braces are in the bracing position, the first and second side walls are restricted from moving between the collapsed position and the deployed position, and wherein, when the first and second braces are in the stowed position, the first and second side walls are free to move between the collapsed position and the deployed position.

10. The transport container of claim 1, further comprising first and second braces movable between a bracing position and a stowed position, wherein the first and second side walls each define a brace recess sized and shaped to receive a respective one of the first and second braces when the first and second braces are in the stowed position.

11. The transport container of claim 1, further comprising first and second braces movable between a bracing position and a stowed position, wherein the first and second braces engage the base in the bracing position.

12. The transport container of claim 8, wherein at least one of the first and second braces move with a respective at least one of the first and second side walls as the respective at least one of the first and second side walls is moved between the extended position and the contracted position.

13. The transport container of claim 1, further comprising one or more supports coupled to a shaft extending along a length of the first and second side walls, the one or more supports selectively movable along the length of the first and second side walls in at least one of a rearward direction and a forward direction, the one or more supports having a locked position wherein the one or more supports are prevented from moving along the shaft and an unlocked position wherein the one or more supports are configured to move along the shaft.

14. The transport container of claim 1, wherein at least one of the first and second side walls has an upper surface having at least one projection, and the base has a lower surface defining at least one recess sized and shaped to receive the at least one projection.

15. A transport container for carrying one or more generally planar objects, the transport container comprising:

a base configured to support the one or more generally planar objects;

first and second side walls supported by the base, at least one of the first and second side walls movable relative to the other of the first and second side walls to change a distance between the first and second side walls to conform the distance to a dimension of the one or more generally planar objects;

wherein the first and second side walls are movable between a deployed position and a collapsed position, wherein in the deployed position the first and second side walls are generally upright and wherein in the collapsed position the first and second side walls lay generally flat on the base; and an object support slidable along a shaft extending along a length of the first and second side walls, the object support is selectively movable along the length of the first and second side walls in at least one of a rearward direction and a forward direction, the object supports having a locked position wherein object support is prevented from moving along the shaft and an unlocked position wherein the object support is configured to slide along the shaft, wherein the object support further has a stowed position wherein the object support is rotated about the shaft such that the object support is configured to not brace the one or more generally planar objects.

16. The transport container of claim 15, wherein at least one of the first and second side walls includes a lower end and a locator extending downward from the lower end, and the base defines a plurality of locator recesses sized and shaped to receive the locator such that the at least one of the first and second side walls is configured to move at discrete increments between the extended position and the contracted position.

17. A transport container for carrying one or more generally planar objects, the transport container comprising:

a base configured to support the one or more generally planar objects;

first and second side walls supported by the base, at least one of the first and second side walls includes a shaft, at least one of the first and second side walls movable relative to the other of the first and second side walls to change a distance between the first and second side walls to conform the distance to a dimension of the one or more generally planar objects;

wherein the first and second side walls are movable between a deployed position and a collapsed position, wherein in the deployed position the first and second side walls are generally upright and wherein in the collapsed position the first and second side walls lay generally flat on the base; and at least one of the first and second side walls having a brace rotatably combined with the shaft, the brace rotatably movable around the shaft between a bracing position wherein the brace engages the base and a stowed position wherein the brace is received within a brace recess in the least one of the first and second side walls, the brace recess is sized and shaped to receive the brace when the brace is in the stowed position.

18. The transport container of claim 17 wherein the brace includes a plurality of projections configured to be received by recesses in the base when the brace is in the bracing position.

19. The transport container of claim 17 wherein the brace is configured to rotate 270 degrees around the shaft between the bracing position and the stowed position.

20. A transport container for carrying one or more generally planar objects, the transport container comprising:

a base configured to support the one or more generally planar objects;

first and second side walls supported by the base, at least one of the first and second side walls includes a shaft, at least one of the first and second side walls movable relative to the other of the first and second side walls to change a distance between the first and second side walls to conform the distance to a dimension of the one or more generally planar objects;

wherein the first and second side walls are movable between a deployed position and a collapsed position, wherein in the deployed position the first and second side walls are generally upright and wherein in the collapsed position the first and second side walls lay generally flat on the base; and at least one of the first and second side walls having a brace rotatably combined with the shaft, the brace rotatably movable around the shaft between a bracing position wherein the brace engages the base and a stowed position wherein the brace does not engage the base, wherein the brace is slidable longitudinally along the shaft to selectively engage the base in the bracing position.

* * * * *